US007601062B2

(12) United States Patent
Cole et al.

(10) Patent No.: US 7,601,062 B2
(45) Date of Patent: Oct. 13, 2009

(54) GAMING DEVICE AND METHOD INCLUDING MOVING PAYLINES

(75) Inventors: James M. Cole, Reno, NV (US); William J. Bussick, Reno, NV (US)

(73) Assignee: IGT, Reno, NV (US)

( * ) Notice: Subject to any disclaimer, the term of this patent is extended or adjusted under 35 U.S.C. 154(b) by 411 days.

(21) Appl. No.: 11/556,969

(22) Filed: Nov. 6, 2006

(65) Prior Publication Data

US 2008/0108409 A1 May 8, 2008

(51) Int. Cl.
*A63F 13/10* (2006.01)

(52) U.S. Cl. ..... 463/20; 463/16; 463/30; 463/31

(58) Field of Classification Search ..... 463/16–42
See application file for complete search history.

(56) References Cited

U.S. PATENT DOCUMENTS

| | | | |
|---|---|---|---|
| 4,198,052 | A | 4/1980 | Gauselmann |
| D261,782 | S | 11/1981 | Muir |
| 4,448,419 | A | 5/1984 | Telnaes |
| 4,618,150 | A | 10/1986 | Kimura |
| 4,624,459 | A | 11/1986 | Kaufman |
| 4,695,053 | A | 9/1987 | Vazquez, Jr. et al. |
| 4,732,386 | A | 3/1988 | Rayfiel |
| 4,756,531 | A | 7/1988 | DiRe et al. |
| 4,826,169 | A | 5/1989 | Bessho et al. |
| 4,838,552 | A | 6/1989 | Hagiwara |
| 4,874,173 | A | 10/1989 | Kishishita |
| 4,991,848 | A | 2/1991 | Greenwood et al. |
| 5,019,973 | A | 5/1991 | Wilcox et al. |
| 5,085,436 | A | 2/1992 | Bennett |
| 5,102,134 | A | 4/1992 | Smyth |
| 5,102,137 | A | 4/1992 | Ekiert |
| 5,209,479 | A | 5/1993 | Nagao et al. |

(Continued)

FOREIGN PATENT DOCUMENTS

| | | |
|---|---|---|
| EP | 0 060 019 | 9/1982 |

(Continued)

OTHER PUBLICATIONS

3 Way-Action Poker Advertisement, written by IGT, published in 2002.

(Continued)

*Primary Examiner*—Ronald Laneau
*Assistant Examiner*—Justin Myhr
(74) *Attorney, Agent, or Firm*—K&L Gates LLP

(57) ABSTRACT

A gaming device and methods of operating a gaming device including paylines that transition in relation to symbol display areas are disclosed. Paylines transition from one position to another position in which the payline is associated with a different combination of symbol display areas than the symbol display areas associated with the payline in the position prior to the transition. The gaming device evaluates symbols displayed in symbol display areas associated with the payline in each of the positions to determine if the generated symbols displayed in the associated symbol display areas include a winning symbol or combination of symbols. The transition of the paylines may be displayed as a movement of the paylines, or portions thereof, individually or as a group, across the viewing area of a display in a scrolling, shifting or rotating manner.

39 Claims, 54 Drawing Sheets

U.S. PATENT DOCUMENTS

| | | | |
|---|---|---|---|
| 5,308,065 | A | 5/1994 | Bridgeman et al. |
| 5,332,228 | A | 7/1994 | Schultz |
| 5,342,047 | A | 8/1994 | Heidel et al. |
| 5,344,144 | A | 9/1994 | Canon |
| 5,393,061 | A | 2/1995 | Manship et al. |
| 5,395,111 | A | 3/1995 | Inoue |
| 5,413,342 | A | 5/1995 | Kaplan |
| 5,423,539 | A | 6/1995 | Nagao |
| 5,431,408 | A | 7/1995 | Adams |
| 5,449,173 | A | 9/1995 | Thomas et al. |
| 5,542,669 | A | 8/1996 | Charron et al. |
| 5,569,084 | A | 10/1996 | Nicastro et al. |
| 5,580,053 | A | 12/1996 | Crouch |
| 5,580,055 | A | 12/1996 | Hagiwara |
| 5,584,764 | A | 12/1996 | Inoue |
| 5,609,524 | A | 3/1997 | Inoue |
| 5,611,535 | A | 3/1997 | Tiberio |
| 5,697,843 | A | 12/1997 | Manship et al. |
| 5,704,835 | A | 1/1998 | Dietz, II |
| 5,722,891 | A | 3/1998 | Inoue |
| 5,752,881 | A | 5/1998 | Inoue |
| 5,766,074 | A | 6/1998 | Cannon et al. |
| 5,769,716 | A | 6/1998 | Saffari et al. |
| 5,772,509 | A | 6/1998 | Weiss |
| 5,775,692 | A | 7/1998 | Watts et al. |
| 5,788,573 | A | 8/1998 | Baerlocher et al. |
| 5,807,172 | A | 9/1998 | Piechowiak |
| 5,810,361 | A | 9/1998 | Kadlic |
| 5,823,873 | A | 10/1998 | Moody |
| 5,823,874 | A | 10/1998 | Adams |
| 5,833,536 | A | 11/1998 | Davids et al. |
| 5,833,537 | A | 11/1998 | Barrie |
| 5,848,932 | A | 12/1998 | Adams |
| 5,851,148 | A | 12/1998 | Brune et al. |
| 5,882,259 | A | 3/1999 | Holmes, Jr. et al. |
| 5,882,261 | A | 3/1999 | Adams |
| 5,890,962 | A | 4/1999 | Takemoto |
| 5,902,184 | A | 5/1999 | Bennett et al. |
| 5,919,088 | A | 7/1999 | Weiss |
| 5,927,714 | A | 7/1999 | Kaplan |
| 5,947,820 | A | 9/1999 | Morro et al. |
| 5,951,397 | A | 9/1999 | Dickinson |
| 5,957,774 | A | 9/1999 | Holmes, Jr. et al. |
| 5,976,016 | A | 11/1999 | Moody et al. |
| 5,980,384 | A | 11/1999 | Barrie |
| 5,984,781 | A | 11/1999 | Sunaga |
| 5,984,782 | A | 11/1999 | Inoue |
| 5,997,400 | A | 12/1999 | Seelig et al. |
| 5,997,401 | A | 12/1999 | Crawford |
| 6,004,207 | A | 12/1999 | Wilson, Jr. et al. |
| 6,004,208 | A | 12/1999 | Takemoto et al. |
| 6,015,346 | A | 1/2000 | Bennett |
| 6,027,115 | A | 2/2000 | Griswold et al. |
| 6,033,307 | A | 3/2000 | Vancura |
| 6,056,642 | A | 5/2000 | Bennett |
| 6,059,289 | A | 5/2000 | Vancura |
| 6,059,658 | A | 5/2000 | Mangano et al. |
| 6,062,980 | A | 5/2000 | Luciano |
| 6,068,552 | A | 5/2000 | Walker et al. |
| 6,089,976 | A | 7/2000 | Schneider et al. |
| 6,089,977 | A | 7/2000 | Bennett |
| 6,089,978 | A | 7/2000 | Adams |
| 6,093,102 | A | 7/2000 | Bennett |
| 6,095,921 | A | 8/2000 | Walker et al. |
| 6,102,798 | A | 8/2000 | Bennett |
| 6,113,098 | A | 9/2000 | Adams |
| 6,120,031 | A | 9/2000 | Adams |
| 6,120,377 | A | 9/2000 | McGinnis, Sr. et al. |
| 6,120,378 | A | 9/2000 | Moody |
| 6,123,333 | A | 9/2000 | McGinnis, Sr. et al. |
| 6,126,542 | A | 10/2000 | Fier |
| 6,142,873 | A | 11/2000 | Weiss et al. |
| 6,142,874 | A | 11/2000 | Kodachi et al. |
| 6,142,875 | A | 11/2000 | Kodachi et al. |
| 6,146,273 | A | 11/2000 | Olsen |
| 6,155,925 | A | 12/2000 | Giobbi et al. |
| 6,159,095 | A | 12/2000 | Frohm et al. |
| 6,159,096 | A | 12/2000 | Yoseloff |
| 6,159,097 | A | 12/2000 | Gura |
| 6,159,098 | A | 12/2000 | Slomiany et al. |
| 6,165,070 | A | 12/2000 | Nolte et al. |
| 6,168,520 | B1 | 1/2001 | Baerlocher et al. |
| 6,174,233 | B1 | 1/2001 | Sunaga et al. |
| 6,186,894 | B1 | 2/2001 | Mayeroff |
| 6,190,254 | B1 | 2/2001 | Bennett |
| 6,190,255 | B1 | 2/2001 | Thomas et al. |
| 6,200,217 | B1 | 3/2001 | Osawa |
| 6,203,429 | B1 | 3/2001 | Demar et al. |
| 6,203,430 | B1 | 3/2001 | Walker et al. |
| 6,220,959 | B1 | 4/2001 | Holmes, Jr. et al. |
| 6,224,483 | B1 | 5/2001 | Mayeroff |
| 6,227,971 | B1 | 5/2001 | Weiss |
| 6,231,442 | B1 | 5/2001 | Mayeroff |
| 6,231,445 | B1 | 5/2001 | Acres |
| 6,234,897 | B1 | 5/2001 | Frohm et al. |
| 6,241,607 | B1 | 6/2001 | Payne et al. |
| 6,251,013 | B1 | 6/2001 | Bennett |
| 6,261,177 | B1 | 7/2001 | Bennett |
| 6,261,178 | B1 | 7/2001 | Bennett |
| 6,270,409 | B1 | 8/2001 | Shuster |
| 6,270,411 | B1 | 8/2001 | Gura et al. |
| 6,270,412 | B1 | 8/2001 | Crawford et al. |
| 6,299,165 | B1 | 10/2001 | Nagano |
| 6,299,170 | B1 | 10/2001 | Yoseloff |
| 6,302,398 | B1 | 10/2001 | Vecchio |
| 6,309,299 | B1 | 10/2001 | Weiss |
| 6,309,300 | B1 | 10/2001 | Glavich |
| 6,311,976 | B1 | 11/2001 | Yoseloff et al. |
| 6,315,660 | B1 | 11/2001 | DeMar et al. |
| 6,315,663 | B1 | 11/2001 | Sakamoto |
| 6,315,664 | B1 | 11/2001 | Baerlocher et al. |
| 6,319,124 | B1 | 11/2001 | Baerlocher et al. |
| 6,322,078 | B1 | 11/2001 | Adams |
| 6,328,649 | B1 | 12/2001 | Randall et al. |
| 6,336,860 | B1 | 1/2002 | Webb |
| 6,346,043 | B1 | 2/2002 | Colin et al. |
| 6,347,996 | B1 | 2/2002 | Gilmore et al. |
| 6,358,144 | B1 | 3/2002 | Kaddlic et al. |
| 6,358,147 | B1 | 3/2002 | Jaffe et al. |
| 6,364,314 | B1 | 4/2002 | Canterbury |
| 6,364,766 | B1 | 4/2002 | Anderson et al. |
| 6,375,570 | B1 | 4/2002 | Poole |
| 6,386,973 | B1 | 5/2002 | Yoseloff |
| 6,386,975 | B1 | 5/2002 | Peterson |
| 6,394,902 | B1 | 5/2002 | Glavich et al. |
| 6,398,218 | B1 | 6/2002 | Vancura |
| 6,413,162 | B1 | 7/2002 | Baerlocher et al. |
| 6,419,579 | B1 | 7/2002 | Bennett |
| 6,439,943 | B1 | 8/2002 | Aoki et al. |
| 6,439,993 | B1 | 8/2002 | O'Halloran |
| 6,454,266 | B1 | 9/2002 | Breeding et al. |
| 6,461,241 | B1 | 10/2002 | Webb et al. |
| 6,464,581 | B1 | 10/2002 | Yoseloff et al. |
| 6,491,584 | B2 | 12/2002 | Graham et al. |
| 6,494,454 | B2 | 12/2002 | Adams |
| 6,517,432 | B1 | 2/2003 | Jaffe |
| 6,544,120 | B2 | 4/2003 | Ainsworth |
| 6,547,242 | B1 | 4/2003 | Sugiyama et al. |
| 6,551,187 | B1 | 4/2003 | Jaffe |
| 6,558,254 | B2 | 5/2003 | Baerlocher et al. |
| 6,561,900 | B1 | 5/2003 | Baerlocher et al. |
| 6,602,137 | B2 | 8/2003 | Kaminkow et al. |
| 6,604,740 | B1 | 8/2003 | Singer et al. |
| 6,604,999 | B2 | 8/2003 | Ainsworth |

| | | | | |
|---|---|---|---|---|
| 6,605,002 | B2 | 8/2003 | Baerlocher | |
| 6,609,971 | B2 | 8/2003 | Vancura | |
| 6,612,574 | B1 | 9/2003 | Cole et al. | |
| 6,612,575 | B1 | 9/2003 | Cole et al. | |
| 6,616,142 | B2 | 9/2003 | Adams | |
| 6,632,139 | B1 | 10/2003 | Baerlocher | |
| 6,634,945 | B2 | 10/2003 | Glavich et al. | |
| 6,644,664 | B2 | 11/2003 | Muir et al. | |
| 6,676,511 | B2 | 1/2004 | Payne et al. | |
| 6,676,512 | B2 | 1/2004 | Fong et al. | |
| 6,695,696 | B1 * | 2/2004 | Kaminkow | 463/16 |
| 6,780,111 | B2 | 8/2004 | Cannon et al. | |
| 6,786,818 | B1 | 9/2004 | Rothschild et al. | |
| 6,790,141 | B2 | 9/2004 | Muir | |
| 6,793,578 | B2 | 9/2004 | Luccesi et al. | |
| 6,832,957 | B2 | 12/2004 | Falconer | |
| 6,864,357 | B2 | 3/2005 | Eggen et al. | |
| 6,866,585 | B2 | 3/2005 | Muir | |
| 6,869,357 | B2 | 3/2005 | Adams et al. | |
| 6,875,107 | B1 | 4/2005 | Luciano, Jr. | |
| 6,896,615 | B2 | 5/2005 | Berman | |
| 6,896,617 | B2 | 5/2005 | Daly | |
| 6,905,405 | B2 | 6/2005 | McClintic | |
| 6,905,406 | B2 | 6/2005 | Kaminkow et al. | |
| 6,939,226 | B1 | 9/2005 | Joshi | |
| 6,960,133 | B1 | 11/2005 | Marks et al. | |
| 6,966,835 | B2 | 11/2005 | Graham | |
| 6,974,385 | B2 | 12/2005 | Joshi et al. | |
| 7,001,274 | B2 | 2/2006 | Baerlocher et al. | |
| 7,014,560 | B2 | 3/2006 | Glavich et al. | |
| 7,029,395 | B1 | 4/2006 | Baerlocher | |
| 7,052,395 | B2 | 5/2006 | Glavich et al. | |
| 7,056,213 | B2 | 6/2006 | Ching et al. | |
| 7,070,502 | B1 | 7/2006 | Bussick et al. | |
| 7,128,647 | B2 | 10/2006 | Muir | |
| 7,156,736 | B2 | 1/2007 | Adams et al. | |
| 7,160,188 | B2 | 1/2007 | Kaminkow et al. | |
| 7,161,589 | B2 | 1/2007 | Muir | |
| 7,169,042 | B2 | 1/2007 | Muir et al. | |
| 7,192,345 | B2 | 3/2007 | Muir et al. | |
| 2001/0041610 | A1 | 11/2001 | Luciano et al. | |
| 2001/0054794 | A1 | 12/2001 | Cole et al. | |
| 2002/0014740 | A1 | 2/2002 | Ainsworth | |
| 2002/0025844 | A1 | 2/2002 | Casey et al. | |
| 2002/0055382 | A1 | 5/2002 | Meyer | |
| 2002/0065124 | A1 | 5/2002 | Ainsworth | |
| 2002/0090990 | A1 | 7/2002 | Joshi et al. | |
| 2002/0094857 | A1 | 7/2002 | Meyer | |
| 2002/0094862 | A1 | 7/2002 | Inoue | |
| 2003/0013518 | A1 | 1/2003 | Graham | |
| 2003/0017868 | A1 | 1/2003 | Crawford | |
| 2003/0045345 | A1 | 3/2003 | Berman | |
| 2003/0060266 | A1 | 3/2003 | Baerlocher | |
| 2003/0069068 | A1 | 4/2003 | Kaminkow | |
| 2003/0092480 | A1 | 5/2003 | White et al. | |
| 2003/0114215 | A1 | 6/2003 | Adams et al. | |
| 2003/0144053 | A1 | 7/2003 | Michaelson | |
| 2003/0203752 | A1 | 10/2003 | Kaminkow et al. | |
| 2003/0216165 | A1 | 11/2003 | Singer et al. | |
| 2004/0009803 | A1 | 1/2004 | Bennett et al. | |
| 2004/0023714 | A1 | 2/2004 | Asdale | |
| 2004/0048650 | A1 | 3/2004 | Mierau et al. | |
| 2004/0053677 | A1 | 3/2004 | Hughs-Baird | |
| 2004/0058727 | A1 | 3/2004 | Marks et al. | |
| 2004/0077401 | A1 | 4/2004 | Schlottmann | |
| 2004/0077402 | A1 | 4/2004 | Schlottmann | |
| 2004/0097280 | A1 | 5/2004 | Gauselmann | |
| 2004/0180714 | A1 | 9/2004 | Ward | |
| 2004/0192431 | A1 | 9/2004 | Singer et al. | |
| 2004/0195773 | A1 | 10/2004 | Musci et al. | |
| 2004/0219968 | A1 | 11/2004 | Fiden et al. | |
| 2004/0242314 | A1 | 12/2004 | Casey | |
| 2005/0054420 | A1 | 3/2005 | Cregan et al. | |
| 2005/0054429 | A1 | 3/2005 | Baerlocher et al. | |
| 2005/0054436 | A1 | 3/2005 | Frizzell et al. | |
| 2005/0059481 | A1 | 3/2005 | Joshi et al. | |
| 2005/0060050 | A1 | 3/2005 | Baerlocher et al. | |
| 2005/0096123 | A1 | 5/2005 | Cregan et al. | |
| 2005/0124404 | A1 | 6/2005 | Nicely | |
| 2005/0124406 | A1 | 6/2005 | Cannon | |
| 2005/0130731 | A1 | 6/2005 | Englman et al. | |
| 2005/0130737 | A1 | 6/2005 | Englman et al. | |
| 2005/0148384 | A1 | 7/2005 | Marks et al. | |
| 2005/0170876 | A1 | 8/2005 | Masci et al. | |
| 2005/0192081 | A1 | 9/2005 | Marks et al. | |
| 2005/0208994 | A1 | 9/2005 | Berman | |
| 2006/0046830 | A1 * | 3/2006 | Webb | 463/20 |
| 2006/0068892 | A1 * | 3/2006 | Gomez et al. | 463/20 |
| 2006/0084497 | A1 | 4/2006 | Marks et al. | |
| 2006/0089191 | A1 | 4/2006 | Singer et al. | |
| 2006/0121969 | A1 | 6/2006 | Marks et al. | |
| 2006/0148554 | A1 * | 7/2006 | Hornik et al. | 463/20 |
| 2006/0183535 | A1 | 8/2006 | Marks et al. | |
| 2006/0246977 | A1 | 11/2006 | Cannon | |
| 2007/0026923 | A1 | 2/2007 | Muir | |
| 2007/0077980 | A1 | 4/2007 | Marks et al. | |
| 2007/0111782 | A1 | 5/2007 | Adams et al. | |
| 2007/0129134 | A1 | 6/2007 | Barrie | |
| 2007/0191087 | A1 | 8/2007 | Thomas et al. | |

FOREIGN PATENT DOCUMENTS

| | | |
|---|---|---|
| EP | 0 238 289 | 9/1987 |
| EP | 0 410 789 | 7/1990 |
| EP | 0 984 408 | 3/2000 |
| GB | 2 090 690 | 7/1982 |
| GB | 2 096 376 | 10/1982 |
| GB | 2 097 160 | 10/1982 |
| GB | 2 100 905 | 1/1983 |
| GB | 2 105 891 | 3/1983 |
| GB | 2 117 155 | 10/1983 |
| GB | 2 137 392 | 10/1984 |
| GB | 2 161 008 | 1/1986 |
| GB | 2 170 636 | 8/1986 |
| GB | 2 181 589 | 4/1987 |
| GB | 2 183 882 | 6/1987 |
| GB | 2 191 030 | 12/1987 |
| GB | 2 222 712 | 3/1990 |
| GB | 2 225 889 | 6/1990 |
| GB | 2 226 436 | 6/1990 |
| GB | 2 226 907 | 7/1990 |
| GB | 2 242 300 | 9/1991 |
| GB | 2 262 642 | 6/1993 |
| GB | 2 316 214 | 2/1998 |
| GB | 2 328 311 | 2/1999 |
| WO | WO 96/08799 | 3/1996 |

OTHER PUBLICATIONS

3 Way-Action Poker, IGT, Advertisement [online], [retrieved on Mar. 21, 2001]. Retrieved from the internet <URL: http://www.igt.com/games/new_games/3way_poker.html>.

Barn Yard Article, written by Strictly Slots, published in Mar. 2002.

Bonus Line Lightning Advertisement, written by Bally Gaming, available prior to Nov. 6, 2006.

Break the Spell Advertisement, written by Atronic, published in 1999.

Catch A Wave Advertisement, written by IGT, published in Dec. 2001.

Cossack Dance Advertisement, written by Olympic Video Gaming, available prior to Nov. 6, 2006.

Description of Animating Symbol Feature in Gaming Machine, written by IGT, available prior to Nov. 6, 2006.

Description of Gaming Machine with Animating Symbols, written by IGT, available prior to Nov. 6, 2006.

Description of Symbol Feature in Australian UFO Gaming Machine, published by Barcrest, Ltd., in 1995.

Enchanted Unicorn Advertisement, written by IGT, published in 2001.
Enchanted Unicorn Advertisement, written by IGT, published in 2003.
Fey, Marshall, Slot Machines—A Pictorial History of the First 100 Years, 1997, Liberty Bell Books, 5th Ed., p. 13.
Fishin' Buddies Article, written by Strictly Slots, published in Apr. 2001.
Gold Fever Advertisement ,written by Atronic Casino Technology, Ltd., published 1999.
Goooaal! Advertisement, written by Bally Gaming, Inc., published in 2000.
Happy Camper Advertisement, written by IGT, published in 2004.
I Love Lucy: Vitameatavegamin and I Love Lucy, Chocolate Factory IGT Articles, written by Strictly Slots, published in Jan. 2003 and May 2003.
Jewel in the Crown Advertisement, written by IGT, published 1999.
Loco Loot Article, written by Strictly Slots, published in May 2002.
Mountain Money Article, written by Strictly Slots, published in Jun. 2002.
Penguin Pays Advertisement, written by Aristocrat, published in 1998.
Reel Magic™ Gaming Machine Description, written by IGT, available in 1986.
Slot Machine on Parade Book, 1st Edition, p. 193, written by Robert N. Geddes and illustrade by Daniel R. Mead, published in 1980.
Sphinx II Article, written by Strictly Slots, published in Nov. 2001.
Stooges II Article, written by Strictly Slots, published in Jun. 2001.
The Latest Buzz Article, written by Bally Gaming Systems, published in Fall 2000.
Wild Bear Salmon Run Advertisement, written by IGT, published in 2003.
Wild Cougar Article, written by Strictly Slots, published in 2004.
Wild Streak Article, written by Strictly Slots, published in Mar. 2001.
Big Business Advertisement, written by VIDCO, published prior to Nov. 6, 2006.
Gambling Article, written Daniel R. Mead, published in Oct. 1993.
Ole Advertisement, written by Pacific Gaming, published prior to Nov. 6, 2006.
Bally Medalist Advertisement [online] [retrieved on Apr. 16, 2007, available prior to Nov. 6, 2006]. Retrieved from the Internet at <URL: http://cosmicpinball.com>.
Just Chillin Advertisment [online] [retrieved on Apr. 9, 2007, available prior to Nov. 6, 2006]. Retrieved from the Internet at <URL: http://www.novagamingllc.com>.

* cited by examiner

FIG. 4A

Wager Table

140

| | Minimum Wager |
|---|---|
| Each Payline | 1 credit |
| First Shift of Wagered-On Paylines | 1 credit/payline |
| Two or more Shifts of Wagered-On Paylines | 2 credits/payline |

FIG. 4B

Wager Table

142

| | Minimum Wager |
|---|---|
| Each Payline | 1 credit |
| First Shift of Wagered-On Paylines | 3 credits/payline |
| Two or more Shifts of Wagered-On Paylines | 2 credits/payline |

FIG. 4C

Wager Table

144

| | Minimum Wager |
|---|---|
| Each Payline | 1 credit |
| First Shift of Wagered-On Paylines | 3 credits |
| Two or more Shifts of Wagered-On Paylines | 2 credits/shift |

GAMING DEVICE AND METHOD INCLUDING MOVING PAYLINES

COPYRIGHT NOTICE

A portion of the disclosure of this patent document contains or may contain material which is subject to copyright protection. The copyright owner has no objection to the photocopy reproduction by anyone of the patent document or the patent disclosure in exactly the form it appears in the Patent and Trademark Office patent file or records, but otherwise reserves all copyright rights whatsoever.

BACKGROUND

Manufacturers of gaming devices seek to enhance the enjoyment and excitement of the gaming experience through unique and creative ways of generating and indicating game outcomes. Conventional gaming machines or devices include mechanical or virtual reels. Each reel has a series of symbol display areas spaced along the reel. When the reels are positioned adjacent to one another on a gaming device, the symbol display areas form a grid or matrix of displayed symbol display areas. For example, three reels placed side-by-side, each with three displayed symbol display areas, form a three-by-three matrix of nine displayed symbol display areas. Similarly, five reels placed side-by-side, each with three displayed symbol display areas, form a three-by-five matrix of fifteen displayed symbol display areas. Symbols generated by the gaming device are displayed in the symbol display areas.

In conventional slot machines, a number of paylines are displayed in fixed positions in association with certain displayed symbol display areas of the matrix. The number of paylines can vary; for instance, a slot machine can one, three, five, nine, fifteen, twenty-five or any other suitable number of paylines. The paylines can be straight to indicate a row of adjacent symbol display areas, or paylines can vary in direction and configuration to indicate adjacent symbol display areas in different rows.

The displayed symbol display areas connected by each payline form a predetermined fixed grouping of symbol display areas. Symbols generated by the gaming device and displayed in the grouping of symbol display areas are evaluated for winning symbols and combinations of symbols within that fixed grouping.

In a conventional slot game, a player is provided a single wagering opportunity limited to choosing one or more particular paylines on which to place a wager for the play of the game. After the player wagers on one or more paylines, the reels spin, and the gaming device generates and displays a plurality of symbols on the reels. The gaming device evaluates the symbols displayed in each group of symbol display areas indicated by each of the paylines on which the player placed a wager. If a winning outcome is detected among the symbols displayed in the symbol display areas along a wagered-on payline, an award is provided to the player.

Some known gaming devices allow paylines to be evaluated for a winning outcome without an additional wager. Other known gaming devices include a nudge feature in which a reel is caused to move or rotate in a particular direction to move a different symbol into a symbol display area indicated by a payline. After the movement of the reel, the indicated symbols are evaluated for any winning combinations.

Each of these known features involving paylines and their relationship with symbol display areas, however, include paylines that remain in a fixed predetermined location and in a fixed association with symbol display areas of the display.

To increase player enjoyment and excitement, it is desirable to provide players with new and different ways to indicate and achieve winning outcomes in a game as well as to provide new and different wagering features in gaming machines.

SUMMARY

The present disclosure relates in general to gaming devices and methods, and more particularly to gaming devices and methods providing moving, shifting, rotating or scrolling paylines.

Various embodiments of the present disclosure include changing symbol display areas indicated by one or more paylines while symbols displayed in those symbol display areas remain displayed. The symbol display areas indicated by a payline may be changed by a transition of the payline in relation to a fixed display of symbol display areas, a transition of symbol display areas in relation to a fixed display of the payline, a shift of a symbol displayed into an indicated symbol display area, a change in a configuration of a payline, or combinations thereof. In various embodiments of the present disclosure, one or more of the paylines may move relative to the symbols or reels. The configuration or shape of each payline varies along the length of the payline and, thus, provides for different symbol evaluations. The present disclosure further provides multiple different paylines moving simultaneously, or as groups or sets of paylines. All of the paylines of a gaming machine may be in one group, or may be in different subgroups.

In various embodiments, paylines may be displayed in a variety of different ways in accordance with the present disclosure. Paylines may be displayed having portions or sections of the paylines associated with symbol display areas and portions or sections of the paylines not associated with the symbol display areas. Additional paylines may also be displayed not associated with the symbol display areas at a point in time. The paylines in various embodiments may extend across the entire viewing area of the display having an entry or origination point into the viewing area of the display and an exit point from the viewing area of the display.

In addition to enabling a player to select one or more paylines to be activated for evaluation, various embodiments of the present disclosure include a gaming device operable to enable the player to select particular paylines to undergo a transition and to determine the number of transitions and evaluations of the paylines. Each of these control features may be provided based on alternative wagers which can be made by a player or in other suitable manners.

In an embodiment, the gaming device generates symbols to be displayed in symbol display areas of the display. The symbols may be displayed by any suitable type of reels or other symbol generators or symbol display devices. A reel, for example, may be configured to display three, four, five or any suitable number of symbols in the symbol display areas of the display. Alternatively, one or more of the reels may be independent or a unisymbol reel. Each independent reel is adapted to display a single symbol in a single symbol display area of the display.

In an embodiment, the gaming device evaluates the displayed symbols indicated by an activated payline in a first position. The evaluation includes a determination of any winning outcomes such as a winning symbol or combination of symbols on the activated paylines. The payline then moves, shifts, rotates, or scrolls. Based on the same symbols and the new payline configuration, a second evaluation is performed to determine winning outcomes on the activated payline. This process may be performed for each activated payline. The paylines may move, shift, rotate, or scroll, etc. individually or as one or more groups between evaluations.

In addition or alternatively, the paylines may move, shift, rotate, scroll, etc. as generated symbols are displayed in the symbol display areas of the display, such as during the spinning of reels. Paylines may move at different speeds and/or for different durations in relation to the spinning reels. For example, the reels may stop to display a plurality of symbols in the symbol display areas while one or more of the paylines continue to move. In one embodiment, the gaming device may enable a player to control when the paylines and/or the reels stop in relation to one another.

Thus, it should be appreciated that in various embodiments of the gaming device, a transition of one or more paylines may occur. This transition may be based on an event in a game such as a designated wager, a random or predetermined triggering event or outcome, a selection or any other suitable event. In various embodiments, the displayed symbols remain in a fixed association with the symbol display areas for the multiple evaluations. The gaming device transitions at least one payline from a first position to a different second position such that the combination of the symbol display areas associated with the payline in the second position of the payline is different from the combination of symbol display areas associated with the payline in the first position. A combination of symbol display areas may be different due to at least one different symbol display area in the combination or a different number of symbol display areas in the combination. In an embodiment, the paylines may or may not move together simultaneously.

In various embodiments, the transition of a payline from a first position to a second position may include a movement sequence. Movement of the payline may proceed in any suitable direction, in any linear or non-linear manner into and out of a three-dimensional plane, or combinations thereof, at any suitable speed and for any suitable duration. For example, paylines may move in a scrolling or rotating fashion across a viewing area of a display from top to bottom, from bottom to top, from left to right, from right to left, or any combination.

Movement of a payline or portion thereof may be displayed as a spatial progression from an entry or origination point into the viewing area of the display across the display to an exit point from the viewing area of the display. The spatial progression of a payline to positions associated with symbol display areas may include any suitable number of transitions and evaluations and, in one embodiment, such transitions are defined by stop positions arranged along the payline.

In an embodiment, for any number of transitions, the value of an outcome based on the evaluation of symbols indicated by the transitioned payline may increase or decrease. An increasing multiplier, for example, may be associated with any number of transitions.

In embodiments of the present disclosure, paylines may include an associated payline indicator. A payline indicator may modify an outcome of the game when the payline indicator is associated with a symbol display area upon a transition of the payline. A payline indicator may replace a symbol displayed in the associated symbol display area with a symbol such as a wild symbol. The payline indicator may act as a modifier or multiplier of an award associated with a winning combination of symbols indicated by the payline. The payline indicator may initiate a regeneration of the symbols displayed in at least one symbol display area.

The extent of a payline transition from a first position may be any suitable random or predetermined spatial transition such as between non-symbol display areas and symbol display areas, between adjacent symbol display areas, between non-adjacent symbol display areas, through a set of symbol display areas, through a display of symbol display areas, or any portion or combinations thereof.

The number of transitions may be random, predetermined, or based on a wager or based on an event or outcome of a game. For example, transitions and evaluations may occur until a winning outcome is achieved, until a losing outcome is achieved, until a terminator symbol associated with a payline is associated with at least one symbol display area, or until any other suitable event or outcome occurs in a game.

In various embodiments of the present disclosure including non-symbol display areas, such as, for example, blanks between symbols on a reel, paylines may be associated with non-symbol display areas as well as symbol display areas. A transition from a first position to a second position may include a transition from a position of one or more paylines in association with at least one non-symbol display area to a position of one or more paylines in association with at least one symbol display area.

It should thus be appreciated that payline transition may include a change in the configuration of the payline to associate the payline with at least one different symbol display area. The change in configuration of the payline may change in a same position of the payline on the display. Alternatively, the change in configuration of the payline may occur as it transitions from one position to another on the display or as one or more symbol display areas transition from one position to another on the display.

In other embodiments, a transition includes the transition of one or more symbol display areas in relation to at least one payline. For example, a set of symbol display areas may transition from one position to another position as a group, or sub-group thereof, or individually. In another example, a set of symbol display areas displayed on a reel may separate from symbol display areas associated with a group of reels upon a transition and may transition independent of other reels. In another example, a symbol display area associated with an independent reel may separate from adjacent symbol display areas in a transition and may transition independent of other symbol display areas.

Transitions of symbol display areas in relation to paylines and transitions of paylines in relation to symbol display areas may occur in an alternating, sequential or simultaneous manner. For example, paylines may move in a scrolling or rotating fashion across a viewing area of a display during a movement of symbol display areas.

Features of the embodiments described above may be combined in embodiments including the display of an array or group of paylines. At least one payline of the array of paylines includes a configuration different than the other paylines. In an embodiment, at least one set of symbol display areas, such as a matrix formed by a set of reels, may move in relation to a fixed array of displayed paylines. The generated symbols remain in a fixed association with the symbol display areas. Transition of the set of symbol display areas from a first position to a second position may include movement in any suitable direction.

In various embodiments, the gaming device evaluates the displayed symbols indicated by the transitioned payline for a winning outcome after one or more transitions. Upon a transition from a first position to a second position of the set of symbol display areas in relation to the paylines, at least one payline indicates at least one symbol display area in the second position different than the symbol display areas indicated by the payline in the first position. With each transition of the set of symbol display areas to a different position on the array of paylines, the gaming device may perform an evaluation for a winning outcome in the symbol display areas indicated by active paylines.

In various embodiments of the present disclosure, multiple sets of symbol display areas may be displayed in association with the displayed array of paylines. Each set of symbol display areas may include symbols independently generated to be displayed in each symbol display area of the set. Alternatively, symbols may be duplicated in one or more of the symbol display areas or sets of symbol display areas. Sets of symbol display areas may overlap on the array of paylines. Symbols displayed in symbol display areas from different sets of symbol display areas associated with the same paylines may be evaluated for a winning outcome. In addition, wagers may be place on selected sets of symbol display areas. Also, outcomes associated with one or more transitions of one set of symbol display areas may be compared to outcomes associated with one or more transitions of another set of symbol display areas in a competition game.

In an embodiment, a plurality of symbol display areas associated by display of at least two related symbols and not a payline undergo a transition to include at least one different symbol display area. The gaming device performs an evaluation for a winning symbol or combination of symbols of symbols displayed by the shifted associated symbol display areas.

It should thus be appreciated that various embodiments of the gaming device disclosed herein increase player excitement and enjoyment by providing unique and creative displays of indicating symbols to be evaluated for an award. Various embodiments of the gaming device disclosed herein also provide players additional opportunities to achieve a winning outcome in a game and provide additional features of a game a player may be enabled to control and on which a player may place a wager.

Additional features and advantages are described herein, and will be apparent from, the following Detailed Description and the figures.

BRIEF DESCRIPTION OF THE FIGURES

FIGS. 4A, 4B and 4C are front views of exemplary wager charts of different embodiments disclosed herein.

FIGS. 7A, 7B and 7C are front views of a display device of at least one embodiment disclosed herein illustrating an alternative display of a transition of one or more paylines in relation to symbol display areas.

DETAILED DESCRIPTION

Gaming Device

The present disclosure may be implemented in various configurations for gaming machines or gaming devices, including but not limited to: (1) a dedicated gaming machine or gaming device, wherein the computerized instructions for controlling any games (which are provided by the gaming machine or gaming device) are provided with the gaming machine or gaming device prior to delivery to a gaming establishment; and (2) a changeable gaming machine or gaming device, where the computerized instructions for controlling any games (which are provided by the gaming machine or gaming device) are downloadable to the gaming machine or gaming device through a data network when the gaming machine or gaming device is in a gaming establishment. In one embodiment, the computerized instructions for controlling any games are executed by a central server, central controller or remote host. In such a "thin client" embodiment, the central server remotely controls any games (or other suitable interfaces) and the gaming device is utilized to display such games (or suitable interfaces) and receive one or more inputs or commands from a player. In another embodiment, the computerized instructions for controlling any games are communicated from the central server, central controller or remote host to a gaming device local processor and memory devices. In such a "thick client" embodiment, the gaming device local processor executes the communicated computerized instructions to control any games (or other suitable interfaces) provided to a player.

In one embodiment, one or more gaming devices in a gaming system may be thin client gaming devices and one or more gaming devices in the gaming system may be thick client gaming devices. In another embodiment, certain functions of the gaming device are implemented in a thin client environment and certain other functions of the gaming device are implemented in a thick client environment. In one such embodiment, computerized instructions for controlling any primary games are communicated from the central server to the gaming device in a thick client configuration and computerized instructions for controlling any secondary games or bonus functions are executed by a central server in a thin client configuration.

Figure 1A:
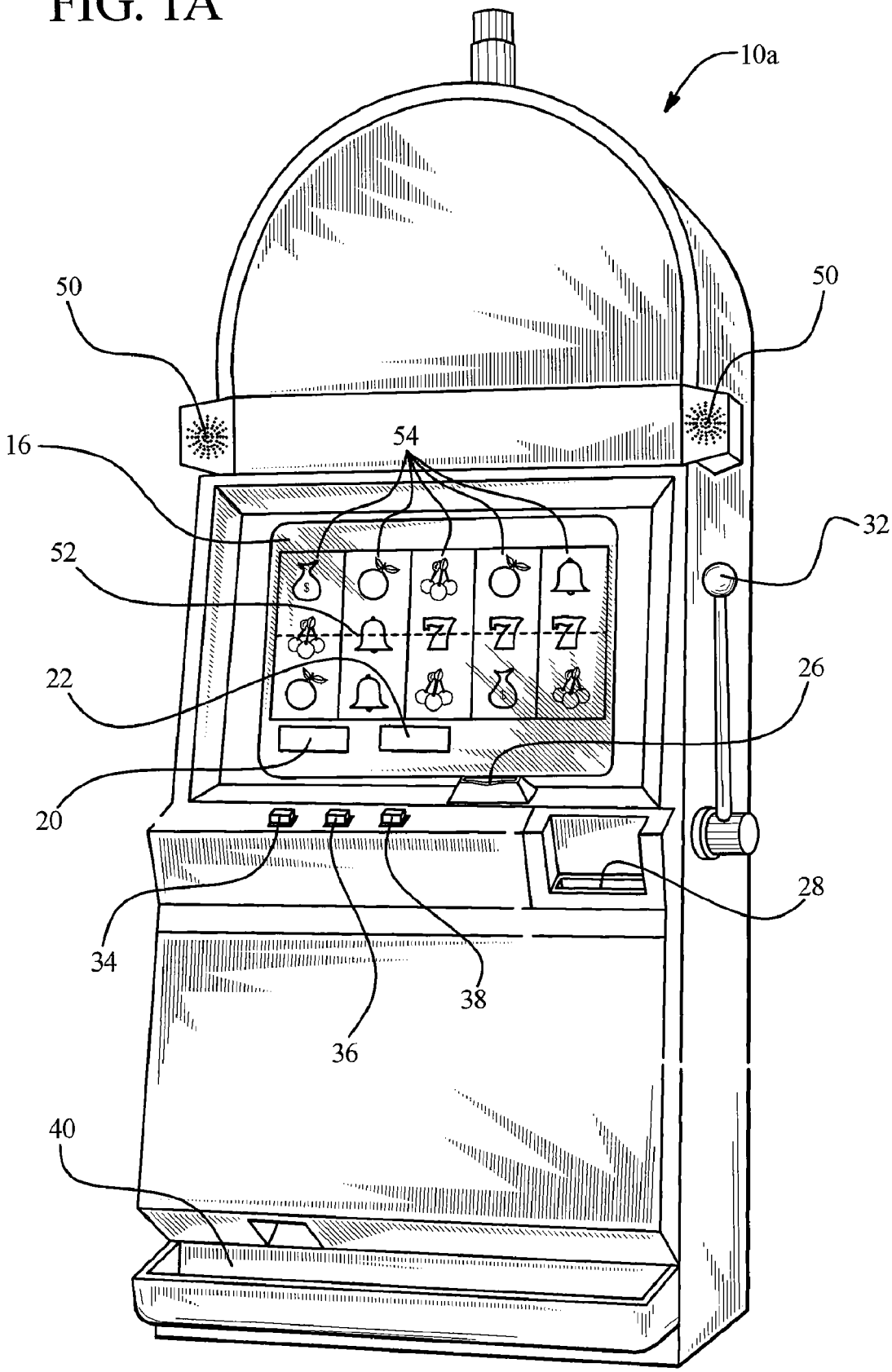
FIGS. 1A and 1B are perspective views of alternative embodiments of the gaming device of the present disclosure.
Figure 1B:
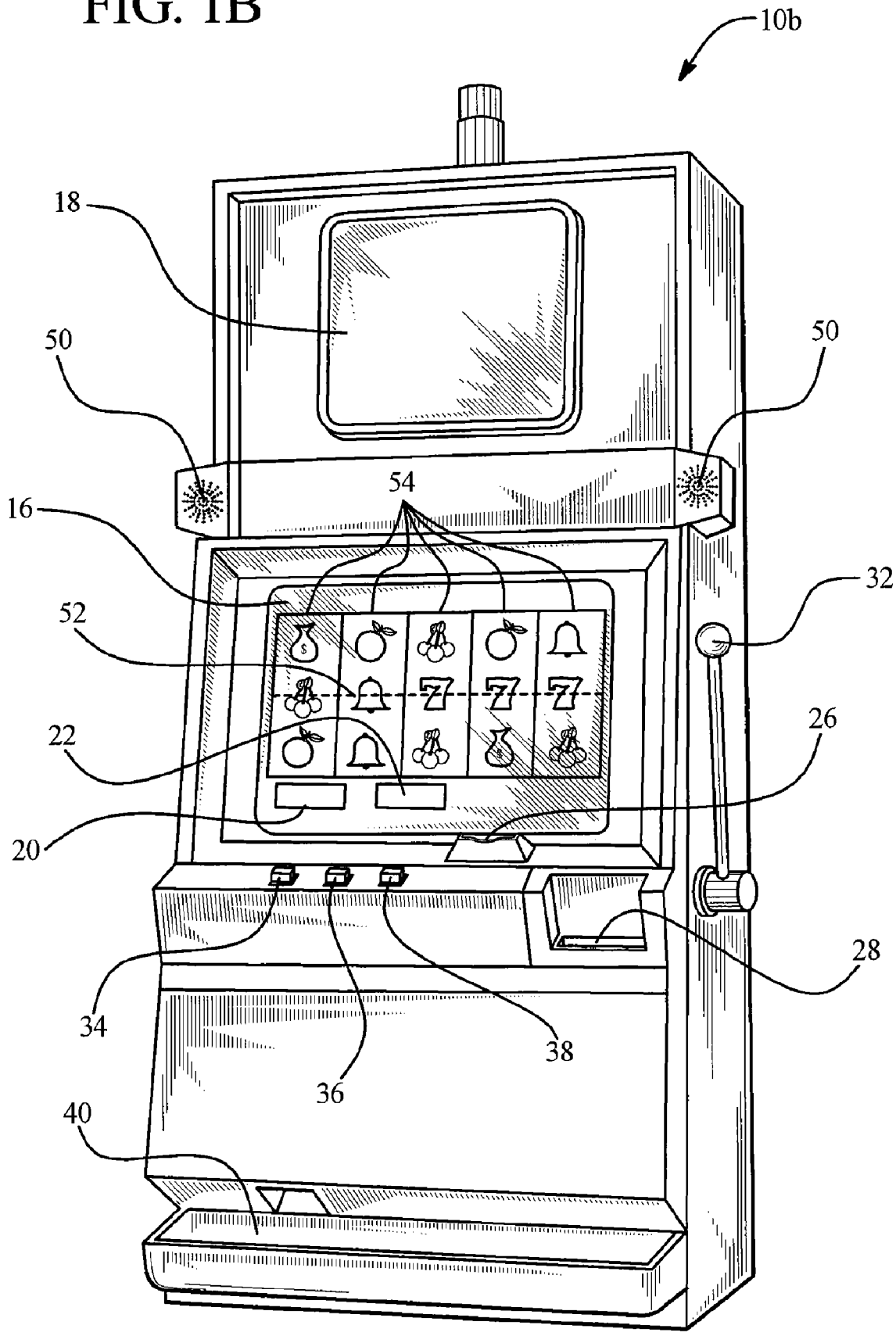

Referring now to the drawings, two example alternative embodiments of the gaming device of the disclosed herein are illustrated in FIGS. 1A and 1B as gaming device 10*a* and gaming device 10*b*, respectively. Gaming device 10*a* and/or gaming device 10*b* are generally referred to herein as gaming device 10.

In the embodiments illustrated in FIGS. 1A and 1B, gaming device 10 has a support structure, housing or cabinet which provides support for a plurality of displays, inputs, controls and other features of a conventional gaming machine. It is configured so that a player can operate it while standing or sitting. The gaming device may be positioned on a base or stand or can be configured as a pub-style table-top game (not shown) which a player can operate preferably while sitting. As illustrated by the different configurations shown in FIGS. 1A and 1B, the gaming device may have varying cabinet and display configurations.

Figure 2A:
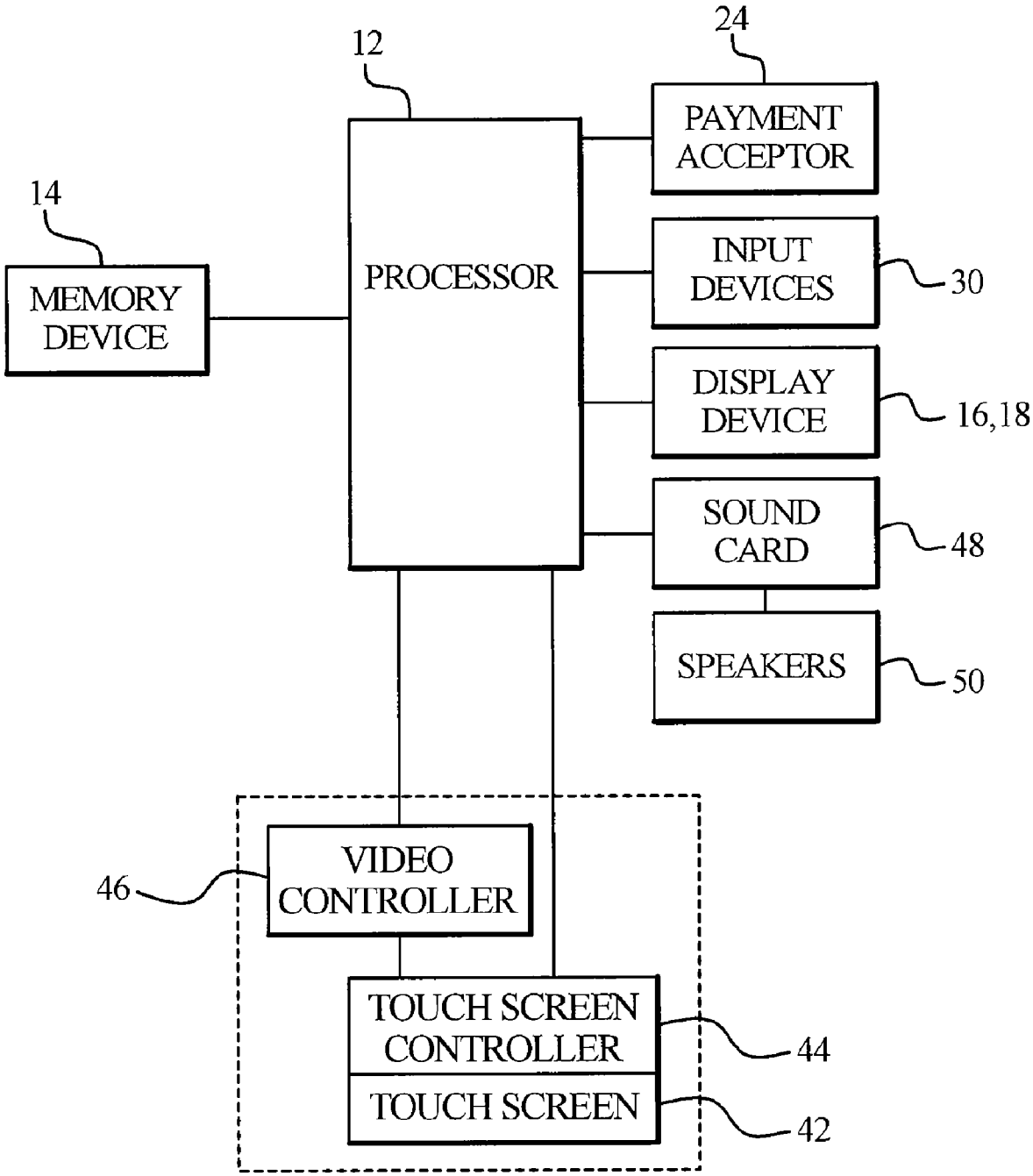
FIG. 2A is a schematic block diagram of the electronic configuration of one embodiment of the gaming device of the present disclosure.

In one embodiment, as illustrated in FIG. 2A, the gaming device preferably includes at least one processor 12, such as a microprocessor, a microcontroller-based platform, a suitable integrated circuit or one or more application-specific integrated circuits (ASIC's). The processor is in communication with or operable to access or to exchange signals with at least one data storage or memory device 14. In one embodiment, the processor and the memory device reside within the cabinet of the gaming device. The memory device stores program code and instructions, executable by the processor, to control the gaming device. The memory device also stores other data such as image data, event data, player input data, random or pseudo-random number generators, pay-table data or information and applicable game rules that relate to the play of the gaming device. In one embodiment, the memory device includes random access memory (RAM), which can include non-volatile RAM (NVRAM), magnetic RAM (MRAM), ferroelectric RAM (FeRAM) and other forms as commonly understood in the gaming industry. In one embodiment, the memory device includes read only memory (ROM). In one embodiment, the memory device includes flash memory and/or EEPROM (electrically erasable programmable read only memory). Any other suitable magnetic, optical and/or semiconductor memory may operate in conjunction with the gaming device disclosed herein.

In one embodiment, part or all of the program code and/or operating data described above can be stored in a detachable or removable memory device, including, but not limited to, a suitable cartridge, disk, CD ROM, DVD or USB memory device. In other embodiments, part or all of the program code and/or operating data described above can be downloaded to the memory device through a suitable network.

In one embodiment, an operator or a player can use such a removable memory device in a desktop computer, a laptop personal computer, a personal digital assistant (PDA), portable computing device, or other computerized platform to implement the present disclosure. In one embodiment, the gaming device or gaming machine disclosed herein is operable over a wireless network, such as part of a wireless gaming system. In this embodiment, the gaming machine may be a hand held device, a mobile device or any other suitable wireless device that enables a player to play any suitable game at a variety of different locations. It should be appreciated that a gaming device or gaming machine as disclosed herein may be a device that has obtained approval from a regulatory gaming commission or a device that has not obtained approval from a regulatory gaming commission. It should be appreciated that the processor and memory device may be collectively referred to herein as a "computer" or "controller."

In one embodiment, as discussed in more detail below, the gaming device randomly generates awards and/or other game outcomes based on probability data. In one such embodiment, this random determination is provided through utilization of a random number generator (RNG), such as a true random number generator, a pseudo random number generator or other suitable randomization process. In one embodiment, each award or other game outcome is associated with a probability and the gaming device generates the award or other game outcome to be provided to the player based on the associated probabilities. In this embodiment, since the gaming device generates outcomes randomly or based upon one or more probability calculations, there is no certainty that the gaming device will ever provide the player with any specific award or other game outcome.

In another embodiment, as discussed in more detail below, the gaming device employs a predetermined or finite set or pool of awards or other game outcomes. In this embodiment, as each award or other game outcome is provided to the player, the gaming device flags or removes the provided award or other game outcome from the predetermined set or pool. Once flagged or removed from the set or pool, the specific provided award or other game outcome from that specific pool cannot be provided to the player again. This type of gaming device provides players with all of the available awards or other game outcomes over the course of the play cycle and guarantees the amount of actual wins and losses.

In another embodiment, as discussed below, upon a player initiating game play at the gaming device, the gaming device enrolls in a bingo game. In this embodiment, a bingo server calls the bingo balls that result in a specific bingo game outcome. The resultant game outcome is communicated to the individual gaming device to be provided to a player. In one embodiment, this bingo outcome is displayed to the player as a bingo game and/or in any form in accordance with the present disclosure.

In one embodiment, as illustrated in FIG. 2A, the gaming device includes one or more display devices controlled by the processor. The display devices are preferably connected to or mounted to the cabinet of the gaming device. The embodiment shown in FIG. 1A includes a central display device 16 which displays a primary game. This display device may also display any suitable secondary game associated with the primary game as well as information relating to the primary or secondary game. The alternative embodiment shown in FIG. 1B includes a central display device 16 and an upper display device 18. The upper display device may display the primary game, any suitable secondary game associated or not associated with the primary game and/or information relating to the primary or secondary game. These display devices may also serve as digital glass operable to advertise games or other aspects of the gaming establishment. As seen in FIGS. 1A and 1B, in one embodiment, the gaming device includes a credit display 20 which displays a player's current number of credits, cash, account balance or the equivalent. In one embodiment, gaming device includes a bet display 22 which displays a player's amount wagered.

In another embodiment, at least one display device may be a mobile display device, such as a PDA or tablet PC, that enables play of at least a portion of the primary or secondary game at a location remote from the gaming device.

The display devices may include, without limitation, a monitor, a television display, a plasma display, a liquid crystal display (LCD) a display based on light emitting diodes (LED), a display based on a plurality of organic light-emitting diodes (OLEDs), a display based on polymer light-emitting diodes (PLEDs), a display based on a plurality of surface-conduction electron-emitters (SEDs), a display including a projected and/or reflected image or any other suitable electronic device or display mechanism. In one embodiment, as described in more detail below, the display device includes a touch-screen with an associated touch-screen controller. The display devices may be of any suitable size and configuration, such as a square, a rectangle or an elongated rectangle.

The display devices of the gaming device are configured to display at least one and preferably a plurality of game or other suitable images, symbols and indicia such as any visual representation or exhibition of the movement of objects such as mechanical, virtual or video reels and wheels, dynamic lighting, video images, images of people, characters, places, things and faces of cards, and the like.

In one alternative embodiment, the symbols, images and indicia displayed on or of the display device may be in mechanical form. That is, the display device may include any electromechanical device, such as one or more mechanical objects, such as one or more rotatable wheels, reels or dice, configured to display at least one or a plurality of game or other suitable images, symbols or indicia.

As illustrated in FIG. 2A, in one embodiment, the gaming device includes at least one payment acceptor 24 in communication with the processor. As seen in FIGS. 1A and 1B, the payment acceptor may include a coin slot 26 and a payment, note or bill acceptor 28, where the player inserts money, coins or tokens. The player can place coins in the coin slot or paper money, a ticket or voucher into the payment, note or bill acceptor. In other embodiments, devices such as readers or validators for credit cards, debit cards or credit slips may accept payment. In one embodiment, a player may insert an identification card into a card reader of the gaming device. In one embodiment, the identification card is a smart card having a programmed microchip or a magnetic strip coded with a player's identification, credit totals (or related data) and other relevant information. In another embodiment, a player may carry a portable device, such as a cell phone, a radio frequency identification tag or any other suitable wireless device, which communicates a player's identification, credit totals (or related data) and other relevant information to the gaming device. In one embodiment, money may be transferred to a gaming device through electronic funds transfer. When a player funds the gaming device, the processor determines the amount of funds entered and displays the corresponding amount on the credit or other suitable display as described above.

As seen in FIGS. 1A, 1B and 2A, in one embodiment the gaming device includes at least one and preferably a plurality of input devices 30 in communication with the processor. The input devices can include any suitable device which enables the player to produce an input signal which is received by the processor. In one embodiment, after appropriate funding of the gaming device, the input device is a game activation device, such as a pull arm 32 or a play button 34 which is used by the player to start any primary game or sequence of events in the gaming device. The play button can be any suitable play activator such as a bet one button, a max bet button or a repeat the bet button. In one embodiment, upon appropriate funding, the gaming device begins the game play automatically. In another embodiment, upon the player engaging one of the play buttons, the gaming device automatically activates game play.

In one embodiment, as shown in FIGS. 1A and 1B, one input device is a bet one button 36. The player places a bet by pushing the bet one button. The player can increase the bet by one credit each time the player pushes the bet one button. When the player pushes the bet one button, the number of credits shown in the credit display preferably decreases by one, and the number of credits shown in the bet display preferably increases by one. In another embodiment, one input device is a bet max button (not shown) which enables the player to bet the maximum wager permitted for a game of the gaming device.

In one embodiment, one input device is a cash out button 38. The player may push the cash out button and cash out to receive a cash payment or other suitable form of payment corresponding to the number of remaining credits. In one embodiment, when the player cashes out, the player receives the coins or tokens in a coin payout tray 40. In one embodiment, when the player cashes out, the player may receive other payout mechanisms such as tickets or credit slips redeemable by a cashier (or other suitable redemption system) or funding to the player's electronically recordable identification card.

In one embodiment, as mentioned above and seen in FIG. 2A, one input device is a touch-screen 42 coupled with a touch-screen controller 44, or some other touch-sensitive display overlay to allow for player interaction with the images on the display. The touch-screen and the touch-screen controller are connected to a video controller 46. A player can make decisions and input signals into the gaming device by touching the touch-screen at the appropriate places. One such input device is a touch-screen button panel. It should be appreciated that the utilization of touch-screens is widespread in the gaming industry.

The gaming device may further include a plurality of communication ports for enabling communication of the processor with external peripherals, such as external video sources, expansion buses, game or other displays, an SCSI port or a key pad.

In one embodiment, as seen in FIG. 2A, the gaming device includes a sound generating device controlled by one or more sounds cards 48 which function in conjunction with the processor. In one embodiment, the sound generating device includes at least one and preferably a plurality of speakers 50 or other sound generating hardware and/or software for generating sounds, such as playing music for the primary and/or secondary game or for other modes of the gaming device, such as an attract mode. In one embodiment, the gaming device provides dynamic sounds coupled with attractive multimedia images displayed on one or more of the display devices to provide an audio-visual representation or to otherwise display full-motion video with sound to attract players to the gaming device. During idle periods, the gaming device may display a sequence of audio and/or visual attraction messages to attract potential players to the gaming device. The videos may also be customized for or to provide any appropriate information.

In one embodiment, the gaming machine may include a sensor, such as a camera in communication with the processor (and possibly controlled by the processor) that is selectively positioned to acquire an image of a player actively using the gaming device and/or the surrounding area of the gaming device. In one embodiment, the camera may be configured to selectively acquire still or moving (e.g., video) images and may be configured to acquire the images in either an analog, digital or other suitable format. The display devices may be configured to display the image acquired by the camera as well as display the visible manifestation of the game in split screen or picture-in-picture fashion. For example, the camera may acquire an image of the player and the processor may incorporate that image into the primary and/or secondary game as a game image, symbol or indicia.

Gaming device 10 can incorporate any suitable wagering primary or base game. The gaming machine or device may include some or all of the features of conventional gaming machines or devices. The primary or base game may comprise any suitable reel-type game, card game, cascading or falling symbol game, number game or other game of chance susceptible to representation in an electronic or electromechanical form, which in one embodiment produces a random outcome based on probability data at the time of or after placement of a wager. That is, different primary wagering games, such as video poker games, video blackjack games, video keno, video bingo or any other suitable primary or base game may be implemented.

In one embodiment, as illustrated in FIGS. 1A and 1B, a base or primary game may be a slot game with one or more paylines 52. The paylines may be horizontal, vertical, circular, diagonal, angled or any combination thereof. In this embodiment, the gaming device includes at least one and preferably a plurality of reels 54, such as three to five reels 54, in either electromechanical form with mechanical rotating reels or video form with simulated reels and movement thereof. In one embodiment, an electromechanical slot machine includes a plurality of adjacent, rotatable reels which may be combined and operably coupled with an electronic display of any suitable type. In another embodiment, if the reels 54 are in video form, one or more of the display devices, as described above, display the plurality of simulated video reels 54. Each reel 54 displays a plurality of indicia or symbols, such as bells, hearts, fruits, numbers, letters, bars or other images which preferably correspond to a theme associated with the gaming device. In another embodiment, one or more of the reels are independent reels or unisymbol reels. In this embodiment, each independent or unisymbol reel generates and displays one symbol to the player. In one embodiment, the gaming device awards prizes after the reels of the primary game stop spinning if specified types and/or configurations of indicia or symbols occur on an active payline or otherwise occur in a winning pattern, occur on the requisite number of adjacent reels and/or occur in a scatter pay arrangement.

In an alternative embodiment, rather than determining any outcome to provide to the player by analyzing the symbols generated on any wagered upon paylines as described above, the gaming device determines any outcome to provide to the player based on the number of associated symbols which are generated in active symbol positions on the requisite number of adjacent reels (i.e., not on paylines passing through any displayed winning symbol combinations). In this embodiment, if a winning symbol combination is generated on the reels, the gaming device provides the player one award for that occurrence of the generated winning symbol combination. For example, if one winning symbol combination is generated on the reels, the gaming device will provide a single award to the player for that winning symbol combination (i.e., not based on the number of paylines that would have passed through that winning symbol combination). It should be appreciated that because a gaming device with wagering on ways to win provides the player one award for a single occurrence of a winning symbol combination and a gaming device with paylines may provide the player more than one award for the same occurrence of a single winning symbol combination (i.e., if a plurality of paylines each pass through the same winning symbol combination), it is possible to provide a player at a ways to win gaming device with more ways to win for an equivalent bet or wager on a traditional slot gaming device with paylines.

In one embodiment, the total number of ways to win is determined by multiplying the number of symbols generated in active symbol positions on a first reel by the number of symbols generated in active symbol positions on a second reel by the number of symbols generated in active symbol positions on a third reel and so on for each reel of the gaming device with at least one symbol generated in an active symbol position. For example, a three reel gaming device with three symbols generated in active symbol positions on each reel includes 27 ways to win (i.e., 3 symbols on the first reel×3 symbols on the second reel×3 symbols on the third reel). A four reel gaming device with three symbols generated in active symbol positions on each reel includes 81 ways to win (i.e., 3 symbols on the first reel×3 symbols on the second reel×3 symbols on the third reel×3 symbols on the fourth reel). A five reel gaming device with three symbols generated in active symbol positions on each reel includes 243 ways to win (i.e., 3 symbols on the first reel×3 symbols on the second reel×3 symbols on the third reel×3 symbols on the fourth reel×3 symbols on the fifth reel). It should be appreciated that modifying the number of generated symbols by either modifying the number of reels or modifying the number of symbols generated in active symbol positions by one or more of the reels, modifies the number of ways to win.

In another embodiment, the gaming device enables a player to wager on and thus activate symbol positions. In one such embodiment, the symbol positions are on the reels. In this embodiment, if based on the player's wager, a reel is activated, then each of the symbol positions of that reel will be activated and each of the active symbol positions will be part of one or more of the ways to win. In one embodiment, if based on the player's wager, a reel is not activated, then a designated number of default symbol positions, such as a single symbol position of the middle row of the reel, will be activated and the default symbol position(s) will be part of one or more of the ways to win. This type of gaming machine enables a player to wager on one, more or each of the reels and the processor of the gaming device uses the number of wagered on reels to determine the active symbol positions and the number of possible ways to win. In alternative embodiments, (1) no symbols are displayed as generated at any of the inactive symbol positions, or (2) any symbols generated at any inactive symbol positions may be displayed to the player but suitably shaded or otherwise designated as inactive.

In one embodiment wherein a player wagers on one or more reels, a player's wager of one credit may activate each of the three symbol positions on a first reel, wherein one default symbol position is activated on each of the remaining four reels. In this example, as described above, the gaming device provides the player three ways to win (i.e., 3 symbols on the first reel×1 symbol on the second reel×1 symbol on the third reel×1 symbol on the fourth reel×1 symbol on the fifth reel). In another example, a player's wager of nine credits may activate each of the three symbol positions on a first reel, each of the three symbol positions on a second reel and each of the three symbol positions on a third reel wherein one default symbol position is activated on each of the remaining two reels. In this example, as described above, the gaming device provides the player twenty-seven ways to win (i.e., 3 symbols on the first reel×3 symbols on the second reel×3 symbols on the third reel×1 symbol on the fourth reel×1 symbol on the fifth reel).

In one embodiment, to determine any award(s) to provide to the player based on the generated symbols, the gaming device individually determines if a symbol generated in an active symbol position on a first reel forms part of a winning symbol combination with or is otherwise suitably related to a symbol generated in an active symbol position on a second reel. In this embodiment, the gaming device classifies each pair of symbols which form part of a winning symbol combination (i.e., each pair of related symbols) as a string of related symbols. For example, if active symbol positions include a first cherry symbol generated in the top row of a first reel and a second cherry symbol generated in the bottom row of a second reel, the gaming device classifies the two cherry symbols as a string of related symbols because the two cherry symbols form part of a winning symbol combination.

After determining if any strings of related symbols are formed between the symbols on the first reel and the symbols on the second reel, the gaming device determines if any of the symbols from the next adjacent reel should be added to any of the formed strings of related symbols. In this embodiment, for a first of the classified strings of related symbols, the gaming device determines if any of the symbols generated by the next adjacent reel form part of a winning symbol combination or are otherwise related to the symbols of the first string of related symbols. If the gaming device determines that a symbol generated on the next adjacent reel is related to the symbols of the first string of related symbols, that symbol is subsequently added to the first string of related symbols. For example, if the first string of related symbols is the string of related cherry symbols and a related cherry symbol is generated in the middle row of the third reel, the gaming device adds the related cherry symbol generated on the third reel to the previously classified string of cherry symbols.

On the other hand, if the gaming device determines that no symbols generated on the next adjacent reel are related to the symbols of the first string of related symbols, the gaming device marks or flags such string of related symbols as complete. For example, if the first string of related symbols is the string of related cherry symbols and none of the symbols of the third reel are related to the cherry symbols of the previously classified string of cherry symbols, the gaming device marks or flags the string of cherry symbols as complete.

After either adding a related symbol to the first string of related symbols or marking the first string of related symbols as complete, the gaming device proceeds as described above for each of the remaining classified strings of related symbols which were previously classified or formed from related symbols on the first and second reels.

After analyzing each of the remaining strings of related symbols, the gaming device determines, for each remaining pending or incomplete string of related symbols, if any of the symbols from the next adjacent reel, if any, should be added to any of the previously classified strings of related symbols. This process continues until either each string of related symbols is complete or there are no more adjacent reels of symbols to analyze. In this embodiment, where there are no more adjacent reels of symbols to analyze, the gaming device marks each of the remaining pending strings of related symbols as complete.

When each of the strings of related symbols is marked complete, the gaming device compares each of the strings of related symbols to an appropriate paytable and provides the player any award associated with each of the completed strings of symbols. It should be appreciated that the player is provided one award, if any, for each string of related symbols generated in active symbol positions (i.e., as opposed to being based on how many paylines that would have passed through each of the strings of related symbols in active symbol positions).

In one embodiment, a base or primary game may be a poker game wherein the gaming device enables the player to play a conventional game of video draw poker and initially deals five cards all face up from a virtual deck of fifty-two card deck. Cards may be dealt as in a traditional game of cards or in the case of the gaming device, may also include that the cards are randomly selected from a predetermined number of cards. If the player wishes to draw, the player selects the cards to hold via one or more input device, such as pressing related hold buttons or via the touch screen. The player then presses the deal button and the unwanted or discarded cards are removed from the display and the gaming machine deals the replacement cards from the remaining cards in the deck. This results in a final five-card hand. The gaming device compares the final five-card hand to a payout table which utilizes conventional poker hand rankings to determine the winning hands. The gaming device provides the player with an award based on a winning hand and the credits the player wagered.

In another embodiment, the base or primary game may be a multi-hand version of video poker. In this embodiment, the gaming device deals the player at least two hands of cards. In one such embodiment, the cards are the same cards. In one embodiment each hand of cards is associated with its own deck of cards. The player chooses the cards to hold in a primary hand. The held cards in the primary hand are also held in the other hands of cards. The remaining non-held cards are removed from each hand displayed and for each hand replacement cards are randomly dealt into that hand. Since the replacement cards are randomly dealt independently for each hand, the replacement cards for each hand will usually be different. The poker hand rankings are then determined hand by hand and awards are provided to the player.

In one embodiment, a base or primary game may be a keno game wherein the gaming device displays a plurality of selectable indicia or numbers on at least one of the display devices. In this embodiment, the player selects at least one or a plurality of the selectable indicia or numbers via an input device such as the touch screen. The gaming device then displays a series of drawn numbers to determine an amount of matches, if any, between the player's selected numbers and the gaming device's drawn numbers. The player is provided an award based on the amount of matches, if any, based on the amount of determined matches and the number of numbers drawn.

In one embodiment, in addition to winning credits or other awards in a base or primary game, the gaming device may also give players the opportunity to win credits in a bonus or secondary game or bonus or secondary round. The bonus or secondary game enables the player to obtain a prize or payout in addition to the prize or payout, if any, obtained from the base or primary game. In general, a bonus or secondary game produces a significantly higher level of player excitement than the base or primary game because it provides a greater expectation of winning than the base or primary game and is accompanied with more attractive or unusual features than the base or primary game. In one embodiment, the bonus or secondary game may be any type of suitable game, either similar to or completely different from the base or primary game.

In one embodiment, the triggering event or qualifying condition may be a selected outcome in the primary game or a particular arrangement of one or more indicia on a display device in the primary game, such as the number seven appearing on three adjacent reels along a payline in the primary slot game embodiment seen in FIGS. 1A and 1B. In other embodiments, the triggering event or qualifying condition may be by exceeding a certain amount of game play (such as number of games, number of credits, amount of time), or reaching a specified number of points earned during game play.

In another embodiment, the gaming device processor 12 or central server 56 randomly provides the player one or more plays of one or more secondary games. In one such embodiment, the gaming device does not provide any apparent reasons to the player for qualifying to play a secondary or bonus game. In this embodiment, qualifying for a bonus game is not triggered by an event in or based specifically on any of the plays of any primary game. That is, the gaming device may simply qualify a player to play a secondary game without any explanation or alternatively with simple explanations. In another embodiment, the gaming device (or central server) qualifies a player for a secondary game at least partially based on a game triggered or symbol triggered event, such as at least partially based on the play of a primary game.

In one embodiment, the gaming device includes a program which will automatically begin a bonus round after the player has achieved a triggering event or qualifying condition in the base or primary game. In another embodiment, after a player has qualified for a bonus game, the player may subsequently enhance his/her bonus game participation through continued play on the base or primary game. Thus, for each bonus qualifying event, such as a bonus symbol, that the player obtains, a given number of bonus game wagering points or credits may be accumulated in a "bonus meter" programmed to accrue the bonus wagering credits or entries toward eventual participation in a bonus game. The occurrence of multiple such bonus qualifying events in the primary game may result in an arithmetic or exponential increase in the number of bonus wagering credits awarded. In one embodiment, the player may redeem extra bonus wagering credits during the bonus game to extend play of the bonus game.

In one embodiment, no separate entry fee or buy in for a bonus game need be employed. That is, a player may not purchase an entry into a bonus game, rather they must win or earn entry through play of the primary game thus, encouraging play of the primary game. In another embodiment, qualification of the bonus or secondary game is accomplished through a simple "buy in" by the player, for example, if the player has been unsuccessful at qualifying through other specified activities. In another embodiment, the player must make a separate side-wager on the bonus game or wager a designated amount in the primary game to qualify for the secondary game. In this embodiment, the secondary game triggering event must occur and the side-wager (or designated primary game wager amount) must have been placed to trigger the secondary game.

Figure 2B:
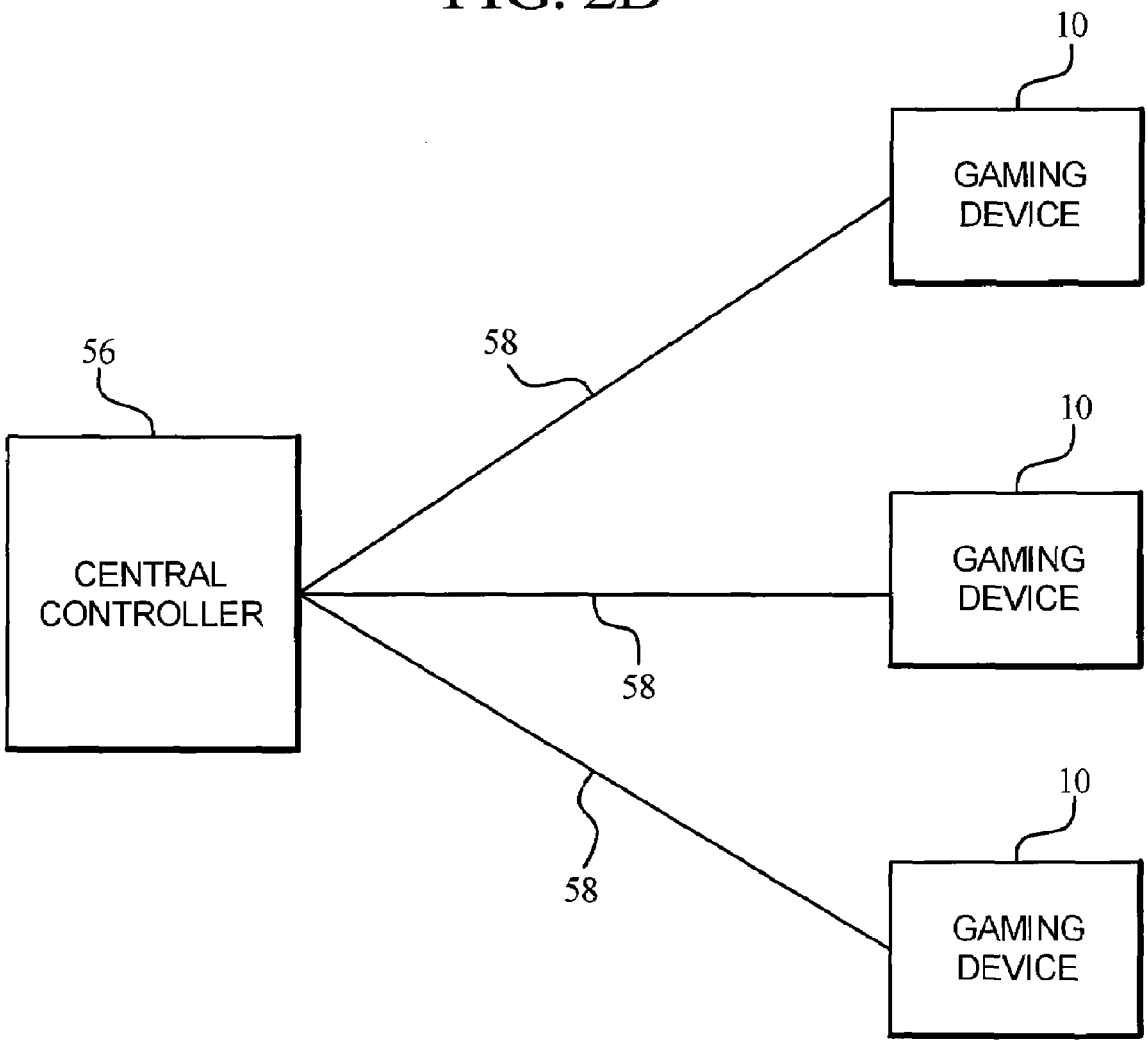
FIG. 2B is a schematic block diagram illustrating a plurality of gaming terminal in communication with a central controller.

In one embodiment, as illustrated in FIG. 2B, one or more of the gaming devices 10 are in communication with each other and/or at least one central server, central controller or remote host 56 through a data network or remote communication link 58. In this embodiment, the central server, central controller or remote host is any suitable server or computing device which includes at least one processor and at least one memory or storage device. In different such embodiments, the central server is a progressive controller or a processor of one of the gaming devices in the gaming system. In these embodiments, the processor of each gaming device is designed to transmit and receive events, messages, commands or any other suitable data or signal between the individual gaming device and the central server. The gaming device processor is operable to execute such communicated events, messages or commands in conjunction with the operation of the gaming device. Moreover, the processor of the central server is designed to transmit and receive events, messages, commands or any other suitable data or signal between the central server and each of the individual gaming devices. The central server processor is operable to execute such communicated events, messages or commands in conjunction with the operation of the central server. It should be appreciated that one, more or each of the functions of the central controller as disclosed herein may be performed by one or more gaming device processors. It should be further appreciated that one, more or each of the functions of one or more gaming device processors as disclosed herein may be performed by the central controller.

In one embodiment, the game outcome provided to the player is determined by a central server or controller and provided to the player at the gaming device. In this embodiment, each of a plurality of such gaming devices are in communication with the central server or controller. Upon a player initiating game play at one of the gaming devices, the initiated gaming device communicates a game outcome request to the central server or controller.

In one embodiment, the central server or controller receives the game outcome request and randomly generates a game outcome for the primary game based on probability data. In another embodiment, the central server or controller randomly generates a game outcome for the secondary game based on probability data. In another embodiment, the central server or controller randomly generates a game outcome for both the primary game and the secondary game based on probability data. In this embodiment, the central server or controller is capable of storing and utilizing program code or other data similar to the processor and memory device of the gaming device.

In an alternative embodiment, the central server or controller maintains one or more predetermined pools or sets of predetermined game outcomes. In this embodiment, the central server or controller receives the game outcome request and independently selects a predetermined game outcome from a set or pool of game outcomes. The central server or controller flags or marks the selected game outcome as used. Once a game outcome is flagged as used, it is prevented from further selection from the set or pool and cannot be selected by the central controller or server upon another wager. The provided game outcome can include a primary game outcome, a secondary game outcome, primary and secondary game outcomes, or a series of game outcomes such as free games.

The central server or controller communicates the generated or selected game outcome to the initiated gaming device. The gaming device receives the generated or selected game outcome and provides the game outcome to the player. In an alternative embodiment, how the generated or selected game outcome is to be presented or displayed to the player, such as a reel symbol combination of a slot machine or a hand of cards dealt in a card game, is also determined by the central server or controller and communicated to the initiated gaming device to be presented or displayed to the player. Central production or control can assist a gaming establishment or other entity in maintaining appropriate records, controlling gaming, reducing and preventing cheating or electronic or other errors, reducing or eliminating win-loss volatility and the like.

In another embodiment, a predetermined game outcome value is determined for each of a plurality of linked or networked gaming devices based on the results of a bingo or keno game. In this embodiment, each individual gaming device utilizes one or more bingo or keno games to determine the predetermined game outcome value provided to the player for the interactive game played at that gaming device. In one embodiment, the bingo or keno game is displayed to the player. In another embodiment, the bingo or keno game is not displayed to the player, but the results of the bingo or keno game determine the predetermined game outcome value for the primary or secondary game.

In the various bingo embodiments, as each gaming device is enrolled in the bingo game, such as upon an appropriate wager or engaging an input device, the enrolled gaming device is provided or associated with a different bingo card. Each bingo card consists of a matrix or array of elements, wherein each element is designated with a separate indicia, such as a number. It should be appreciated that each different bingo card includes a different combination of elements. For example, if four bingo cards are provided to four enrolled gaming devices, the same element may be present on all four of the bingo cards while another element may solely be present on one of the bingo cards.

In operation of these embodiments, upon providing or associating a different bingo card to each of a plurality of enrolled gaming devices, the central controller randomly selects or draws, one at a time, a plurality of the elements. As each element is selected, a determination is made for each gaming device as to whether the selected element is present on the bingo card provided to that enrolled gaming device. This determination can be made by the central controller, the gaming device, a combination of the two, or in any other suitable manner. If the selected element is present on the bingo card provided to that enrolled gaming device, that selected element on the provided bingo card is marked or flagged. This process of selecting elements and marking any selected elements on the provided bingo cards continues until one or more predetermined patterns are marked on one or more of the provided bingo cards. It should be appreciated that in one embodiment, the gaming device requires the player to engage a daub button (not shown) to initiate the process of the gaming device marking or flagging any selected elements.

After one or more predetermined patterns are marked on one or more of the provided bingo cards, a game outcome is determined for each of the enrolled gaming devices based, at least in part, on the selected elements on the provided bingo cards. As described above, the game outcome determined for each gaming device enrolled in the bingo game is utilized by that gaming device to determine the predetermined game outcome provided to the player. For example, a first gaming device to have selected elements marked in a predetermined pattern is provided a first outcome of win $10 which will be provided to a first player regardless of how the first player plays in a first game and a second gaming device to have selected elements marked in a different predetermined pattern is provided a second outcome of win $2 which will be provided to a second player regardless of how the second player plays a second game. It should be appreciated that as the process of marking selected elements continues until one or more predetermined patterns are marked, this embodiment ensures that at least one bingo card will win the bingo game and thus at least one enrolled gaming device will provide a predetermined winning game outcome to a player. It should be appreciated that other suitable methods for selecting or determining one or more predetermined game outcomes may be employed.

In one example of the above-described embodiment, the predetermined game outcome may be based on a supplemental award in addition to any award provided for winning the bingo game as described above. In this embodiment, if one or more elements are marked in supplemental patterns within a designated number of drawn elements, a supplemental or intermittent award or value associated with the marked supplemental pattern is provided to the player as part of the predetermined game outcome. For example, if the four corners of a bingo card are marked within the first twenty selected elements, a supplemental award of $10 is provided to the player as part of the predetermined game outcome. It should be appreciated that in this embodiment, the player of a gaming device may be provided a supplemental or intermittent award regardless of if the enrolled gaming device's provided bingo card wins or does not win the bingo game as described above.

In another embodiment, one or more of the gaming devices are in communication with a central server or controller for monitoring purposes only. That is, each individual gaming device randomly generates the game outcomes to be provided to the player and the central server or controller monitors the activities and events occurring on the plurality of gaming devices. In one embodiment, the gaming network includes a real-time or on-line accounting and gaming information system operably coupled to the central server or controller. The accounting and gaming information system of this embodiment includes a player database for storing player profiles, a player tracking module for tracking players and a credit system for providing automated casino transactions.

In one embodiment, the gaming device disclosed herein is associated with or otherwise integrated with one or more player tracking systems. In this embodiment, the gaming device and/or player tracking system tracks any players gaming activity at the gaming device. In one such embodiment, the gaming device and/or associated player tracking system timely tracks when a player inserts their playing tracking card to begin a gaming session and also timely tracks when a player removes their player tracking card when concluding play for that gaming session. In another embodiment, rather than requiring a player to insert a player tracking card, the gaming device utilizes one or more portable devices carried by a player, such as a cell phone, a radio frequency identification tag or any other suitable wireless device to track when a player begins and ends a gaming session. In another embodiment, the gaming device utilizes any suitable biometric technology or ticket technology to track when a player begins and ends a gaming session.

During one or more gaming sessions, the gaming device and/or player tracking system tracks any suitable information, such as any amounts wagered, average wager amounts and/or the time these wagers are placed. In different embodiments, for one or more players, the player tracking system includes the player's account number, the player's card number, the player's first name, the player's surname, the player's preferred name, the player's player tracking ranking, any promotion status associated with the player's player tracking card, the player's address, the player's birthday, the player's anniversary, the player's recent gaming sessions, or any other suitable data.

In one embodiment, a plurality of the gaming devices are capable of being connected together through a data network. In one embodiment, the data network is a local area network (LAN), in which one or more of the gaming devices are substantially proximate to each other and an on-site central server or controller as in, for example, a gaming establishment or a portion of a gaming establishment. In another embodiment, the data network is a wide area network (WAN) in which one or more of the gaming devices are in communication with at least one off-site central server or controller. In this embodiment, the plurality of gaming devices may be located in a different part of the gaming establishment or within a different gaming establishment than the off-site central server or controller. Thus, the WAN may include an off-site central server or controller and an off-site gaming device located within gaming establishments in the same geographic area, such as a city or state. The WAN gaming system may be substantially identical to the LAN gaming system described above, although the number of gaming devices in each system may vary relative to each other.

In another embodiment, the data network is an internet or intranet. In this embodiment, the operation of the gaming device can be viewed at the gaming device with at least one internet browser. In this embodiment, operation of the gaming device and accumulation of credits may be accomplished with only a connection to the central server or controller (the internevintranet server) through a conventional phone or other data transmission line, digital subscriber line (DSL), T-1 line, coaxial cable, fiber optic cable, or other suitable connection. In this embodiment, players may access an internet game page from any location where an internet connection and computer, or other internet facilitator is available. The expansion in the number of computers and number and speed of internet connections in recent years increases opportunities for players to play from an ever-increasing number of remote sites. It should be appreciated that enhanced bandwidth of digital wireless communications may render such technology suitable for some or all communications, particularly if such communications are encrypted. Higher data transmission speeds may be useful for enhancing the sophistication and response of the display and interaction with the player.

As mentioned above, in one embodiment, the present disclosure may be employed in a server based gaming system. In one such embodiment, as described above, one or more gaming devices are in communication with a central server or controller. The central server or controller may be any suitable server or computing device which includes at least one processor and a memory or storage device. In alternative embodiments, the central server is a progressive controller or another gaming machine in the gaming system. In one embodiment, the memory device of the central server stores different game programs and instructions, executable by a gaming device processor, to control the gaming device. Each executable game program represents a different game or type of game which may be played on one or more of the gaming devices in the gaming system. Such different games may include the same or substantially the same game play with different pay tables. In different embodiments, the executable game program is for a primary game, a secondary game or both. In another embodiment, the game program may be executable as a secondary game to be played simultaneous with the play of a primary game (which may be downloaded to or fixed on the gaming device) or vice versa.

In this embodiment, each gaming device at least includes one or more display devices and/or one or more input devices for interaction with a player. A local processor, such as the above-described gaming device processor or a processor of a local server, is operable with the display device(s) and/or the input device(s) of one or more of the gaming devices.

In operation, the central controller is operable to communicate one or more of the stored game programs to at least one local processor. In different embodiments, the stored game programs are communicated or delivered by embedding the communicated game program in a device or a component (e.g., a microchip to be inserted in a gaming device), writing the game program on a disc or other media, downloading or streaming the game program over a dedicated data network, internet or a telephone line. After the stored game programs are communicated from the central server, the local processor executes the communicated program to facilitate play of the communicated program by a player through the display device(s) and/or input device(s) of the gaming device. That is, when a game program is communicated to a local processor, the local processor changes the game or type of game played at the gaming device.

In another embodiment, a plurality of gaming devices at one or more gaming sites may be networked to the central server in a progressive configuration, as known in the art, wherein a portion of each wager to initiate a base or primary game may be allocated to one or more progressive awards. In one embodiment, a progressive gaming system host site computer is coupled to a plurality of the central servers at a variety of mutually remote gaming sites for providing a multi-site linked progressive automated gaming system. In one embodiment, a progressive gaming system host site computer may serve gaming devices distributed throughout a number of properties at different geographical locations including, for example, different locations within a city or different cities within a state.

In one embodiment, the progressive gaming system host site computer is maintained for the overall operation and control of the progressive gaming system. In this embodiment, a progressive gaming system host site computer oversees the entire progressive gaming system and is the master for computing all progressive jackpots. All participating gaming sites report to, and receive information from, the progressive gaming system host site computer. Each central server computer is responsible for all data communication between the gaming device hardware and software and the progressive gaming system host site computer. In one embodiment, an individual gaming machine may trigger a progressive award win. In another embodiment, a central server (or the progressive gaming system host site computer) determines when a progressive award win is triggered. In another embodiment, an individual gaming machine and a central controller (or progressive gaming system host site computer) work in conjunction with each other to determine when a progressive win is triggered, for example through an individual gaming machine meeting a predetermined requirement established by the central controller.

In one embodiment, a progressive award win is triggered based on one or more game play events, such as a symbol-driven trigger. In other embodiments, the progressive award triggering event or qualifying condition may be by exceeding a certain amount of game play (such as number of games, number of credits, or amount of time), or reaching a specified number of points earned during game play. In another embodiment, a gaming device is randomly or apparently randomly selected to provide a player of that gaming device one or more progressive awards. In one such embodiment, the gaming device does not provide any apparent reasons to the player for winning a progressive award, wherein winning the progressive award is not triggered by an event in or based specifically on any of the plays of any primary game. That is, a player is provided a progressive award without any explanation or alternatively with simple explanations. In another embodiment, a player is provided a progressive award at least partially based on a game triggered or symbol triggered event, such as at least partially based on the play of a primary game.

In one embodiment, one or more of the progressive awards are each funded via a side bet or side wager. In this embodiment, a player must place or wager a side bet to be eligible to win the progressive award associated with the side bet. In one embodiment, the player must place the maximum bet and the side bet to be eligible to win one of the progressive awards. In another embodiment, if the player places or wagers the required side bet, the player may wager at any credit amount during the primary game (i.e., the player need not place the maximum bet and the side bet to be eligible to win one of the progressive awards). In one such embodiment, the greater the player's wager (in addition to the placed side bet), the greater the odds or probability that the player will win one of the progressive awards. It should be appreciated that one or more of the progressive awards may each be funded, at least in part, based on the wagers placed on the primary games of the gaming machines in the gaming system, via a gaming establishment or via any suitable manner.

In another embodiment, one or more of the progressive awards are partially funded via a side-bet or side-wager which the player may make (and which may be tracked via a side-bet meter). In one embodiment, one or more of the progressive awards are funded with only side-bets or side-wagers placed. In another embodiment, one or more of the progressive awards are funded based on player's wagers as described above as well as any side-bets or side-wagers placed.

In one alternative embodiment, a minimum wager level is required for a gaming device to qualify to be selected to obtain one of the progressive awards. In one embodiment, this minimum wager level is the maximum wager level for the primary game in the gaming machine. In another embodiment, no minimum wager level is required for a gaming machine to qualify to be selected to obtain one of the progressive awards.

In another embodiment, a plurality of players at a plurality of linked gaming devices in a gaming system participate in a group gaming environment. In one embodiment, a plurality of players at a plurality of linked gaming devices work in conjunction with one another, such as playing together as a team or group, to win one or more awards. In one such embodiment, any award won by the group is shared, either equally or based on any suitable criteria, amongst the different players of the group. In another embodiment, a plurality of players at a plurality of linked gaming devices compete against one another for one or more awards. In one such embodiment, a plurality of players at a plurality of linked gaming devices participate in a gaming tournament for one or more awards. In another embodiment, a plurality of players at a plurality of linked gaming devices play for one or more awards wherein an outcome generated by one gaming device affects the outcomes generated by one or more linked gaming devices.

Exemplary Embodiments

In various embodiments described in the present disclosure, at least one of the base or primary game or the bonus or secondary game includes a game having associated symbol display areas such as symbol display areas associated by paylines in a suitable slot game. In disclosed embodiments, new combinations of originally generated symbols are indicated for evaluation upon a transition of the indicators. Paylines, for example, may be transitioned in relation to symbol display areas on the gaming device to cause a change in association of paylines with symbol display areas. In some embodiments, the symbols displayed in the symbol display areas remain fixed while a change in association of paylines with symbol display areas occurs.

The change in association of paylines with symbol display areas may occur during various portions of a game, such as in a primary game or a bonus game, in association with certain events in a game, such as free spins in a game or in association with or during any other suitable event or portion of a game or series of games.

Symbols and paylines may be displayed on the same or different surfaces as the symbols. Symbols and paylines may be displayed on a mechanical display, video display, or combinations thereof. For instance, a display device may include a mechanical set of reels to display symbols and a substantially transparent video display screen to display paylines. The video display screen may be arranged in front of the reels to display an association of the paylines displayed on the video display with the symbols displayed on the mechanical reels. Alternatively, the display device may include a video display screen that displays both symbols and paylines Referring now to FIGS. 3A, 3B, 3C and 3D, an exemplary embodiment including paylines associated with a plurality of symbol display areas is illustrated. In particular, FIGS. 3A, 3B, 3C and 3D illustrate a gaming device including a display device 100 having a plurality of display areas 120 adapted to display a plurality of symbols, such as symbols displayed on one or more reels. The symbol display areas 120 may be arranged on the display 100 in any suitable manner. For example, the symbol display areas may be arranged as an orthogonal matrix of any suitable number of rows and columns of symbol display areas, such as a three-by-three matrix, a three-by-five matrix, a five-by-five matrix, etc. Other suitable arrangements of the symbol display areas may include an arrangement of the symbol display areas in rows having different numbers of columns or in columns having different numbers of rows. Symbol display areas may be arranged in a non-linear arrangement such as curved or circular arrangements.

Figure 3A:
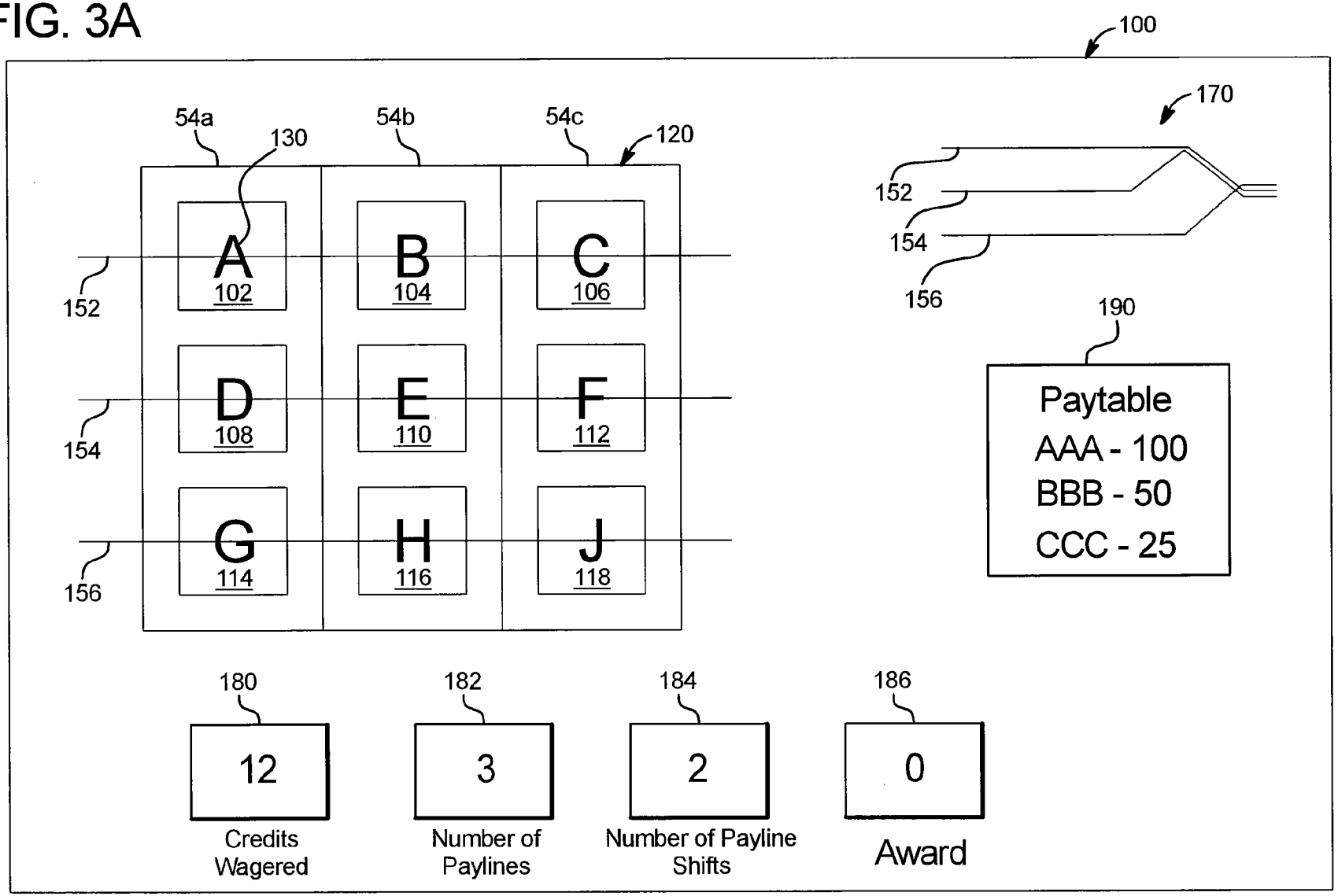
FIGS. 3A, 3B, 3C, 3D are front views of a display device of at least one embodiment disclosed herein, illustrating a gaming device enabling a player to wager on a plurality of paylines and transitions of paylines in relation to symbol display areas.

As illustrated in FIG. 3A, symbol display areas may be arranged in a three-by-three matrix and may be displayed in association with a conventional set of reels adapted to display symbols generated by the gaming device. The symbol display areas illustrated in FIG. 3A include symbol display areas 102, 104 and 106 in a first row, symbol display areas 108, 110 and 112 in a second row, and symbol display areas 114, 116 and 118 in a third row. The symbol display areas may be included on a set of reels such as a conventional set of reels. As illustrated in FIG. 3A, symbol display areas 102, 108 and 114 may be included in association with reel 54*a*. Symbol display areas 104, 110 and 116 may be included in association with reel 54*b*. Symbol display areas 106, 112 and 118 may be included in association with reel 54*c*.

In FIG. 3A, each symbol display area displays a symbol such as symbol 130. For example, symbol display area 102 displays the A symbol, symbol display area 104 displays the B symbol, symbol display area 106 displays the C symbol, etc. It should be appreciated that the gaming device may generate any letter, numeral, character, marking, indicia or any other suitable symbol or combinations thereof to be displayed in the symbol display areas.

Symbol display areas may be associated or linked with other symbol display areas to form at least one subset of symbol display areas and to define a subset of symbols generated to be displayed in those symbol display areas. A subset of symbol display areas may include, for example, one symbol display area from each of a plurality of columns of symbol display areas, such as symbol display areas associated with each of a plurality of reels. In various embodiments, paylines are used to indicate an association or linkage symbol display areas. The gaming device of the present disclosure may, therefore, include a plurality of paylines displayed on the display device. Complete paylines, or portions thereof, may or may not be displayed in association with the symbol display areas, separate from the symbol display areas, or both. At least one payline may be associated with at least two symbol display areas. More than one payline may be associated with the same symbol display area, and not all symbol display areas may be associated with a payline.

As illustrated in FIG. 3A, three paylines 152, 154 and 156 are displayed by the display device. Each payline is initially associated with three symbol display areas indicating the symbols displayed in each of the associated symbol display areas. Payline 152 is associated with symbol display areas 102, 104 and 106; payline 154 is associated with symbol display areas 108, 110 and 112; and payline 156 is associated with symbol display areas 114, 116 and 118.

The display device may be adapted to include an additional payline display 170 separate from the symbol display areas 120, but within the viewing area of the display 100. As illustrated in FIGS. 3A, 3B, 3C and 3D, payline display 170 includes the display of portions of paylines 152, 154 and 156 displayed in association with the symbol display areas and portions of paylines 152, 154 and 156 not displayed in association with the symbol display areas. It should be appreciated that the additional payline display may include a display of the complete length of the payline(s) or portions thereof.

A payline may be activated or designated for at least one of evaluation, transition and re-evaluation, and subsequent payline transitions and evaluations. Any displayed payline or any payline activated by a wager by a player, player selection, random selection by the gaming device, predetermined selection or any other suitable activation of a payline may cause that payline to be evaluated and/or undergo transition.

The embodiments described in the present disclosure may include various features or parameters under the control of such sources as a wager, a player, a gaming device, a server, and an outcome or event of a game. For example, the gaming devices described herein may enable a player to wager on and, thereby, control different features or parameters of the disclosed gaming devices. Upon placement of a wager, a gaming device may enable a player to select one or more paylines to be evaluated for a winning symbol or combination of symbols, determine a number of paylines to be evaluated, select one or more paylines to be transitioned and re-evaluated, determine a number of transitions and evaluations of at least one selected payline, determine the extent of one or more transitions of one or more paylines, determine an amount of the wager to be applied to each payline, determine an amount of the wager to be applied to each transition evaluation of the payline, or control any other suitable feature and combinations thereof.

It should be appreciated that one or more of the features or parameters described above may be controlled by the player. In addition or alternatively, the gaming device may include a display device including a functional display. The functional display may include a display separate from the symbol display areas such as an additional reel. The functional display may be included as a portion of the display device adapted to display symbols in symbol display areas of the display. Alternatively, the functional display may be included in a separate display device of the gaming device. The functional display may include at least one of a mechanical, a video portion or any other suitable visual, audio or sensory display.

The functional display may be adapted to display a random or predetermined determination by the gaming device of a feature or parameter of the game. For example, the functional display may be adapted to display a selection of one or more paylines to be evaluated for a winning symbol or combination of symbols, a determination of a number of paylines to be evaluated, whether a transition occurs, a selection of one or more paylines or symbol display areas to be transitioned and re-evaluated, a determination of a number of transitions and evaluations of at least one selected payline or symbol display area, a determination of a direction of a transition, a determination of an amount of a wager to be applied to each payline of at least one selected payline or symbol display area, a determination of an amount of the wager to be applied to each transition evaluation of the payline, or a display of any other suitable feature and combinations thereof.

In various embodiments, a player is enabled to place a wager on the number of paylines to be evaluated for a winning symbol or combination of symbols displayed in symbol display areas associated with the wagered-on payline. In various embodiments, the number of times a wagered-on payline is transitioned to a different position in relation to the symbol display areas and subsequently evaluated for a winning symbol or combination of symbols may be based on the wager by the player. For example, in the illustrated embodiment, a player is enabled to wager on one, a plurality, or all of the paylines 152, 154 and 156. As illustrated in FIG. 3A, the player wagers on all three paylines as indicated by the "Number of Paylines" display 182. The player is also enabled to wager on the number of transitions and evaluations of the wagered-on payline. In FIG. 3A, the "Number of Payline Shifts" display 184 indicates that the player wagers on two transitions and evaluations for each wagered-on payline.

In various embodiments of the present disclosure, a different amount of a wager may be assigned to a payline or be required to activate a payline for at least one evaluation, transition and re-evaluation, and subsequent payline transitions and evaluations. Examples of variations in wager schemes are illustrated in FIGS. 4A, 4B and 4C as wager tables 140, 142 and 144. As illustrated in FIG. 4A, in an embodiment, a graduated or increasing wager amount is required for at least one subsequent shift and evaluation of a payline. For example, in wager table 140, one credit is required to wager on an initial evaluation of symbols displayed along a payline, one credit is required to wager on a subsequent evaluation of symbols displayed along a payline following a change in association of the payline with a different symbol display area, and two credits is required to wager on two or more transitions and evaluations of a wagered-on payline. In alternative embodiments, the wager required for subsequent transitions of the payline may be discounted, or the player may be provided free transitions for a predetermined number of wagered-on paylines as provided in wager tables 142 and 144 illustrated in FIGS. 4B and 4C, respectively. It should be appreciated that a player may be provided a free shift or transition of one or more paylines based on any suitable event or outcome in the game. It should be further appreciated that any suitable wagering scheme, such as wager schemes associated with the features controlled by a player upon a wager as described above, may be employed to provide incentives to the player or to increase player excitement.

In the embodiment illustrated in FIGS. 3A, 3B, 3C and 3D, and according to the wager table 140 illustrated in FIG. 4A, at least one credit is required to be wagered for a payline to be activated. In addition, at least one credit is required to be wagered to cause a first transition of an activated payline. At least two credits is required to be wagered to cause a second transition of an activated payline. In FIG. 3A, for example, the player wagers twelve credits as indicated by the "Credits Wagered" display 180—one credit for each of three paylines, or three credits; one credit for a first transition of each activated payline, or three credits; and two credits for a subsequent transition of each activated payline, or six credits, for a total of twelve credits.

Figure 3B:
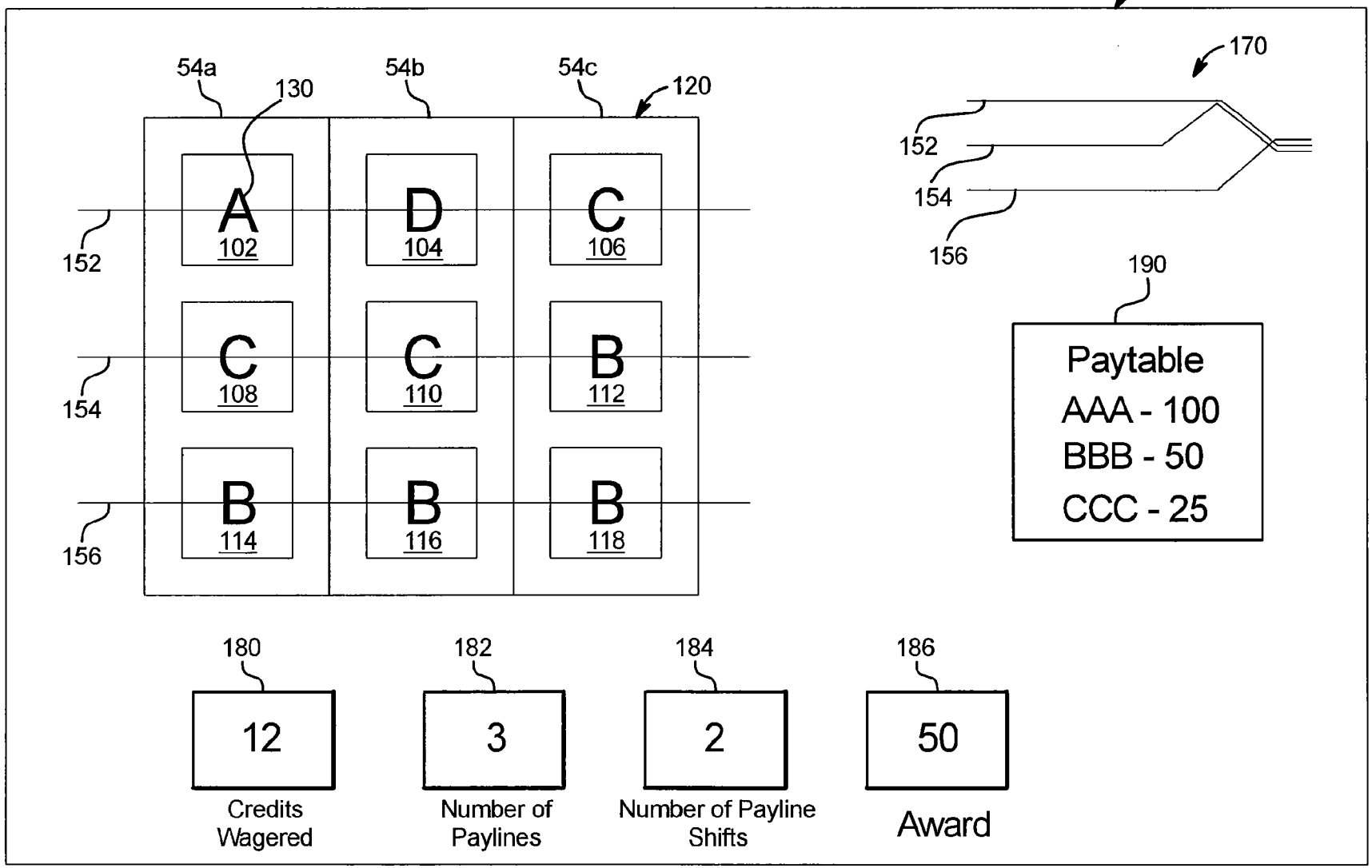

The gaming device may generate symbols to be displayed in the symbol display areas. As illustrated in FIG. 3B, a symbol is generated to be displayed in each symbol display area. For example, symbols A, D and C are displayed in symbol display areas 102, 104 and 106, respectively, along payline 152. Likewise, symbols C, C and B are displayed in symbol display areas 108, 110 and 112, respectively, along payline 154; and symbols B, B and B are displayed in symbol display areas 114, 116 and 118, respectively, along payline 156.

The generation of symbols by the gaming device to be displayed in symbol display areas associated with a particular payline forms a set of symbols or combination of symbols. In various embodiments, the gaming device performs an evaluation of individual symbols or symbol combinations generated and displayed in the symbol display areas associated with one or more paylines to determine if a winning symbol or combination of symbols is indicated by each of the wagered-on paylines. This evaluation by the gaming device may occur upon any suitable event or outcome in a game. For example, an evaluation by the gaming device may be performed prior to or after a transition of one or more paylines. In an exemplary embodiment, an evaluation is performed prior to a transition of the paylines.

In an embodiment, three of the same symbols displayed along the same payline may be considered a winning combination, such as the three B symbols displayed along payline 156 illustrated in FIG. 3B. An outcome may include providing an award to a player for a winning symbol or combination of symbols displayed in symbol display areas associated with a payline. As illustrated in FIG. 3B, an award of 50 credits is associated with three B symbols according to the paytable 190. The number of credits, fifty credits, provided to the player is indicated in an award display 186 as further illustrated in FIG. 3B.

In the embodiments of the present disclosure, the display device may display a change in the display of the paylines in relation to the symbol display areas. The change may include a transition of at least one payline in relation to symbols that remain fixedly displayed in the symbol display areas on the display. In a transition of a payline from a first position to a second position, the payline may be associated with the same or different symbol display areas in each of the first and second positions. In other words, the same combination of symbol display areas may be associated with a payline in a first position and second position of the payline. Alternatively, a different combination of symbol display areas may be associated with a payline in a first position and second position of the payline. Therefore, in various embodiments, a transition may include the display of at least one of the paylines in a second position such that the payline is associated with at least one symbol display area that is different from the symbol display areas associated with the payline in a first position. A transition of one or more of the paylines may continue until a payline is associated with a different set of symbol display areas. A different set of symbol display areas may include at least one symbol display area that was not associated with the payline in an immediately previous or any previous position of the payline. Various examples of displaying a change of symbol display areas indicated by a payline are set forth in the following description.

Transition of any of the paylines or symbol display areas in relation to the other may be random, predetermined, or initiated by any suitable input by a player, such as a wager, or any event or outcome in a game. For example, an outcome in a game may include a "free spin bonus" or "free payline shift" feature enabling the player to select one or more payline transitions in the same, different or related game, such as a bonus game, without an additional wager.

As described above, transition may be initiated by the gaming device itself or by a server via a network. The transition feature may be delivered sequentially or simultaneously to more than one gaming device. The initiation of one or more transitions may be based on existing wagers by a player and may be provided to a player as an incentive to maximize a wager or as an award for maximizing wagers in a game.

Figure 3C:
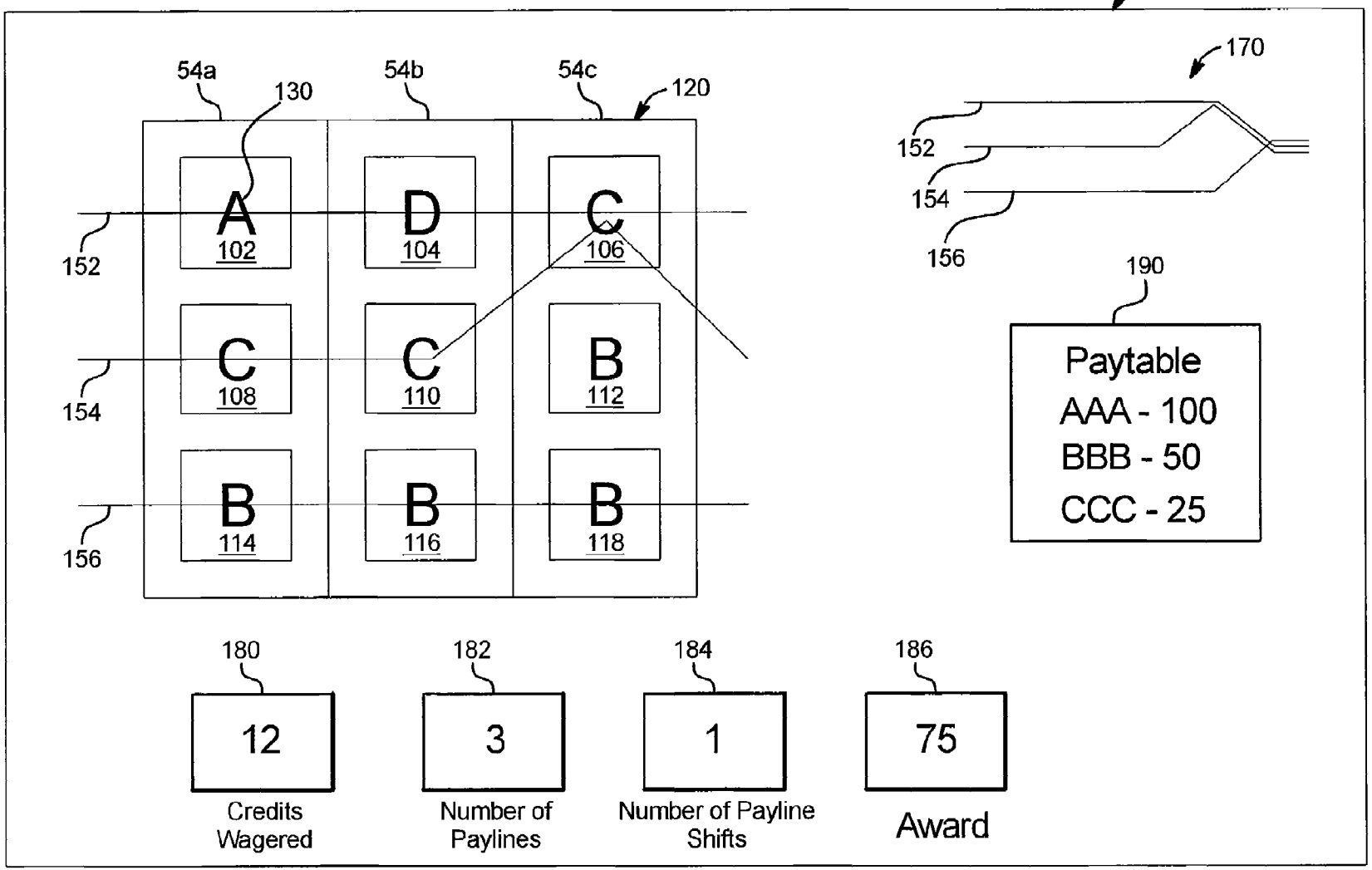

As described above and as illustrated in FIGS. 3A and 3B, each of the activated paylines, 152, 154 and 156, is displayed in a first position. A transition of the paylines 152, 154 and 156 from the first position to a second position is displayed in FIG. 3C such that at least one of the activated paylines in the second position is associated with at least one different symbol display area. As illustrated in FIG. 3C, paylines 152 and 156 each remain associated with the same symbol display areas although a transition of the payline from a first to a second position occurred. Payline 154, on the other hand, is associated with different symbol display areas. In particular, payline 154 is displayed in a first position associated with symbol display areas 108, 110 and 112, as illustrated in FIGS. 3A and 3B. In FIG. 3C, however, payline 154 is associated with symbol display areas 108, 110 and 106. Accordingly, payline 154 is associated with a different symbol display area, symbol display area 106 instead of symbol display area 112. As illustrated in FIGS. 3A, 3B and 3C, the symbols indicated by payline 154 changes from symbols C, C and B in a first position of payline 154, to symbols C, C and C in a second position of payline 154. It should be appreciated, however, that the different display area may or may not display the same symbol, and the payline may or may not indicate a different combination of symbols for a transition to occur. The Number of Payline Shifts display 184 is decremented by one to indicate that a transition of the three wagered-on paylines has occurred and that one more shift of the paylines is available.

An evaluation of any symbol or combination of symbols indicated by an activated payline may occur after one or more transitions of paylines in relation to symbol display areas. For example, upon transition of a payline from a first position to a second position, the gaming device may perform an evaluation to determine if a winning symbol or combination of symbols is displayed in symbol display areas associated with the payline. In certain embodiments, an evaluation may be performed after each transition from a first position to a second position whether or not a payline is associated with a different set of symbol display areas. In other words, a first evaluation may occur of symbols displayed by symbol display areas associated with a payline in a first position. The payline may undergo a transition to a second position wherein the same set of symbol display areas are associated with the payline. A second or subsequent evaluation may then occur of the same symbols displayed by the same set of symbol display areas associated with the payline in the second position.

In an embodiment, each of the activated paylines transitioned to a second position may undergo an evaluation for a winning symbol or combination of symbols displayed in the symbol display areas associated with the paylines. Alternatively, only a payline associated with at least one different symbol display area may be evaluated for a winning symbol or combination of symbols. For example, in the embodiment illustrated in FIG. 3C, the gaming device evaluates payline 154 associated with a different symbol display area (symbol display area 106). Three C symbols are displayed in the symbol display areas 108, 110 and 106 along the same payline, payline 154.

An outcome may include providing an award to a player, such as a number of credits, a modifier, additional shifts of a payline or any other suitable award for a winning symbol or combination of symbols displayed in symbol display areas associated with a payline, including one or more transitioned or shifted paylines. The three C symbols displayed along payline 154, for example, are considered to be a winning combination, and an award of twenty-five credits is associated with the three C symbols according to the paytable 190. The twenty-five credits are added to the award amount of fifty credits to increase the award to seventy-five credits as indicated by the award display 186.

An outcome may include providing an award to a player for a winning symbol or combination of symbols displayed in symbol display areas associated with a payline, even if no change in symbol display areas associated with the payline occurs upon the transition of the payline to a different position. As illustrated in FIG. 3C, payline 156 is displayed in a second position, but remains associated with symbol display areas 114, 116 and 118, as in the first position illustrated in FIG. 3B. In such an embodiment, the player is provided an additional fifty credits, even though the player received fifty credits for the winning combination of three B symbols displayed along payline 156 when it was in the first position.

Outcomes of evaluations may increase, decrease or remain the same for any number of transitions of one or more paylines. In various embodiments, an actual or potential outcome may vary over a number of transitions of the paylines. The value of an outcome, for example, may increase or decrease from one transition to another transition. The value of an outcome may increase or decrease by different amounts from one transition to another transition. The change in outcome may be consistent or random from one transition to another transition.

In an embodiment, a multiplier may be associated with each transition of one or more paylines. In a first transition of the payline, the value of the multiplier may increase from 1× to 2× such that any award obtained from a winning symbol or combination of symbols indicated by the transitional payline is doubled in value. In a second transition of the payline, the multiplier may increase from 2× to 4× such that any award obtained from a winning symbol or combination of symbols indicated by the subsequently transitioned payline is multiplied by four to determine the value of the award. It should be appreciated that the change in the outcome through any number of transitions may be the same or different for each transition. For example, the value of the multiplier may increase or decrease by a fixed amount or according to a mathematical function such as exponentially. Furthermore, the value of the multiplier may increase or decrease by a random amount, or remain the same through any suitable number of payline transitions. The multiplier may increase, decrease or remain the same for each transition of the payline, increase, decrease or remain the same for a predetermined number of payline transitions, or increase, decrease or remain the same for a random number of payline transitions.

Figure 3D:
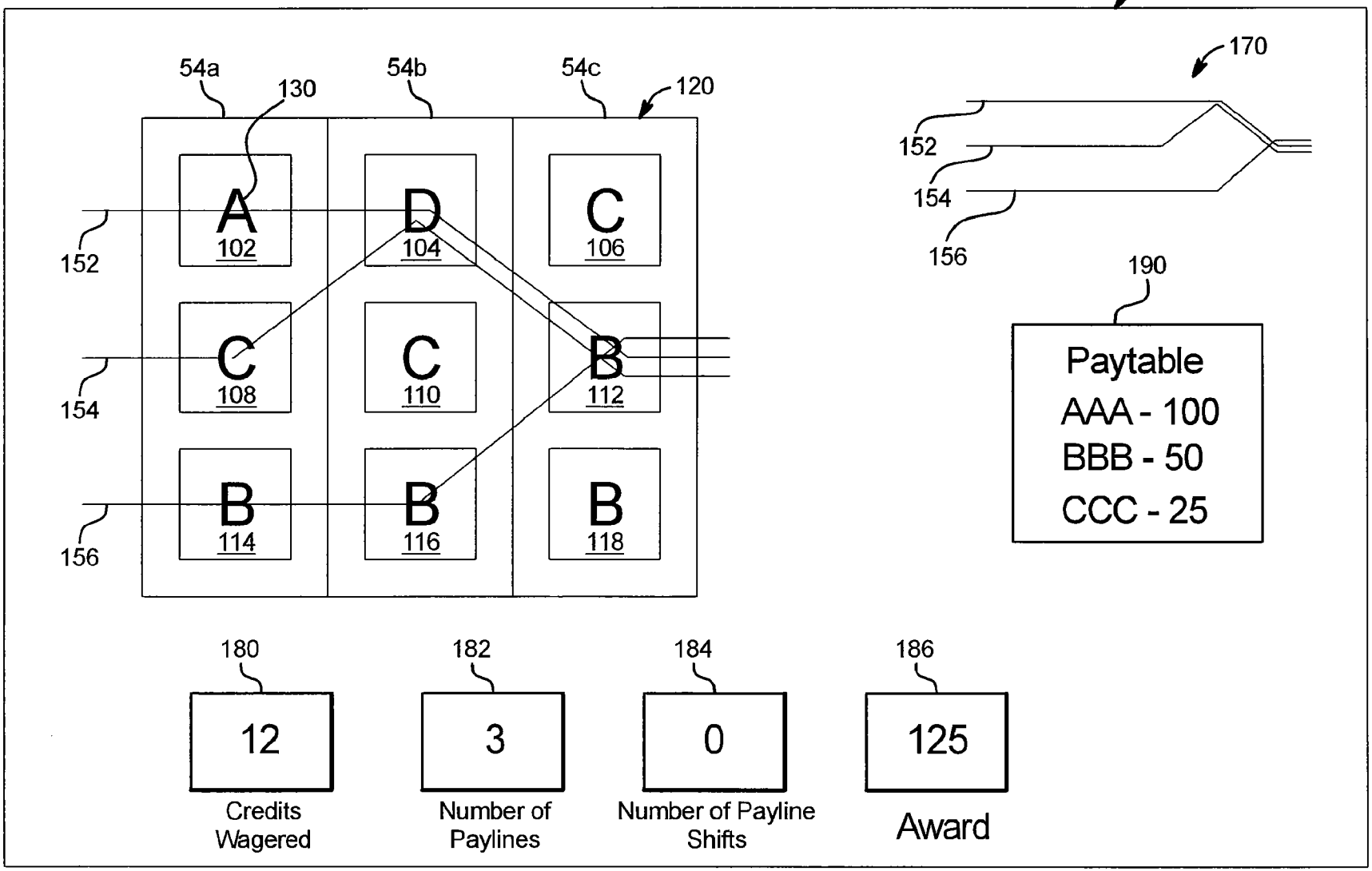

Upon evaluation of one or more of the transitioned paylines, a subsequent transition and evaluation of one or more paylines may occur. As illustrated in FIG. 3D, each of the three paylines wagered upon undergo a transition from the second position to a third position to display a change of symbol display areas associated with at least one payline. In the third position of the paylines, payline 152 is associated with symbol display areas 102, 104 and 112; payline 154 is associated with symbol display areas 108, 104 and 112; and payline 156 is associated with symbol display areas 114, 116 and 112. The Number of Payline Shifts display 184 is decremented by one to indicate that each of the activated paylines has undergone a shift or transition and that no more payline transitions have been wagered on. It should be appreciated that the gaming device may be adapted to offer the player an opportunity to make an additional wager on a subsequent transition during any portion of the game.

The gaming device of the present disclosure may perform an evaluation of symbols displayed in each symbol display area associated with a payline in a second or subsequent position if at least one of the symbol display areas associated with the payline in the first position is different, even if the symbols displayed in the "new" combination of symbol display areas are the same. Hence, an award may be provided to the player for a winning combination of symbols indicated by the payline in the second or subsequent position even if an award was provided to the player for the same winning combination of symbols indicated by the payline in the first position. For example, in the previous position of payline 156, illustrated in FIG. 3C, payline 156 was associated with symbol display areas displaying the B symbol in each symbol display area. Likewise in the subsequent position of payline 156, illustrated in FIG. 3D, payline 156 is again associated with symbol display areas displaying the B symbol in each of the symbol display areas. Therefore, there is no change in the symbols indicated by payline 156 in a previous and subsequent position. However, in an embodiment, because the payline is associated with a different display area (symbol display area 112), the gaming device may be enabled to perform an evaluation of the symbol display areas associated with payline 156. According to the paytable 190, three B symbols corresponds to an award of fifty credits which is added to the cumulative award amount of seventy-five credits for a total of one-hundred twenty-five credits as indicated by the credits display 186. When no further shifts have been wagered on and all evaluations of the paylines have been performed, at least this portion of the game may end. It should be appreciated, however, that additional plays of the game including another generation of symbols to be displayed in the symbol display areas may be provided to a player.

In various embodiments, the gaming device may display paylines having portions or sections of the paylines that are not associated with the symbol display areas. In addition, or alternatively, one or more paylines or sets of paylines may be displayed that are not associated with the symbol display areas. The portions of the paylines and separate sets of paylines may be displayed in any suitable spatial relation to the symbol display areas. The paylines may be displayed above, below, beside, or at any suitable angle, or combinations thereof, to the symbol display areas in two-dimensional or three-dimensional space.

Figure 5A:
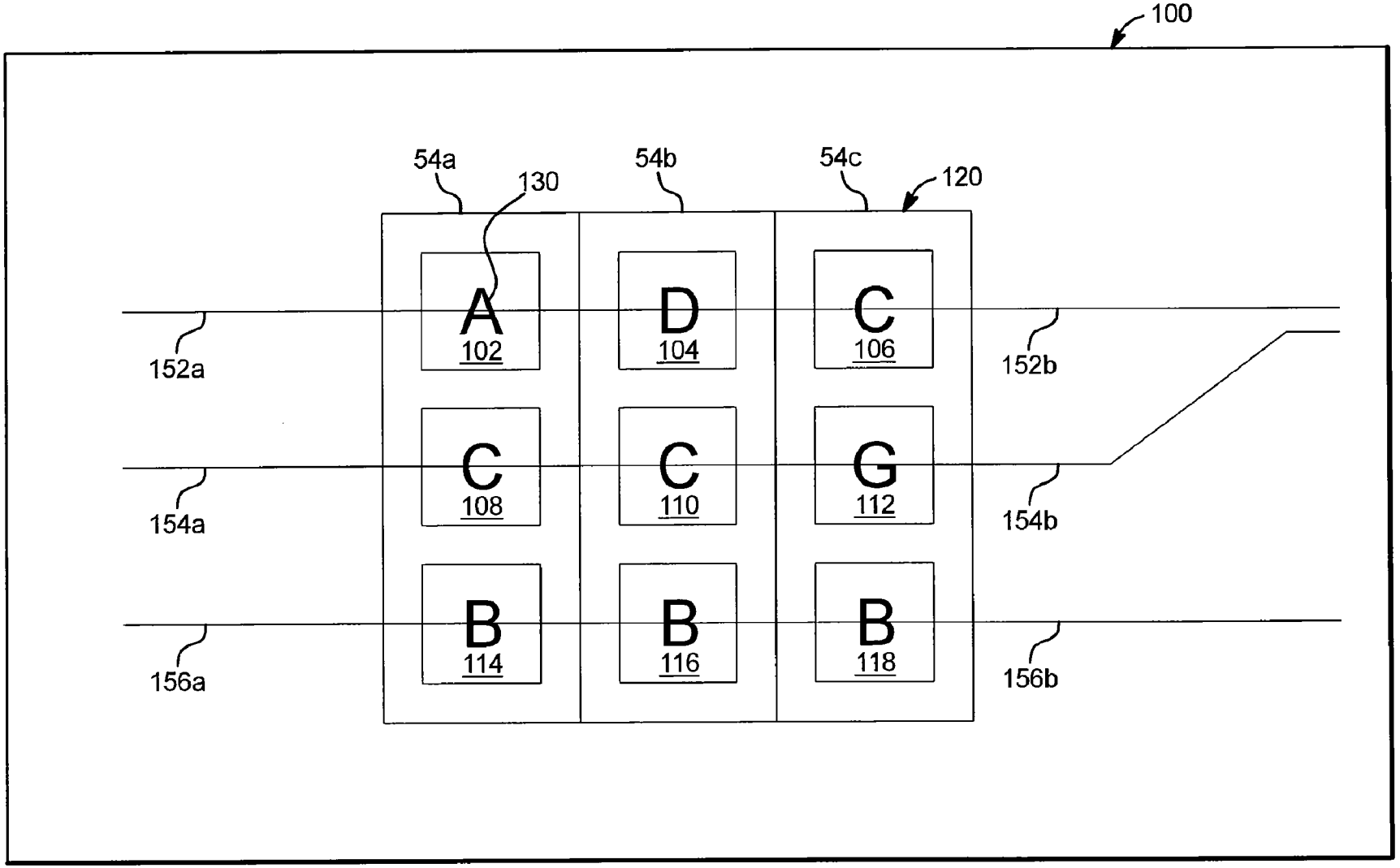
FIGS. 5A and 5B are front views of a display device of at least one embodiment disclosed herein illustrating an alternative display of a transition of one or more paylines in relation to symbol display areas.

As illustrated in FIG. 5A, in an embodiment, portions of paylines 152, 154 and 156 are not associated with the symbol display areas. In a first position, sections 152*a*, 154*a* and 156*a* of paylines 152, 154 and 156, respectively, are associated with symbol display areas. Section 152*b* of payline 152, section 154*b* of payline 154, and section 156*b* of payline 156 extend beyond the symbol display areas. Payline section 152*b*, 154*b* and 156*b*, in contrast to payline sections 152*a*, 154*a* and 156*a*, are not associated with the symbol display areas.

A transition of displayed paylines may include a transition in any direction from a first position to a second position. A transition of a payline from a first position to a second position may include a transition of a payline or portion of a payline from a position where the payline or payline portion is associated with at least one symbol display area, to a position where the payline or payline portion is not associated with a symbol display area. The paylines may transition from one position to another individually or as a group. In an embodiment, the paylines may transition as a group through the viewing area, or portion thereof, any suitable number of times before stopping at a second position.

Figure 5B:
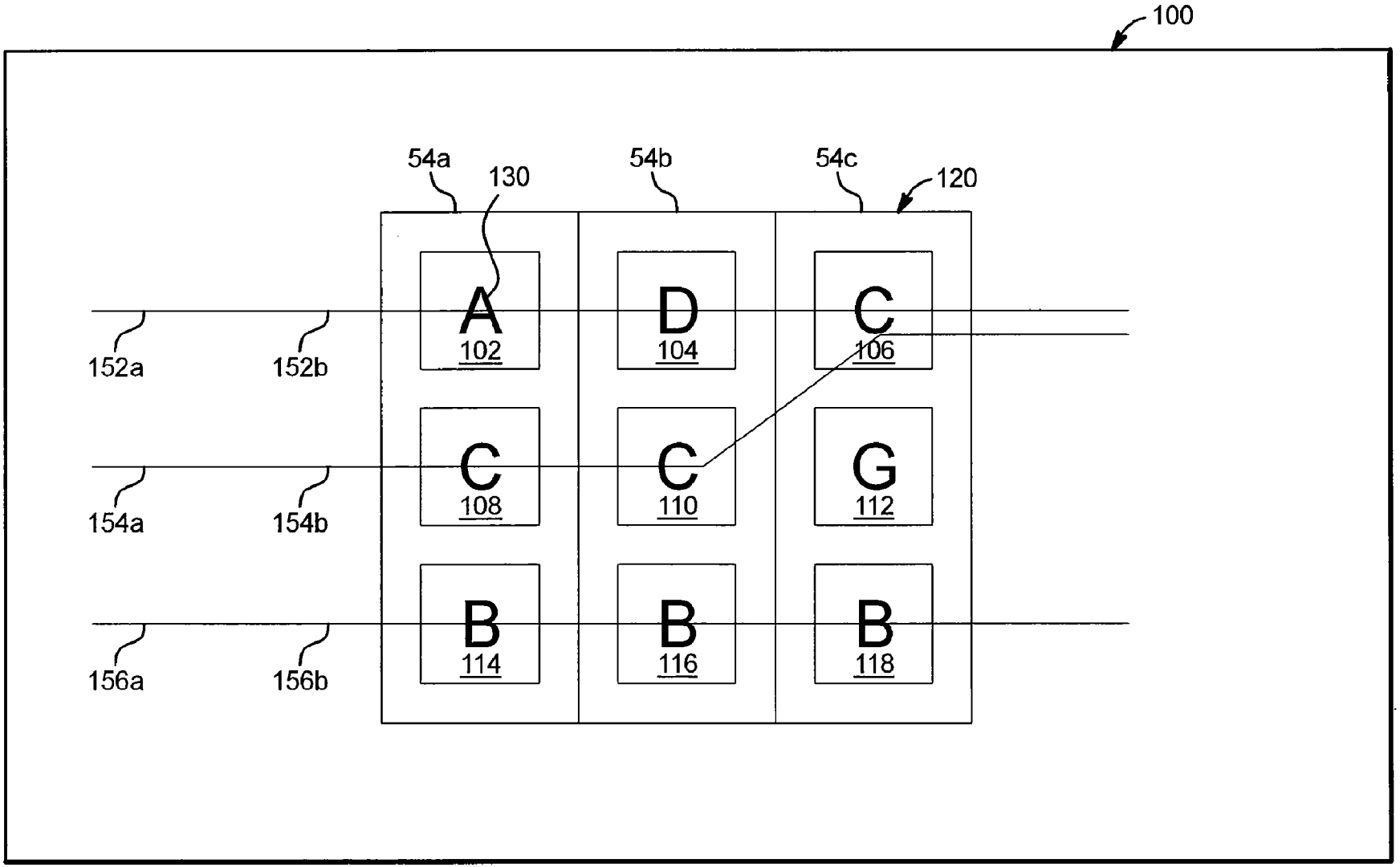

FIG. 5A illustrates a first position of the sections of the paylines as described above. In FIG. 5A, payline 154*a* is displayed in association with symbol display areas 108, 110 and 112. FIG. 5B illustrates the payline sections in a second position such that payline sections 152*b*, 154*b* and 156*b* are associated with the symbol display areas. Payline sections 152*a*, 154*a* and 156*a* are no longer associated with the symbol display areas. In the second position, payline section 154*b* is displayed in association with symbol display area 106 instead of symbol display area 112 as with payline section 154*a*. Accordingly, payline section 154*b* is associated with symbol display areas 108, 110 and 106, a different set of symbol display areas than the symbol display areas associated with payline section 154*a* displayed in the first position.

Figure 6A:
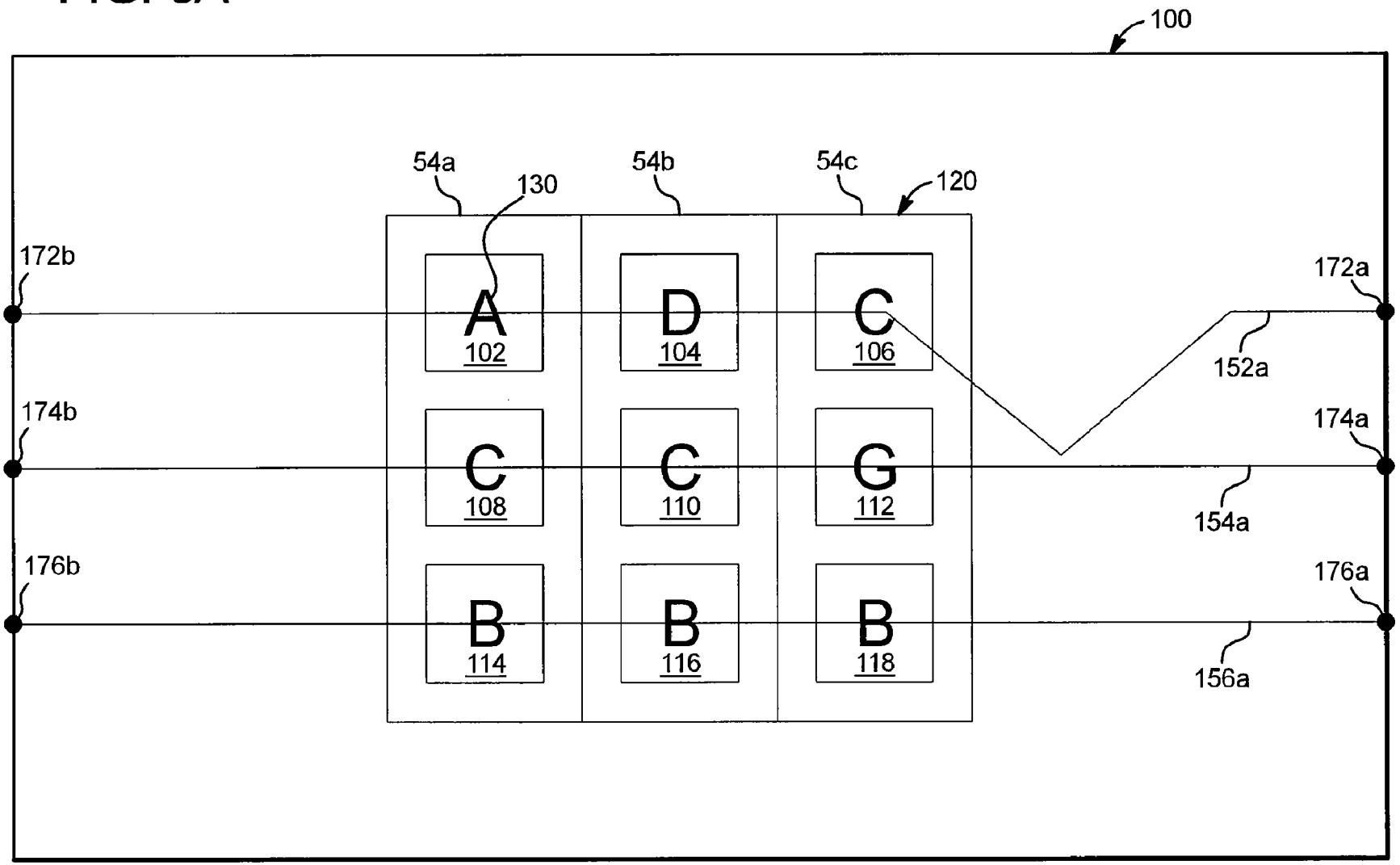
FIGS. 6A and 6B are front views of a display device of at least one embodiment disclosed herein illustrating an alternative display of a transition of one or more paylines in relation to symbol display areas.
Figure 6B:
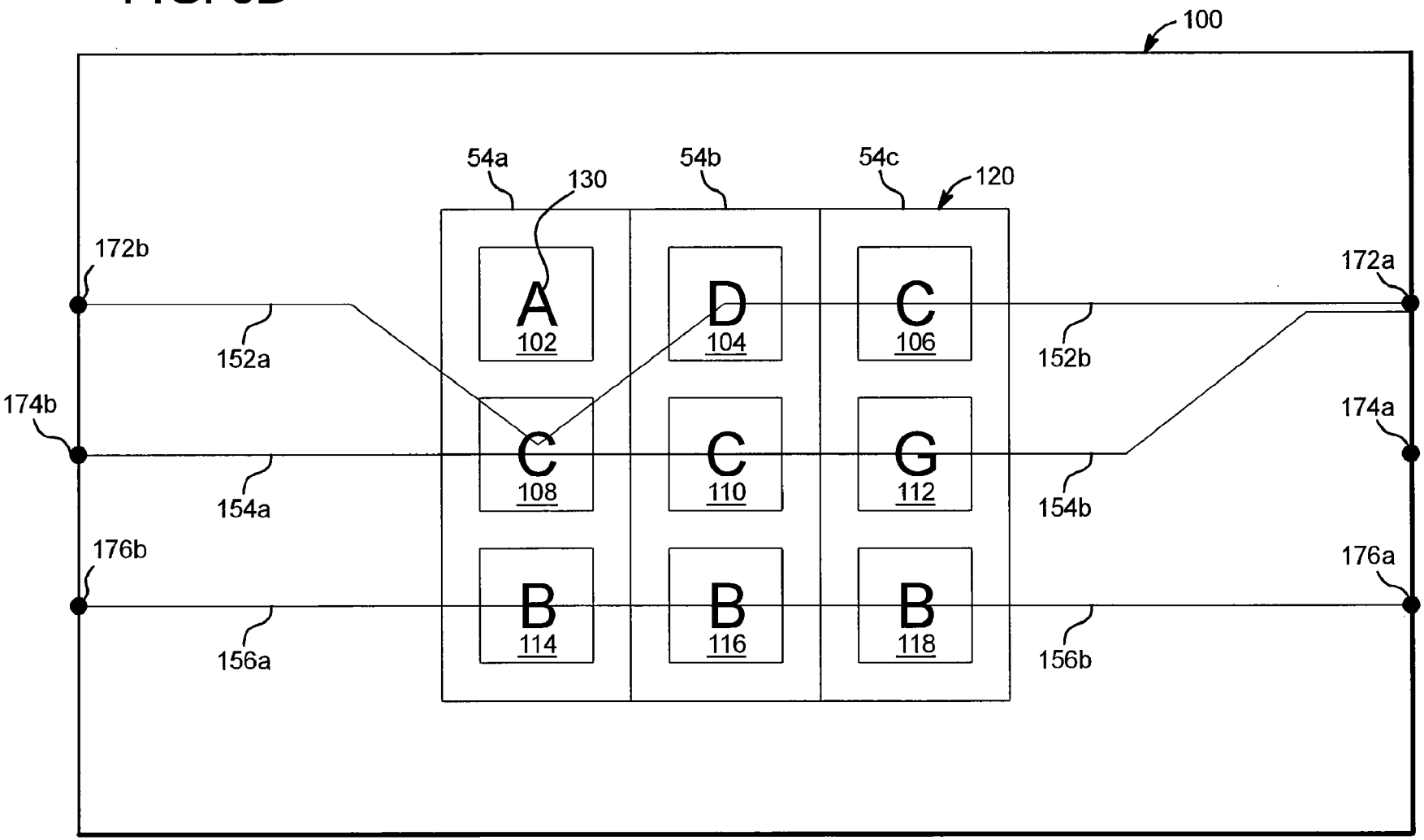
Figure 6C:
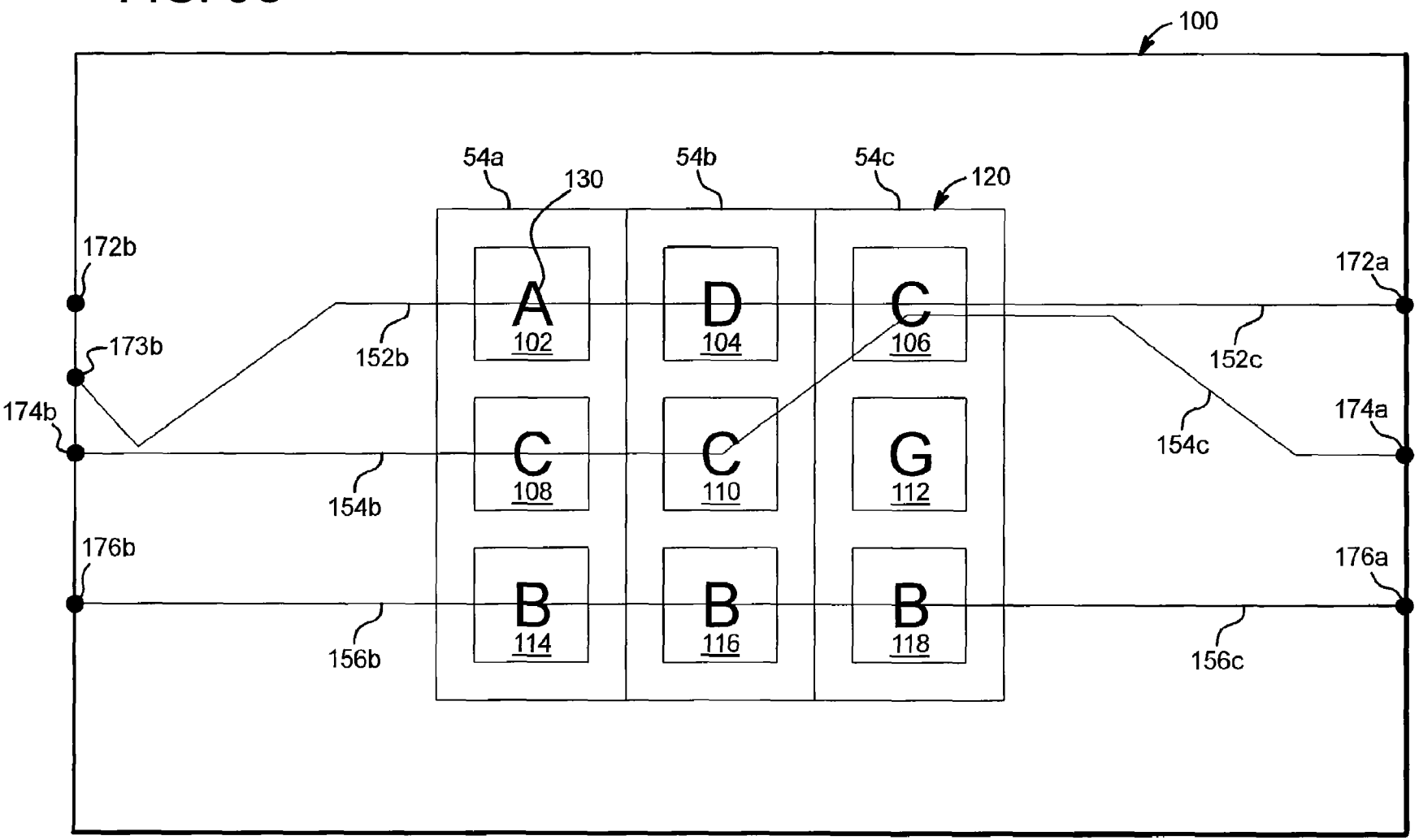

Referring now to FIGS. 6A, 6B and 6C, in an embodiment, the display of paylines may include a display of a portion of an individual payline, at least one of a plurality of paylines, or a portion of at least one of a plurality of paylines. At any particular time, the display device may not display other paylines or other portions of paylines within the viewing area of the display. A first position of a payline may include a displayed portion or section of a payline and a non-displayed portion or section of a payline. A transition from the first position to a second position may include a display of the section not displayed in the first position. For example, only portions of paylines 152, 154 and 156 are displayed in the viewing area of the display illustrated in FIGS. 6A, 6B and 6C. In FIG. 6A, payline sections 152*a*, 154*a* and 156*a* are displayed in the viewing area of the display. Displayed to the left of the symbol display areas 120 are portions of paylines 152, 154 and 156 that may have been displayed in association with the symbol display areas in a previous position of the paylines. In FIG. 6B, only payline sections 152*a*, 154*a* and 156*a*, and payline sections 152*b*, 154*b* and 156*b* are displayed. In FIG. 6C, only payline sections 152*b*, 154*b* and 156*b*, and payline sections 152*c*, 154*c* and 156*c* are displayed. Payline sections 152*a*, 154*a* and 156*a* are no longer displayed in the viewing area of the display.

The displayed transition of a payline may include displaying a section of the payline as entering the viewing area of the display from an origination point and exiting the viewing area of the display at an exit point. For example, as illustrated in FIG. 6A, a section of payline 152, payline section 152*a*, enters the viewing area of display 100 at origination point 172*a*. In an embodiment, the payline may transition to one or more positions within the viewing area until that portion of the payline exits the viewing area of the display 100 at an exit point 172*b*. Alternatively, the entire length of the payline may pass through the viewing area any number of times until the transition to a second position is complete. Likewise, other paylines may transition independently or simultaneously.

It should be appreciated that origination points and exit points may be located at any suitable location along the perimeter of the viewing area of the display. It should also be appreciated that at least one of the origination point and the exit point of a payline in a first position may be different for the same payline in a second or subsequent position. For example, as illustrated in FIG. 6B, payline 154 appears to enter the viewing area of the display from origination point 172*a*, rather than 174*a* as in the first position illustrated in FIG. 6A. It should be further appreciated that subsequent positions of paylines may include any number of origination points, exit points or both, that may be new or different from origination points and exit points of the paylines in previous positions of the paylines. For example, as illustrated in FIG. 6C, payline 152 is displayed to exit the viewing area of display 100 at exit point 173*b*. As illustrated in FIGS. 6A and 6B, none of paylines 152, 154, or 156 were displayed as exiting the viewing area of display 100 at point 173*b*.

Figure 7A:
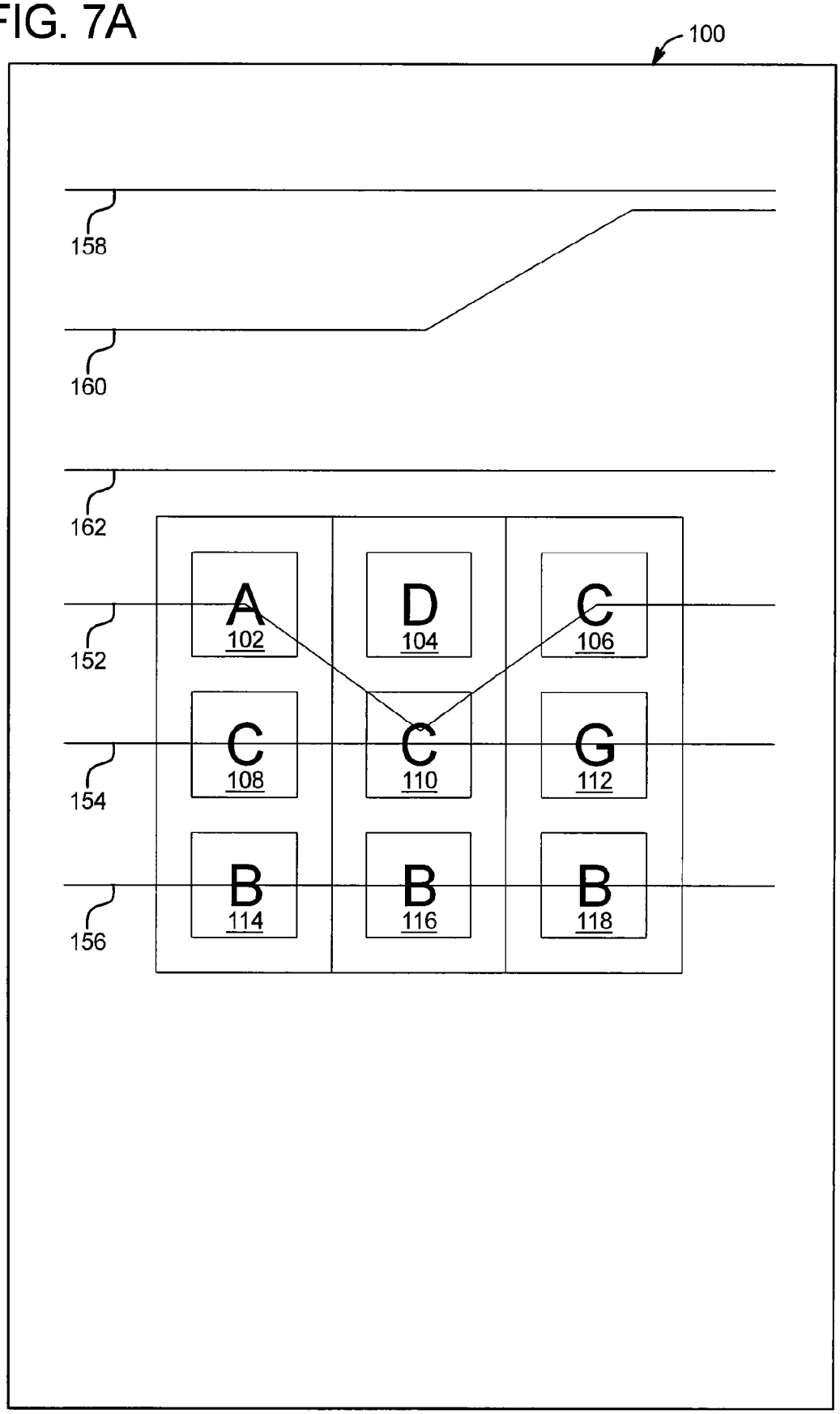

Any suitable number of paylines may be displayed on the display device. In an embodiment, one or more paylines or sets of paylines may be displayed that are not associated with the symbol display areas. As illustrated in FIG. 7A, paylines 152, 154 and 156 are displayed in association with the symbol display areas. In particular, payline 152 is displayed in association with symbol display areas 102, 110 and 106; payline 154 is displayed in association with symbol display areas 108, 110 and 112; and payline 156 is displayed in association with symbol display areas 114, 116 and 118. Also illustrated in FIG. 7A are additional paylines, 158, 160 and 162 displayed separate from paylines 152, 154 and 156 and not in association with the symbol display areas. Additional paylines may be displayed in any suitable spatial relation to the symbol display areas such as above, below, beside, or at any suitable angle, or combinations thereof, in two-dimensional or three-dimensional space. In the illustrated embodiment, paylines 158, 160 and 162 are displayed above the symbol display areas. This arrangement of the displayed paylines may be considered a first position of the paylines.

Figure 7B:
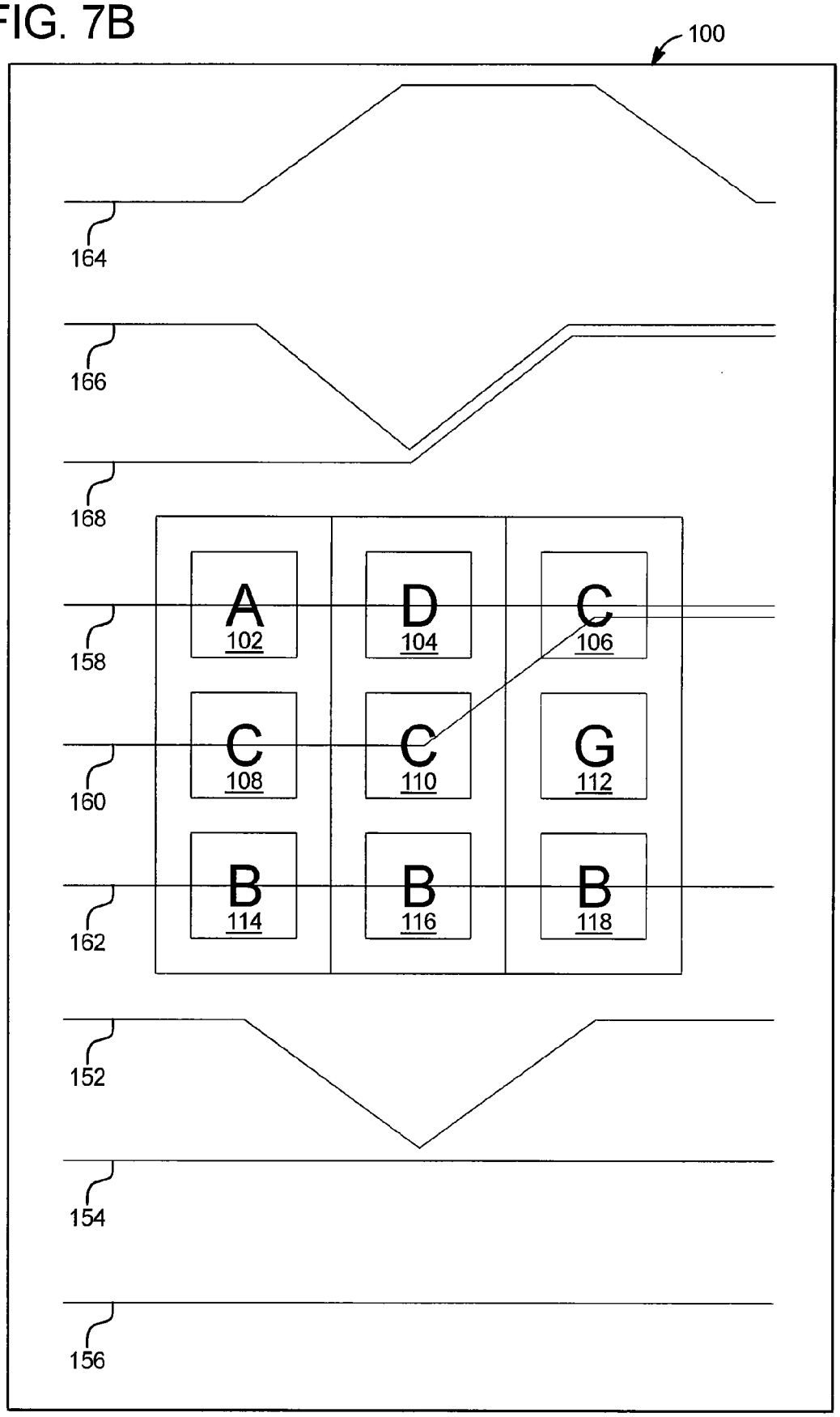

In an embodiment, the display device is adapted to display the paylines in a first position, as illustrated in FIG. 7A, and a second position, as illustrated in FIG. 7B. FIG. 7B illustrates the paylines in a second position such that paylines 158, 160 and 162 are associated with the symbol display areas. In the second position, illustrated in FIG. 7B, payline 158 is displayed in association with symbol display areas 102, 104 and 106; payline 160 is displayed in association with symbol display areas 108, 110 and 106; and payline 162 is displayed in association with symbol display areas 114, 116 and 118. Paylines 152, 154 and 156 are no longer associated with the symbol display areas. The transition of the paylines from the first position to the second position may be displayed as the paylines scrolling from above the reels to below the reels. The paylines may scroll one by one, a plurality at a time, or all at a time as illustrated in FIGS. 7A and 7B.

In the second position, two different sets of symbol display areas are associated with the paylines. Payline 158 is displayed in association with symbol display areas 102, 104 and 106 instead of symbol display areas 102, 110 and 106 as indicated by payline 152 in FIG. 7A. Payline 160 is displayed in association with symbol display areas 108, 110 and 106, instead of symbol display areas 108, 110 and 112 as indicated by payline 154 in FIG. 7B. Accordingly, a different combination or set of symbol display areas is associated with the paylines displayed in the second position, than the sets of symbol display areas associated with the paylines displayed in the first position.

In addition, in various embodiments, the display device may be adapted to display another group of paylines that may transition to a position in association with the symbol display areas. For example, in FIG. 7B, following a transition of paylines 152, 154, 156, 158, 160 and 162 from a first position to a second position, paylines 164, 166 and 168 may be displayed. If any additional transition to a third position of the paylines occurs, any of the displayed paylines may transition to a position in association with the symbol display areas, including paylines 164, 166 and 168. It should be appreciated, however, that any displayed or non-displayed paylines may transition to a position in association with the symbol display areas.

Figure 8A:
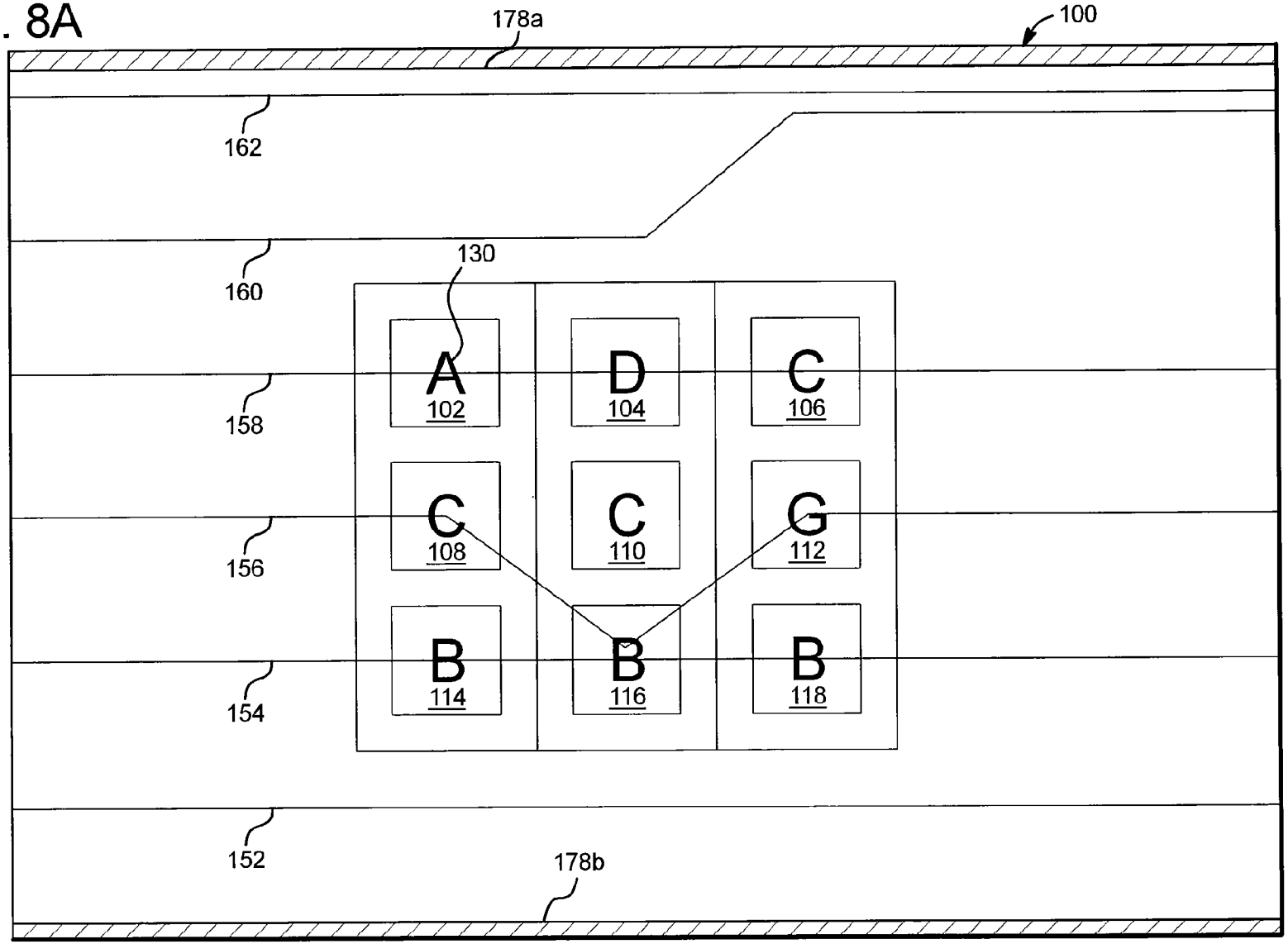
FIGS. 8A and 8B are front views of a display device of at least one embodiment disclosed herein illustrating an alternative display of a transition of one or more paylines in relation to symbol display areas.
Figure 8B:
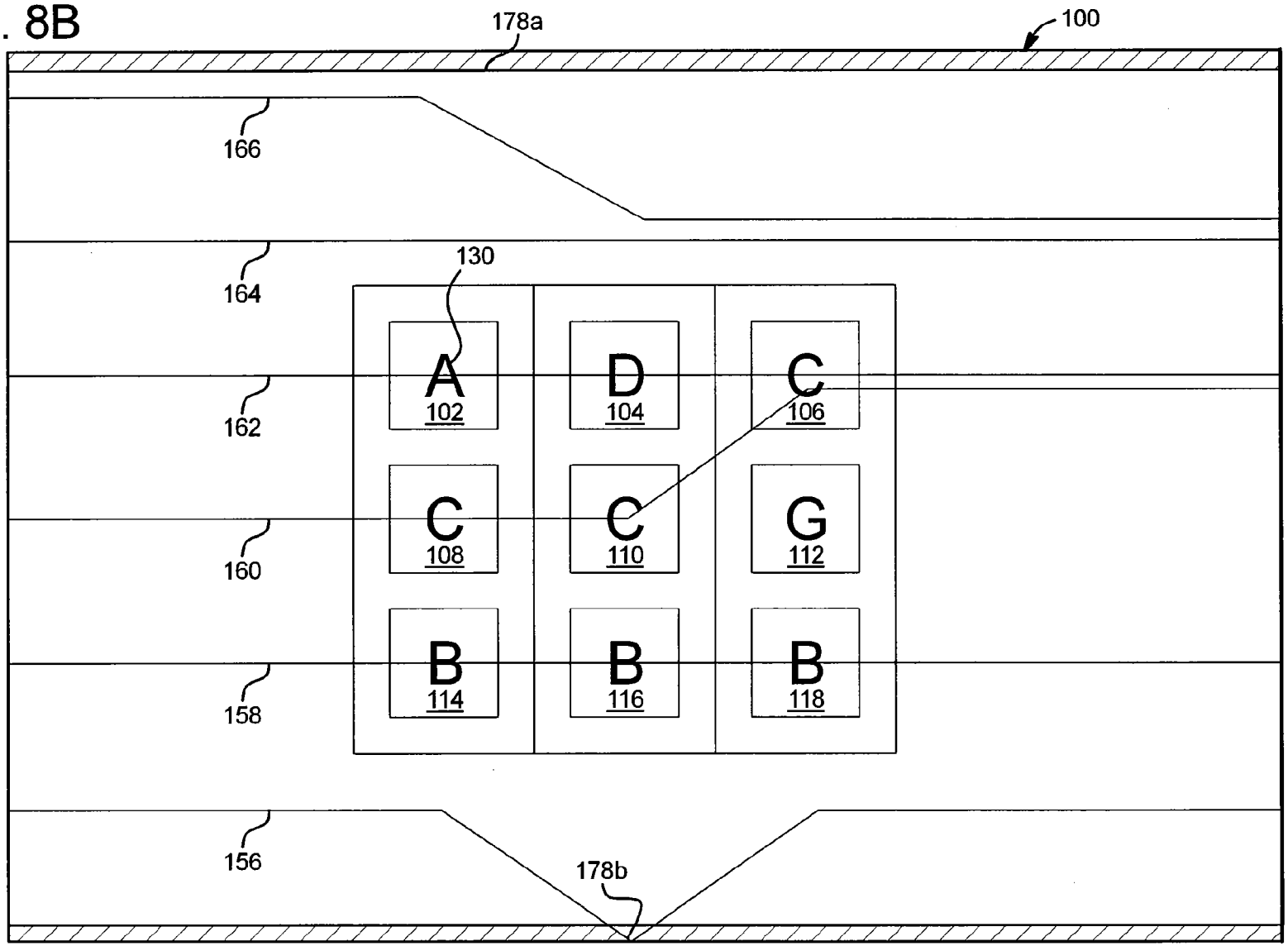

FIGS. 8A and 8B illustrate a series of paylines displayed as extending across the viewing area of display device 100. The display of paylines may include a display of one or more different paylines in a first position that may or may not be associated with symbol display areas on the display. For example, as illustrated in FIG. 8A, portions of paylines 152, 154, 156, 158, 160, and 162 are displayed within the viewing area of the display. Paylines 154, 156 and 158 are associated with the symbol display areas. Paylines 152, 160 and 162 are not associated with the symbol display areas.

A transition of the paylines from the first position, illustrated in FIG. 8A, to a second position, illustrated in FIG. 8B, may cause the paylines to appear to come from and pass into an area beyond a viewing area of the display such as the edge 178 of the display device 100. A transition of the paylines from the first position to the second position may also include a display of an entry of, or origination of, paylines not displayed in the first position into the viewing area of the display. In addition, the displayed transition may include the removal from, or exit from, the viewing area of paylines displayed in the first position of the paylines. The displayed transition may include displaying one or more paylines as originating from an origination point of the viewing area of the display and undergoing at least one transition to an exit point from the viewing area of the display. As illustrated in FIG. 8B, the entry of paylines 164 and 166 into the viewing area of the display 100 from origination point 178*a* corresponds with an exit of paylines 152 and 154 from the viewing area of the display at exit point 178*b*. Again, this transition of paylines may appear to occur in any direction from the first position to the second position.

In an embodiment, at least one of a direction, duration, and frequency of transition of paylines in relation to symbol display areas may be randomly determined, predetermined, or based on any player input, event or outcome in a game.

In embodiments of the present disclosure, one or more transition triggers may be included to initiate a change in the relationship between one or more paylines and displayed symbol display areas associated with the paylines. Transition triggers may further determine at least one of a direction, duration, and frequency of transition of paylines in relation to symbol display areas. The transition trigger may indicate a direction that a payline or group of paylines may shift, such as left, right, up, down or any other suitable direction. The transition trigger may indicate a switch in direction of a transition of the paylines, such as shifting the direction of the paylines from left to right following a transition from right to left. The transition trigger may indicate the extent or duration of a transition of the paylines or symbol display areas such as the distance along a payline the symbol display areas shift and/or a number of transitions and evaluations.

A transition trigger may be in the form of any suitable symbol or number of symbols or indicia generated by the gaming device and displayed in the symbol display areas to indicate the direction, duration, extent, number or frequency of transition or combinations thereof. For example, a transition symbol may include the indicia "3R" which may indicate a transition of the paylines three positions or increments to the right. It should be appreciated that moving a number of positions or increments may be accomplished in one or more transitions with an evaluation being performed for each transition. In particular, the generation of the indicia, "3R" may indicate three transitions to the right of one increment each with an evaluation after each transition, or a single transition of three increments to the right for a single evaluation. The number of transitions may be determined by the gaming device, by a player input or by any suitable event of a game.

FIGS. 9A, 9B, 9C and 9D illustrate an exemplary embodiment including transition of paylines based, at least in part, on transition symbols. The gaming device may generate at least one transition symbol to be displayed in the symbol display areas of the display. One or more transition symbols may replace a generated symbol in a random fashion, in association with particular generated symbols, based on an event or outcome in a game, or upon any other suitable basis.

Figure 9A:
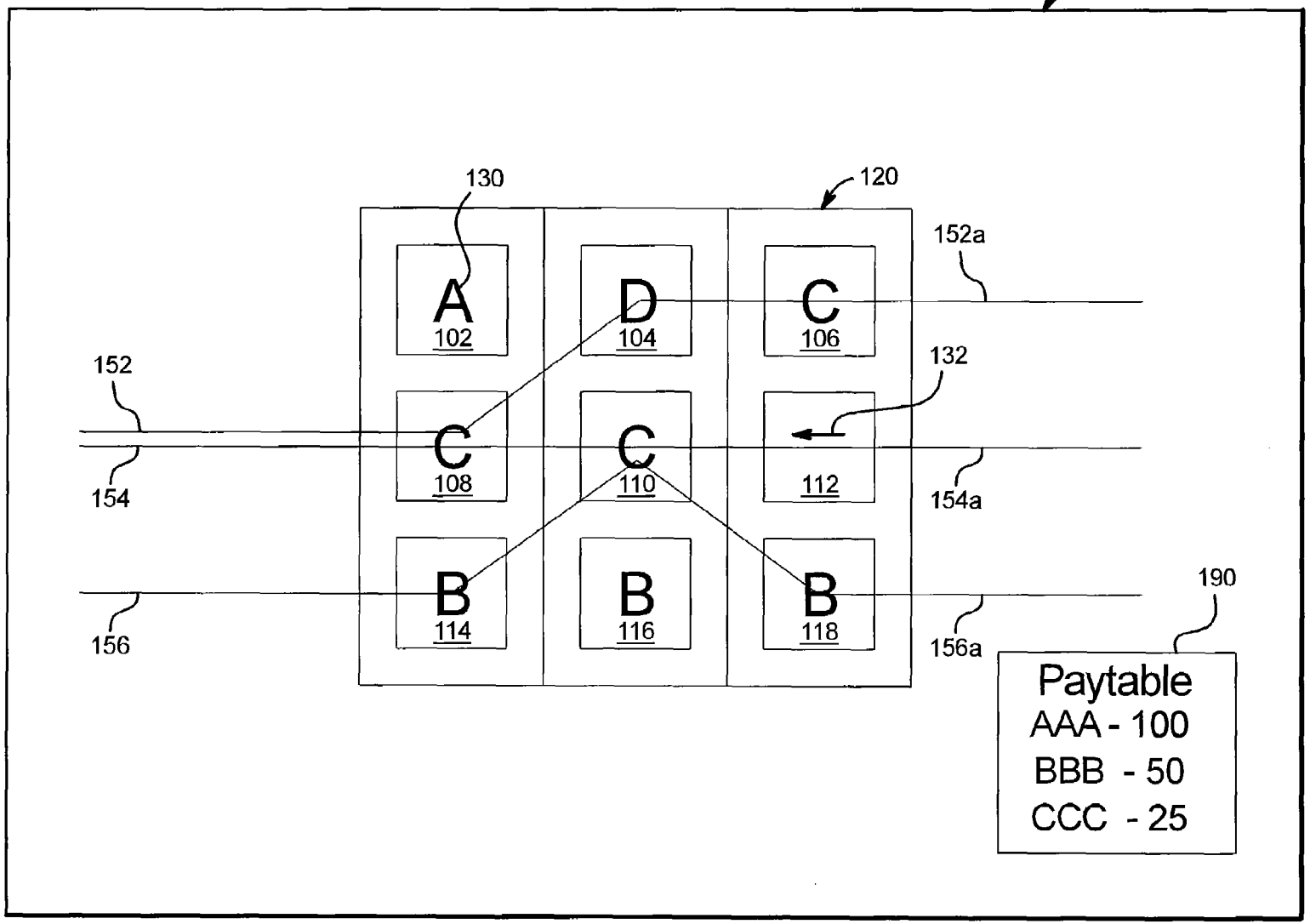
FIGS. 9A, 9B, 9C and 9D are front views of a display device of at least one embodiment disclosed herein illustrating an alternative display of a transition of one or more paylines in relation to symbol display areas.

The transition symbol may replace a generated symbol through one or more transitions of the paylines. As illustrated in FIG. 9A, a transition symbol 132 is generated and displayed in symbol display area 112. The transition symbol may be configured as an "arrow" to indicate a direction. In the illustrated embodiment, the transition symbol 132 indicates a transition of at least one of the paylines to the left of the display 100 in accordance with the transition symbol. It should be appreciated that any other suitable symbols indicating a direction may be employed, such as the word "Left" or letter "L".

Figure 9B:
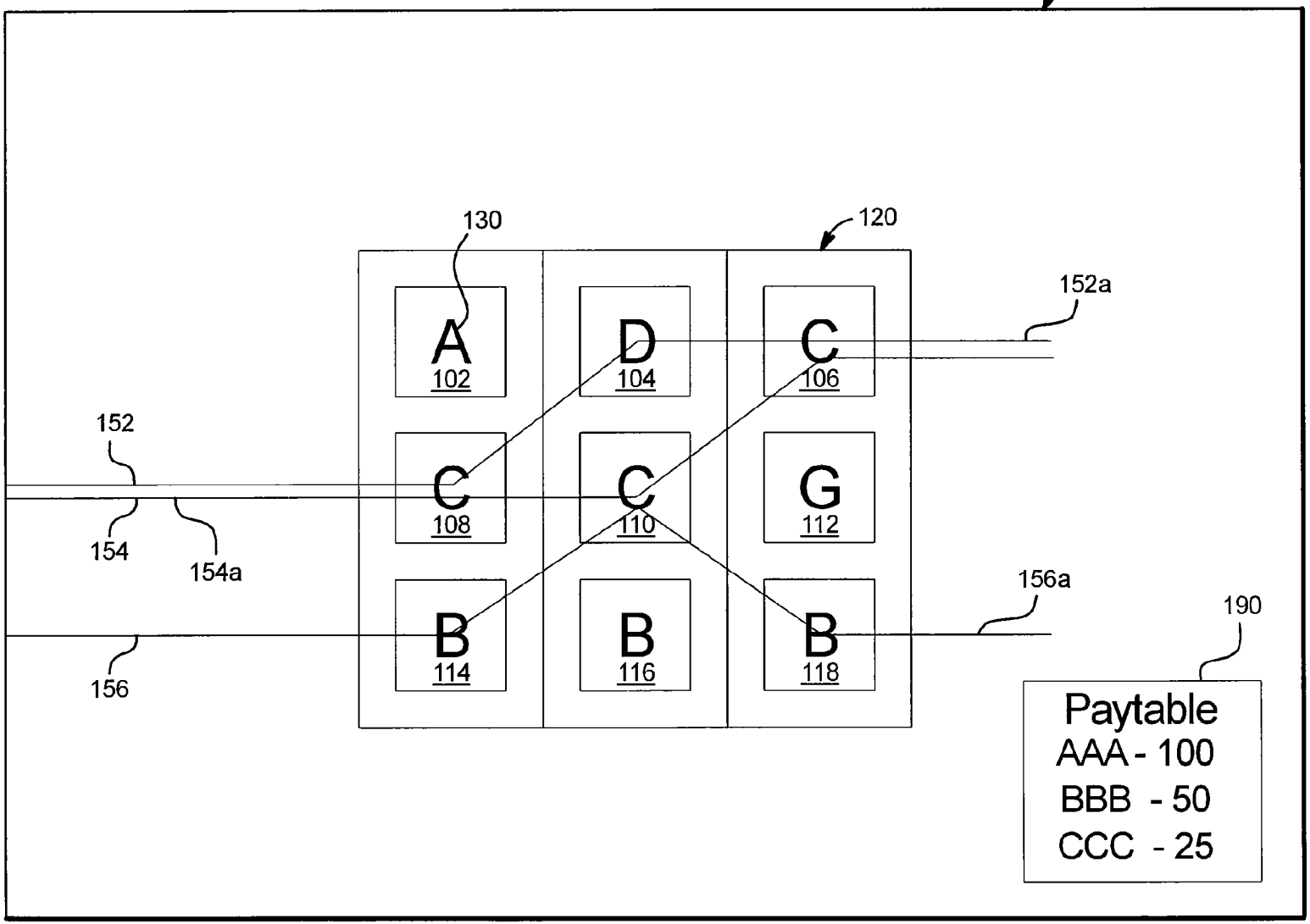

Payline 154 is associated with symbol display area 112 displaying the transition symbol 132. In various embodiments, the payline associated with a symbol display area displaying a transition symbol undergoes a transition in accordance with the transition symbol. Paylines other than the payline indicating a transition symbol may undergo a transition in addition to or instead of the payline associated with a symbol display area displaying a transition symbol. FIG. 9B illustrates a transition of payline 154 in a direction indicated by the transition symbol 132 in FIG. 9A. As illustrated in FIG. 9B, payline portion 154*a* is illustrated in a position to the left of the symbol display areas 120 indicating a shift of payline 154 to the left of the display 100. Payline portions 152*a*, and 156*a* remain displayed in a position to the right of the symbol display areas indicating that paylines 152 and 156 in this embodiment have not undergone a transition. Also, in an embodiment, the transition symbol may be changed back to a previously displayed symbol, or a newly generated symbol to replace the transition symbol displayed in the symbol display area. In FIG. 9B, the arrow displayed in the symbol display area 112 is replaced by a G symbol.

As illustrated in FIG. 9B, upon transition of the paylines in accordance with the transition symbol, payline 154 is associated with symbol display areas 108, 110 and 106, each displaying a C symbol. According to the paytable illustrated in FIGS. 3A to 3D, three C symbols is a winning outcome. In an embodiment, a winning outcome event in a game causes at least one transition symbol to replace any symbol displayed in the symbol display areas to initiate at least one additional transition of the paylines. In an embodiment, a winning outcome event in a game causes at least one transition symbol to replace at least one of the winning symbols to initiate at least one additional transition of the paylines. For example, in FIG. 9C, the C symbol displayed in symbol display area 106 is replaced, as described above, with a transition symbol 132 indicating a direction for payline transition. The transition symbol 132 indicates a downward transition of at least one of the paylines in relation to the symbol display areas.

Figure 9C:
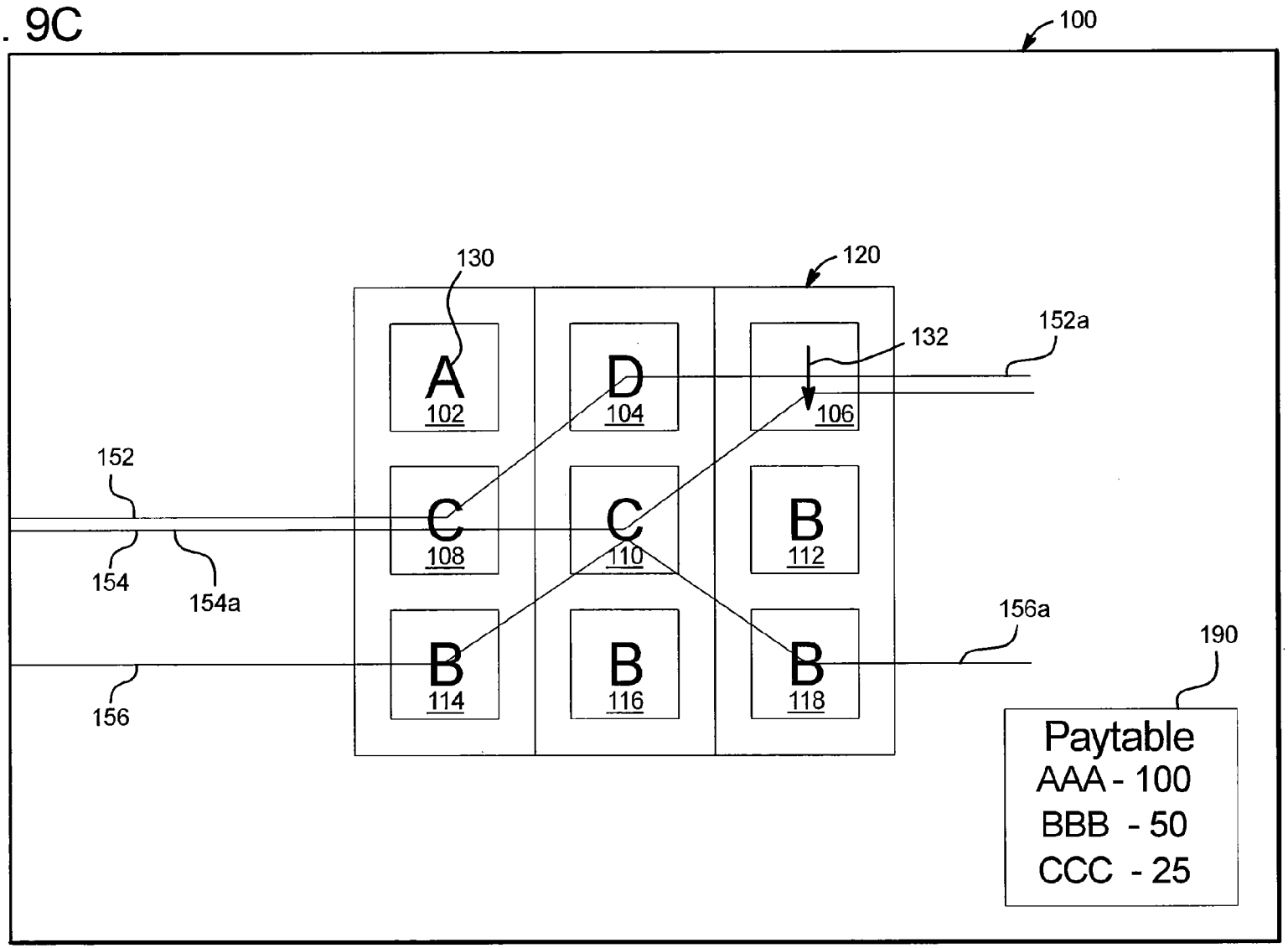
Figure 9D:
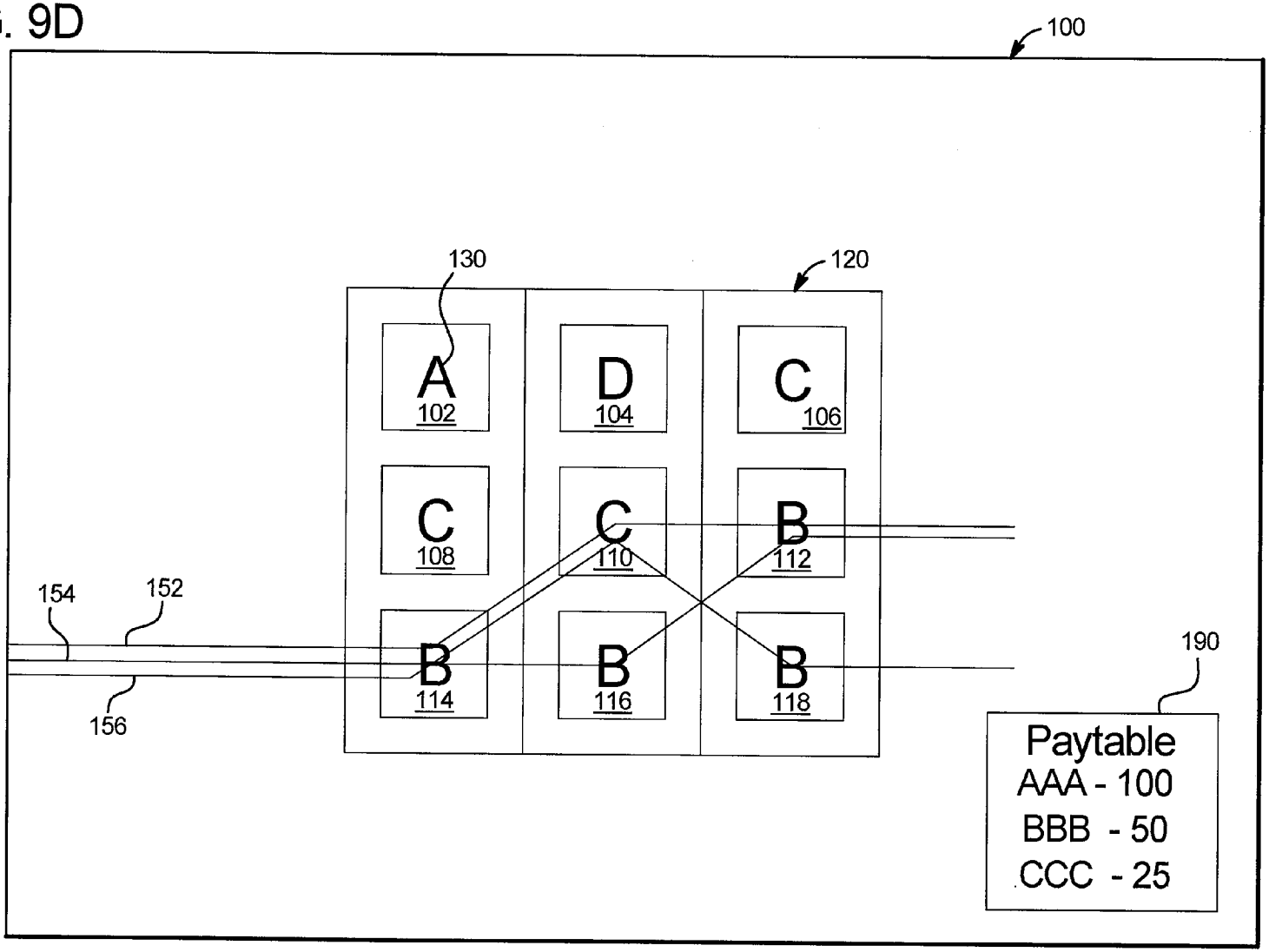

FIG. 9D illustrates a transition of paylines from a position illustrated in FIG. 9C in accordance with the transition symbol 132 displayed in symbol display area 106. As illustrated in FIG. 9D, because both paylines 152 and 154 indicate the transition symbol displayed in symbol display area 106, both paylines 152 and 154 are shifted downward. Payline 152 is associated with symbol display areas 114, 110 and 112. Payline 154 is associated with symbol display areas 114, 116 and 112. In the illustrated embodiment, payline 156 remains associated with symbol display areas 114, 110 and 118. Again, payline 154 indicates a winning outcome of three B symbols associated with an award according to the paytables illustrated in FIGS. 3A to 3D. Also, in the illustrated embodiment, the transition symbol is replaced by the symbol previously displayed in the symbol display area prior to the transition of the paylines. Accordingly, in FIG. 9D, the C symbol displayed in FIG. 9B replaces the transition symbol illustrated in FIG. 9C. It should be appreciated that, in an embodiment, a vertical transition of the paylines may include the display of additional paylines above or below the displayed paylines as described above.

A transition symbol may initiate a re-generation of displayed symbols or portion thereof such as in a re-spin of one or more reels. In such embodiments, transitions and subsequent evaluations may occur after the regeneration of symbols.

In an embodiment, the direction of a transition may be based on the direction of the order of symbols in a winning combination of symbols. For example, if a winning combination of symbols is displayed on the display device in the order A, B and C from left to right, and an award, according to the paytable, is associated with the symbol combination in the order of C, B and A from left to right, the direction of a subsequent transition may proceed from right to left according to the direction of the order of symbols in the winning combination of symbols, C, B and A. A direction of a transition may also alternate between two or more directions for any number of transitions.

In an embodiment, a payline transition may include a return to one or more previous positions of the payline in association with the symbol display areas. For example, a transition of a payline from a first position to a second position may be reversed to transition the payline from the second position back to the first position. An evaluation of any winning symbol or combination of symbols indicated by the payline in the first position, may be performed in the second position and again in the first position. In certain embodiments, if a winning symbol or combination of symbols is indicated by at least one of the paylines in the previous position, a return to that previous position may entitle the player to an additional award based on the winning symbol or combination of symbols indicated by the payline in that previous position. It should be appreciated that any suitable triggering event as described above may initiate a return to a previous position.

As described above, a payline transition may include a change in association of the payline with at least one symbol display area as a result of a shift of the payline in relation to the symbol display areas or the shift of the symbol display areas in relation to the payline. A payline transition may also include a change in association of the payline with at least one symbol displayed in a symbol display area. For instance, in an embodiment, a transition of the paylines may occur when at least one displayed symbol is shifted to a different symbol display area in the display such that at least one payline indicates a symbol previously displayed in another display area. Such a transition includes at least one shifted symbol and may include at least one newly generated symbol.

Figure 10A:
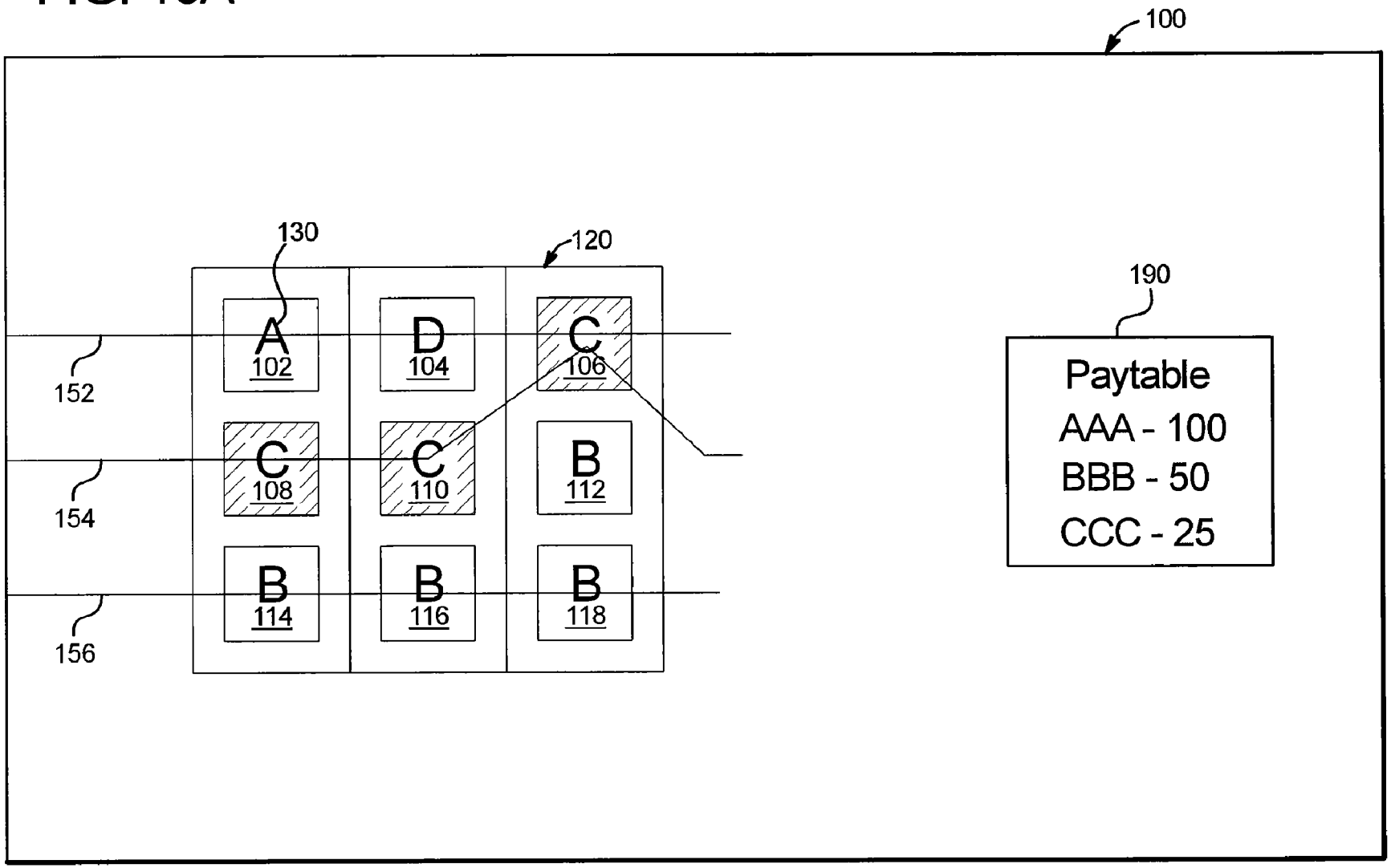
FIGS. 10A and 10B are front views of a display device of at least one embodiment disclosed herein illustrating an alternative display of a transition of one or more paylines in relation to symbol display areas.
Figure 10B:
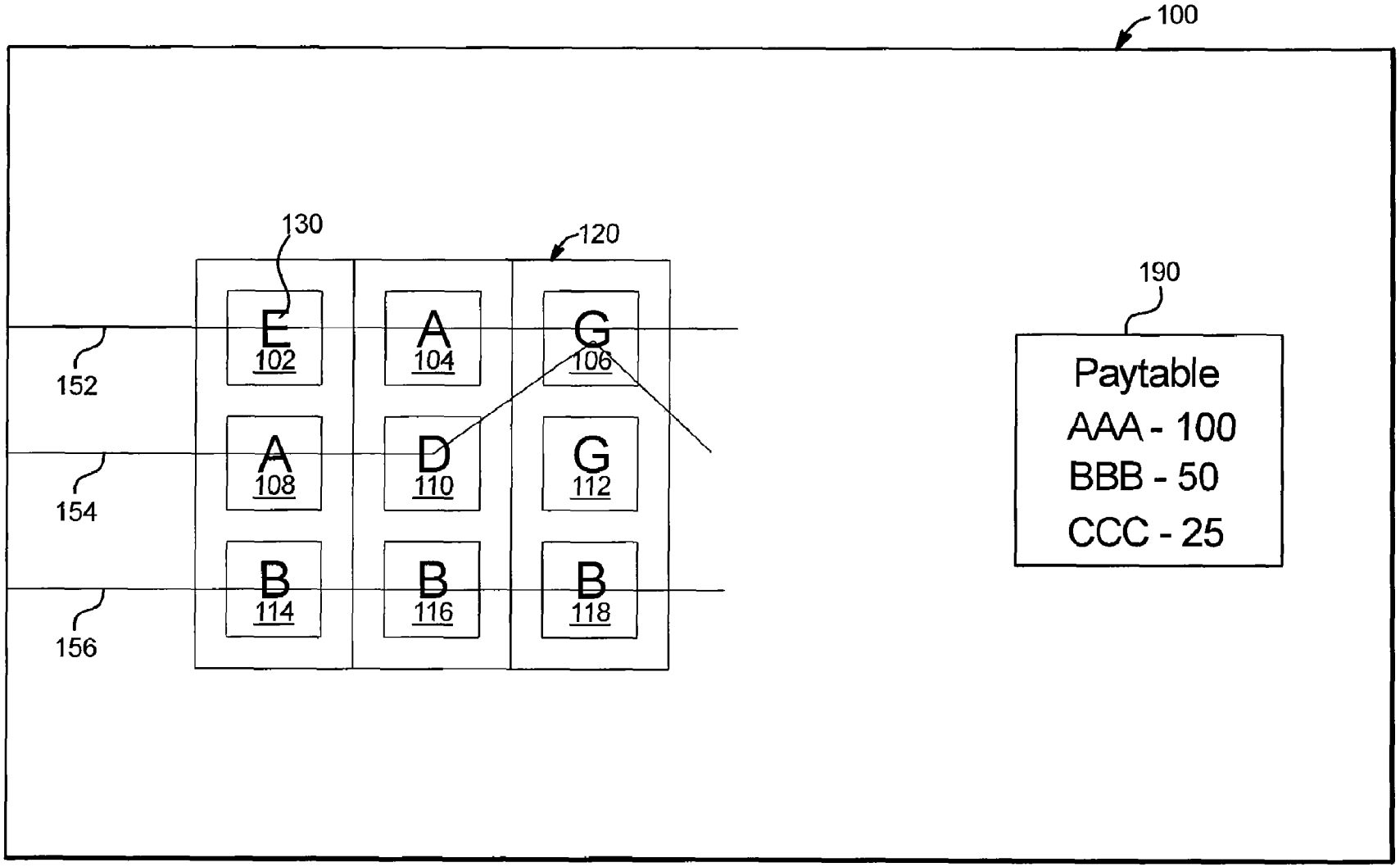

FIGS. 10A and 10B illustrate a winning combination of C symbols displayed in symbol display areas 108, 110 and 106 indicated on payline 154. In an embodiment, symbols of a winning combination are removed from the display causing symbols displayed in symbol display areas above the winning symbol display areas to cascade into the winning symbol display areas. Symbols displayed in symbol display areas 102 and 104 may shift into symbol display areas 108 and 110. In an embodiment, additional symbols may be generated to replace winning symbols removed from the symbol display areas. As illustrated in FIG. 10A, a G symbol is generated to be displayed in symbol display area 106 to replace the removed winning symbol, and symbols E and A symbols are generated to be displayed in symbol display areas 102, 104, respectively, to replace the symbols shifted to symbol display areas 108 and 110. Accordingly, payline 154 undergoes a transition which includes a change in association of the payline with at least one symbol displayed in a symbol display area. In particular, payline 154 undergoes a change from being associated with symbols C, C and C to being associated with symbols A and D previously displayed in symbol display areas 102 and 104, respectively, and newly generated symbol G.

The number of transitions may be fixed and may be independent of the outcome or event in a game such as the outcome of an evaluation following a transition. For example, as described above, in addition to initiating one or more transitions, a wager may limit the number of transitions to a fixed number regardless of the outcome of the transitions. Alternatively, in some embodiments, the number of transitions may be based on any other suitable event such as an outcome or event in a game. Payline transitions may occur until a winning symbol or combination of symbols is indicated by one or more paylines, such as in a bonus round of a game. Payline transitions may also occur until no winning symbol or combination of symbols is indicated by one or more paylines or until a terminating condition occurs in the game, such as the indication by an activated payline of at least one generated terminator symbol.

It should be appreciated that paylines or symbol display areas may remain in a shifted or second position in relation to one another until a triggering event occurs to shift the paylines or the symbol display areas to a subsequent position. Accordingly, in various embodiments, after at least one transition of paylines or symbol display areas in relation to one another, at least one additional generation, display and evaluation of symbols may occur before the paylines or symbol display areas undergo a subsequent transition.

The transition of a payline from a first position to a second position in relation to the symbol display areas may occur between stop positions on a payline. The stop positions may or may not be displayed to the player. Any suitable number of stop positions may be arranged along a payline. The distance between two stop positions along a payline or the portion of a payline defined by two stop positions may determine the extent of a transition of the payline from a first position to a second position. Portions or sections of the payline defined by stop positions may be the same or different along the payline. The distance between stop positions may be any suitable distance or portion of the payline. For instance, the distance between two stop positions may be equivalent to the distance between two adjacent symbol positions. The distance between two stop positions along a payline may be equivalent to the distance between a set of symbol display areas such as a single row of each of the columns of symbol display areas.

The distribution of the stop positions along a payline including the distance between stop positions may be random, predetermined or based on an input by a player or an outcome or event in one or more games. In an embodiment, a player is enabled to define the stop positions before the start of a game or during free spins.

Figure 11A:
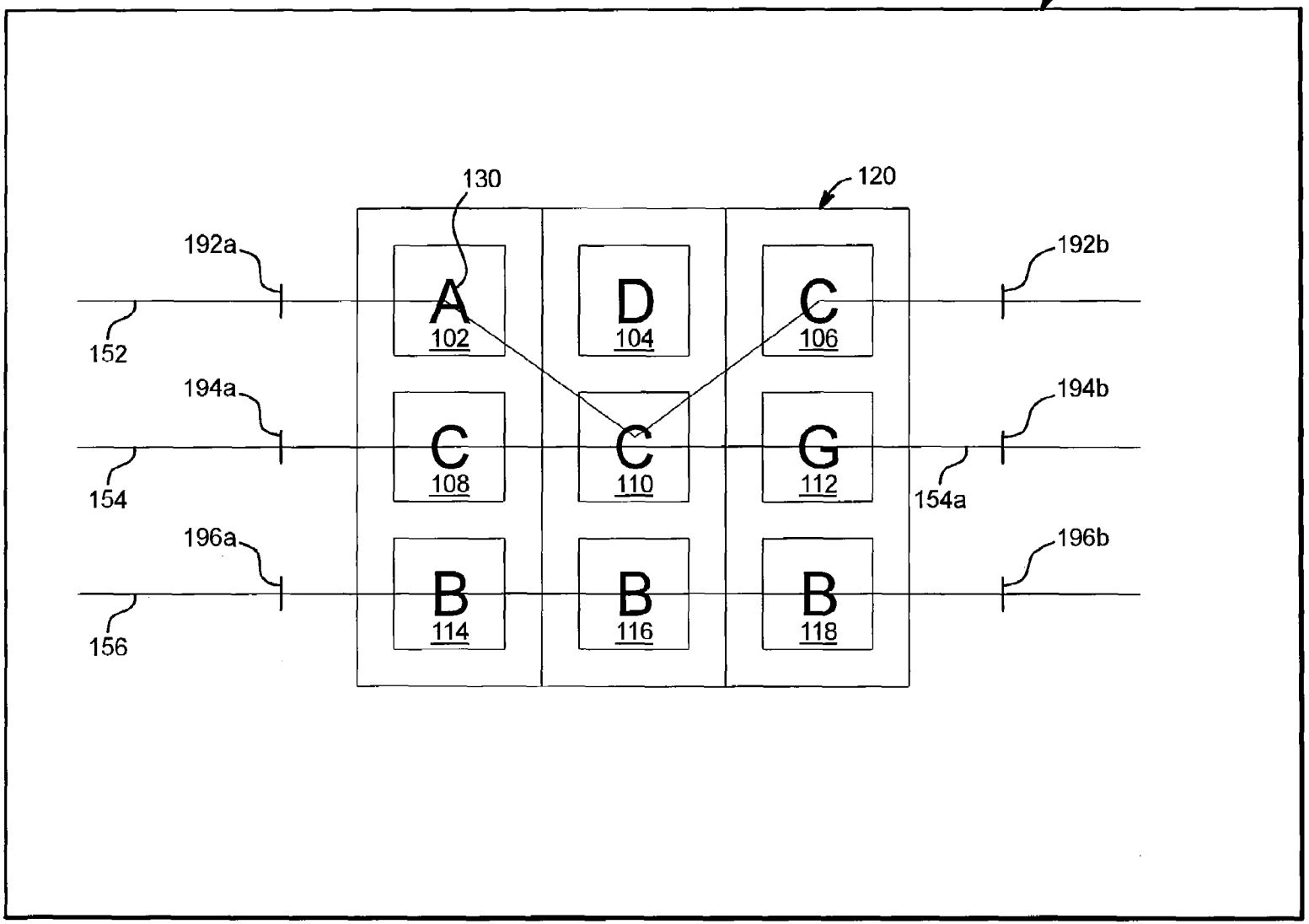
FIGS. 11A and 11B are front views of a display device of at least one embodiment disclosed herein illustrating an alternative display of a transition of one or more paylines in relation to symbol display areas.
Figure 11B:
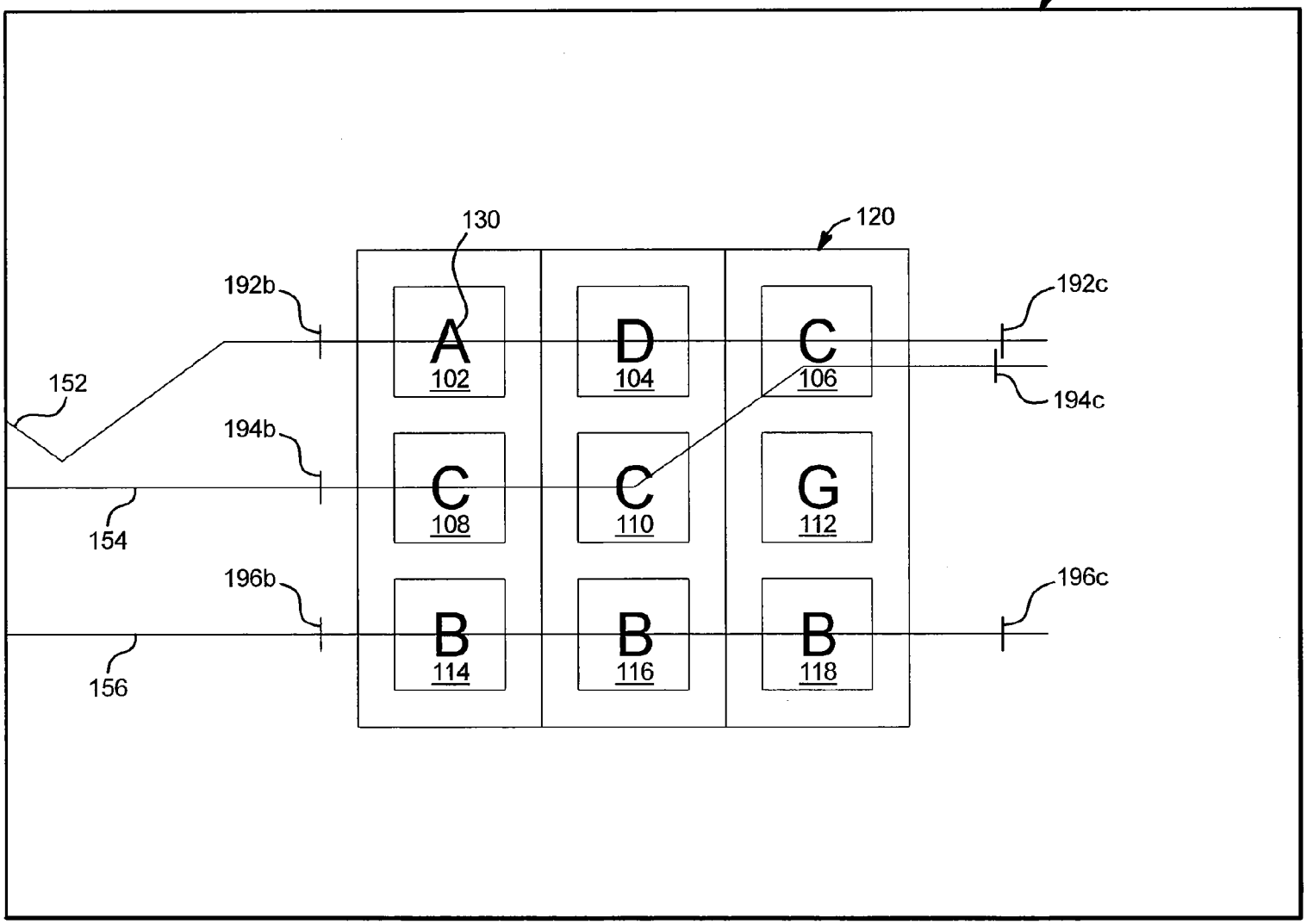

One or more of the stop positions may be arranged in an equidistant manner along the payline such that the transition of a payline from a first position to a second position in relation to the symbol display areas is the same distance along the payline between stop positions. For example, as illustrated in FIGS. 11A and 11B, paylines 152, 154 and 156 each include a plurality of stop positions 192, 194 and 196, respectively, arranged along the payline. Payline 152 includes stop positions 192*a*, 192*b* and 192*c*; payline 154 includes stop positions 194*a*, 194*b* and 194*c*; and payline 156 includes stop positions 196*a*, 196*b* and 196*c*. A pair of stop positions may define a payline section as described above. For example, stop positions 194*a* and 194*b* may define payline section 154*a* as illustrated in FIG. 11A.

In the first position of the paylines illustrated in FIG. 11A, the symbol display areas 102, 110 and 106 are associated with payline 152 between stop positions 192*a* and 192*b*; symbol display areas 108, 110 and 112 are associated with payline 154 between stop positions 194*a* and 184*b*; and symbol display areas 114, 116 and 118 are associated with payline 156 between stop positions 196*a* and 196*b*.

Each of the paylines, individually or as a group, transition to a second position illustrated in FIG. 11B. In the second position of the paylines, the symbol display areas 102, 104 and 106 are associated with payline 152 between stop positions 192*b* and 192*c*; symbol display areas 108, 110 and 106 are associated with payline 154 between stop positions 194*b* and 194*c*; and symbol display areas 114, 116 and 118 are associated with payline 156 between stop positions 196*b* and 196*c*.

The transition of a payline from a first position to a second position in relation to the symbol display areas may occur between stop positions between paylines. For example, as illustrated in FIG. 10, paylines 150 may transition through symbol display areas 120 in any direction along a vertical axis through any suitable number of paylines to a stop position to indicate a plurality of symbols displayed in the symbol display areas.

Figure 12:
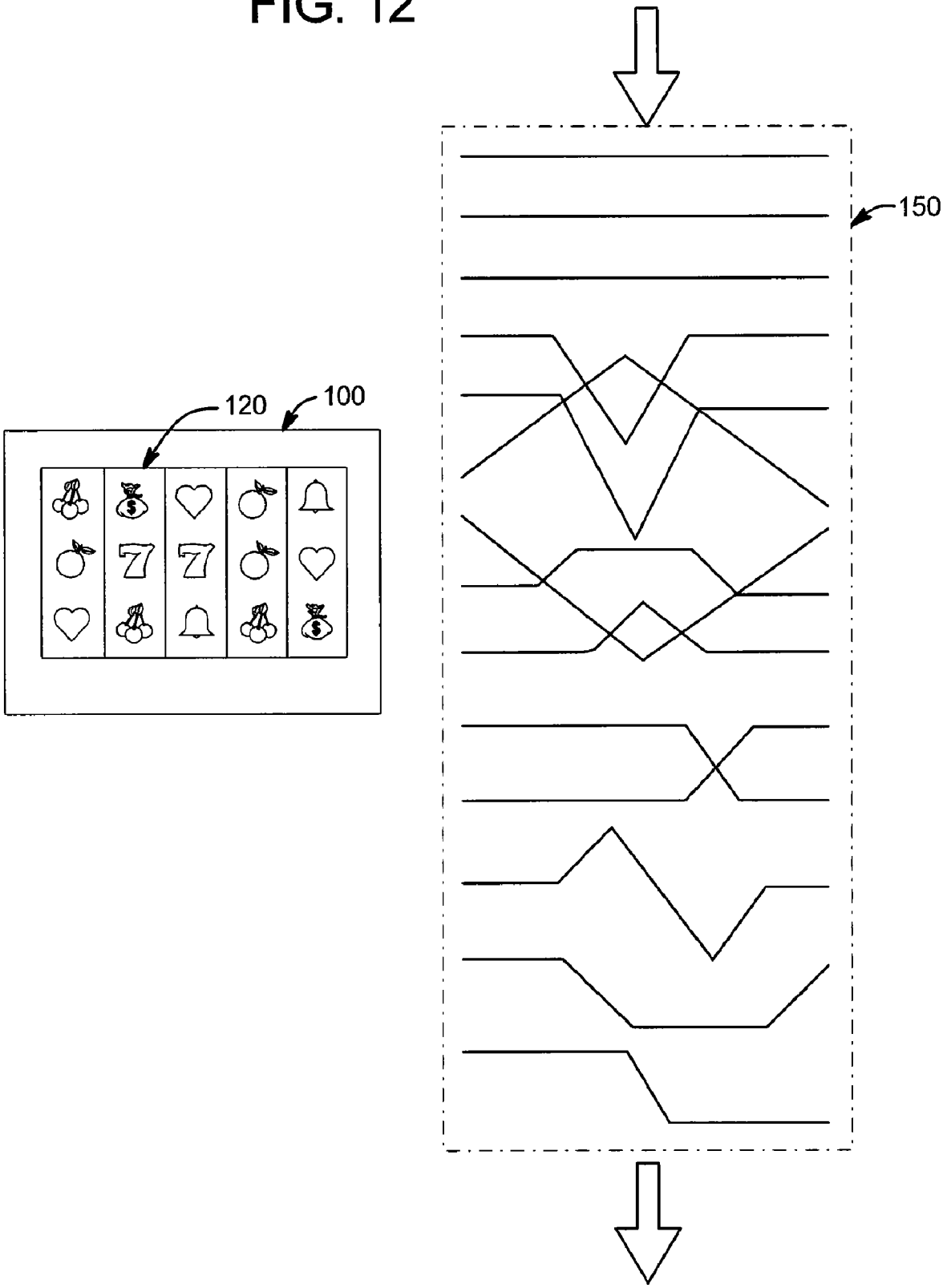
FIG. 12 is a view of a series of paylines that move in relation to symbols displayed on a set of reels in an embodiment of the present disclosure.
Figure 13A:
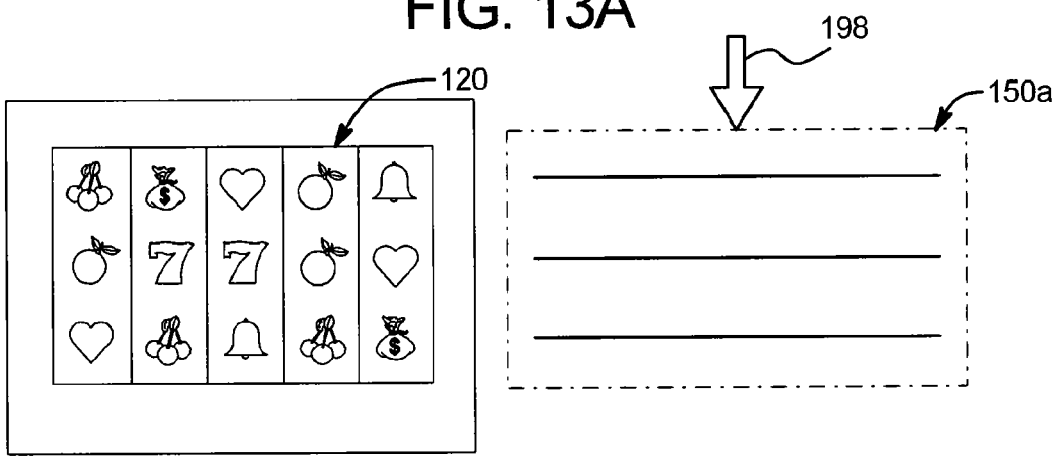
FIGS. 13A, 13B and 13C are views of groups of paylines that move in relation to symbols displayed on a set of reels in an embodiment of the present disclosure.
Figure 13B:
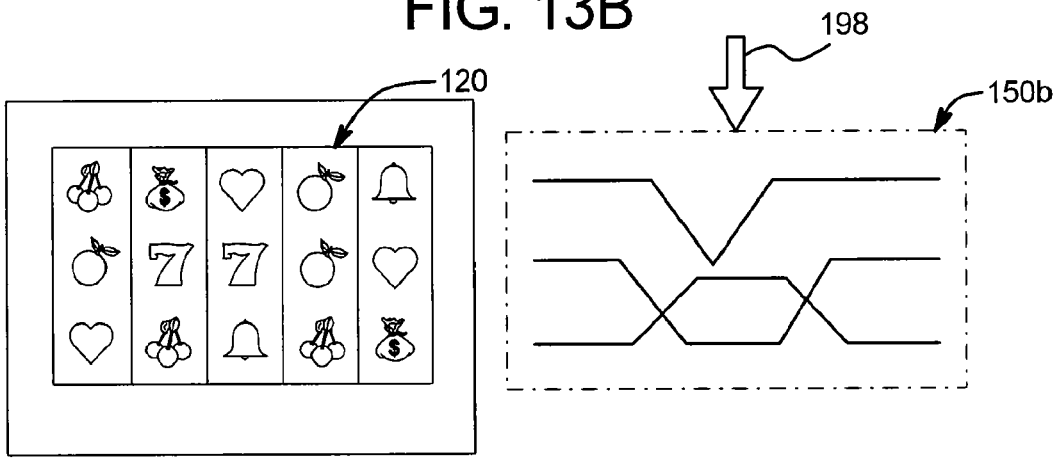
Figure 13C:
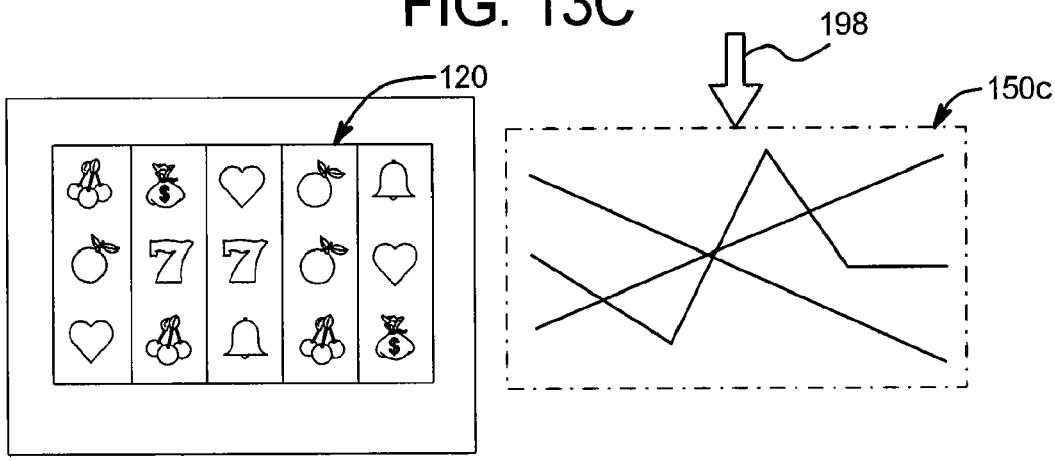

Paylines may move individually to stop positions in relation to the symbol display areas as illustrated in FIG. 12. Alternatively, as illustrated in FIGS. 13A, 13B, and 13C, paylines may move as sets of paylines in a direction 198 to stop positions in relation to the symbol display areas.

In an embodiment, at least one set of a plurality of sets of paylines includes at least one payline having a different configuration than paylines in another set. Paylines may be of any suitable shape or configuration. For example, certain paylines illustrated in FIG. 12 include a different configuration. Shapes or configurations of paylines may vary in a random manner, remain the same, or may be repeated along different paylines. The configuration of a payline may be predetermined or randomly generated as the payline enters the viewing area of the display. Each of the sets of paylines illustrated in FIGS. 13A, 13B and 13C include paylines having a different configuration than the paylines illustrated in the other sets.

In embodiments of the present disclosure, a transition may include a change in configuration of the payline. In an embodiment, any portion or segment of the payline may change configuration as it transitions from one position to another within the viewing area of a display. The configuration of a payline may change from a first configuration in a first position of the payline to a second configuration in a second position of the payline. A change in the configuration of a payline may indicate a different symbol display area.

Figure 14A:
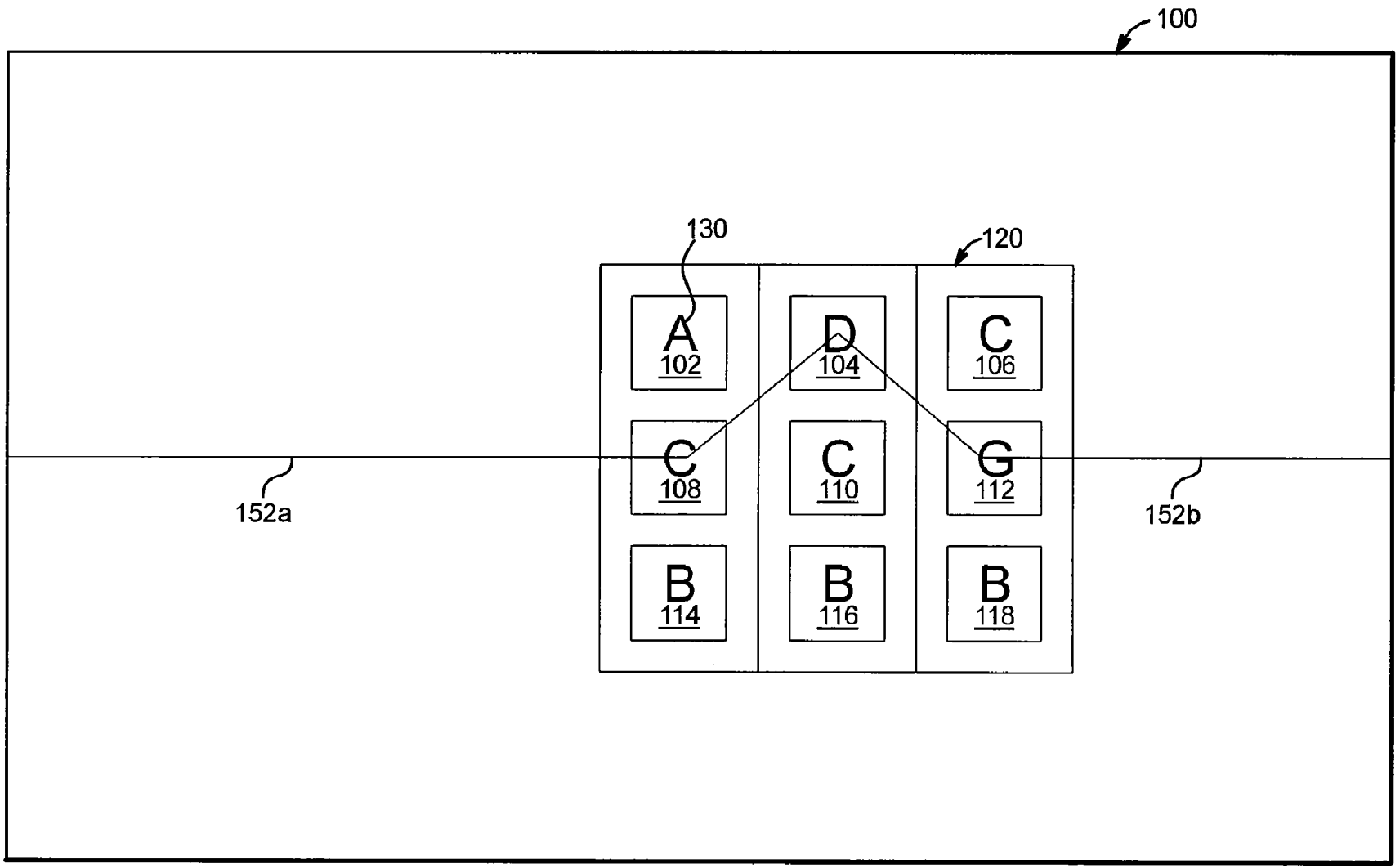
FIGS. 14A and 14B are front views of a display device of at least one embodiment disclosed herein illustrating an alternative display of a transition of one or more paylines in relation to symbol display areas.
Figure 14B:
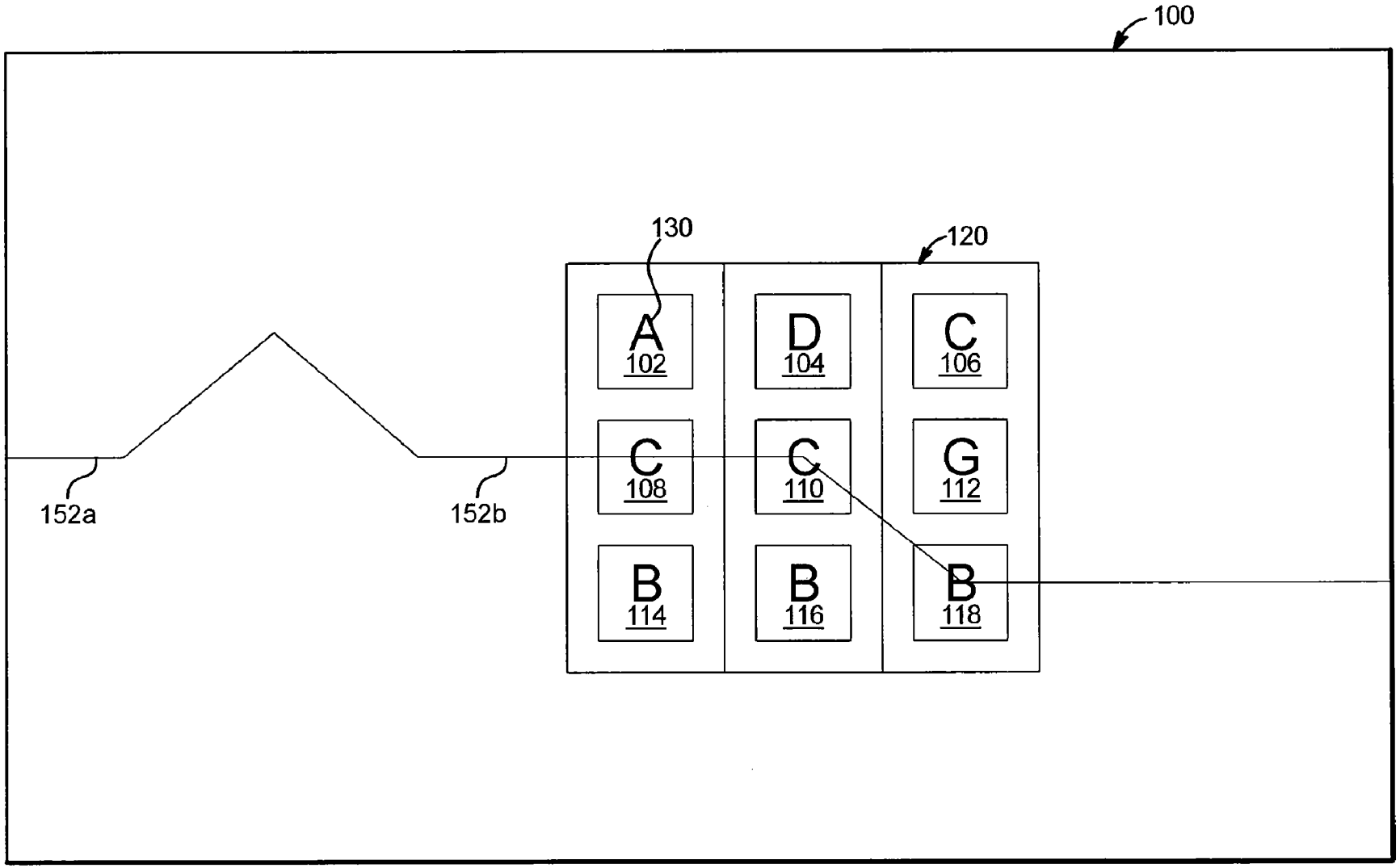

For example, as illustrated in FIGS. 14A and 14B, a transition of payline 152 from a first position to a second position in relation to symbol display areas 120 includes a change in the configuration of the payline. In FIG. 14A, the payline is associated with symbol display areas 108, 110 and 112. It appears that a shift of the payline to the left of the display would result in the payline being associated with symbol display areas 108, 110 and 112. As illustrated in FIG. 14B, however, as the payline shifts to the left, the configuration of the payline also changes. Rather than the payline being associated with symbol display areas 108, 110 and 112 based on the configuration of the payline in FIG. 14A, the payline configuration changes to be associated with symbol display areas 108, 110 and 118. Such a change in the configuration of the payline may be under the control of the gaming device, a player input, or any event or outcome in the game, such as a triggering event. The change in payline configuration may occur randomly or in a predetermined manner, such as at one or more predetermined locations on the display.

It should be appreciated that the chance that a change in the configuration of a displayed payline may occur upon a transition of the payline from a first position to a second position, decreases the probability that a player may determine which symbol display areas will be indicated upon a shift of the payline. Other characteristics of a transition that remain unknown to the player until the transition occurs, such as an unknown direction and extent of a transition of a payline as described above, increase the excitement in a game.

Figure 15A:
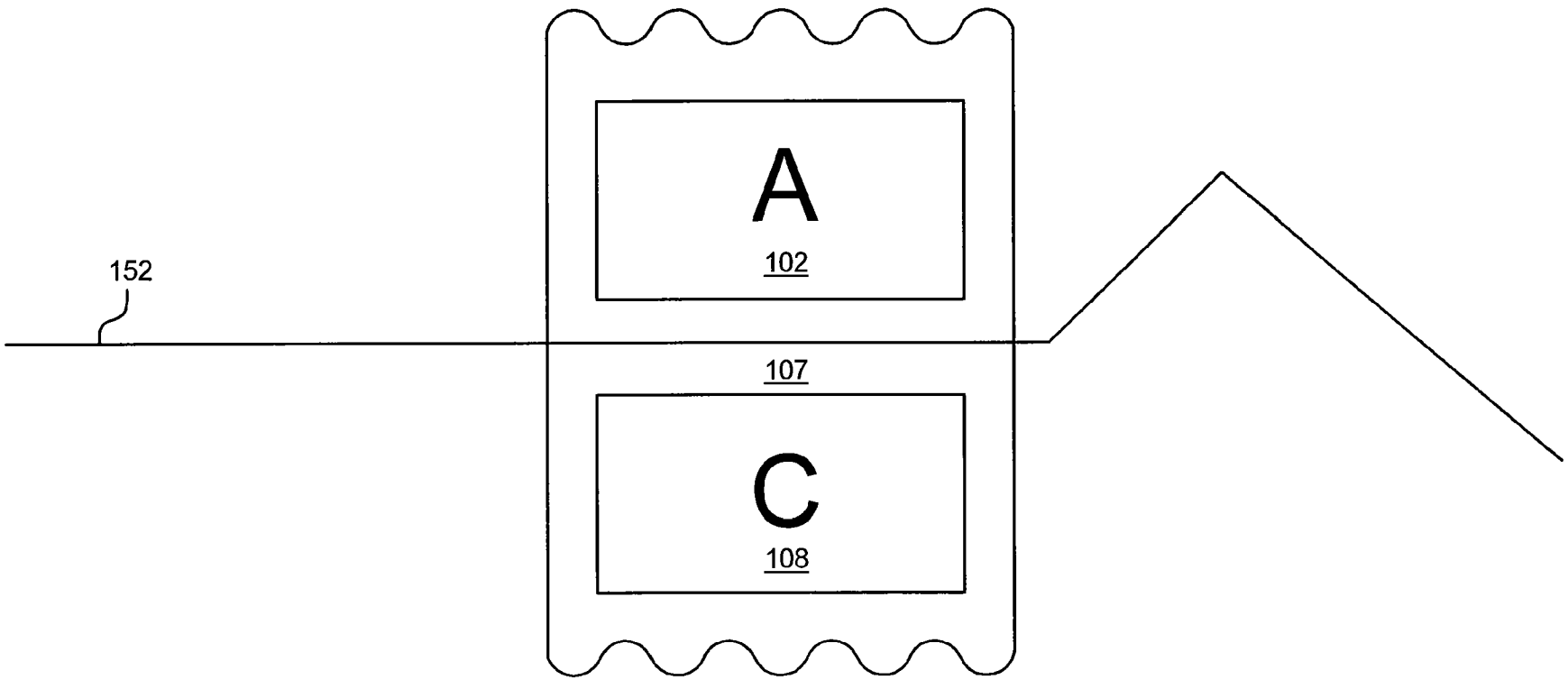
FIGS. 15A, 15B and 15C are front views of a portion of a display device of at least one embodiment disclosed herein illustrating an alternative transition of one or more paylines in relation to symbol display areas.
Figure 15B:
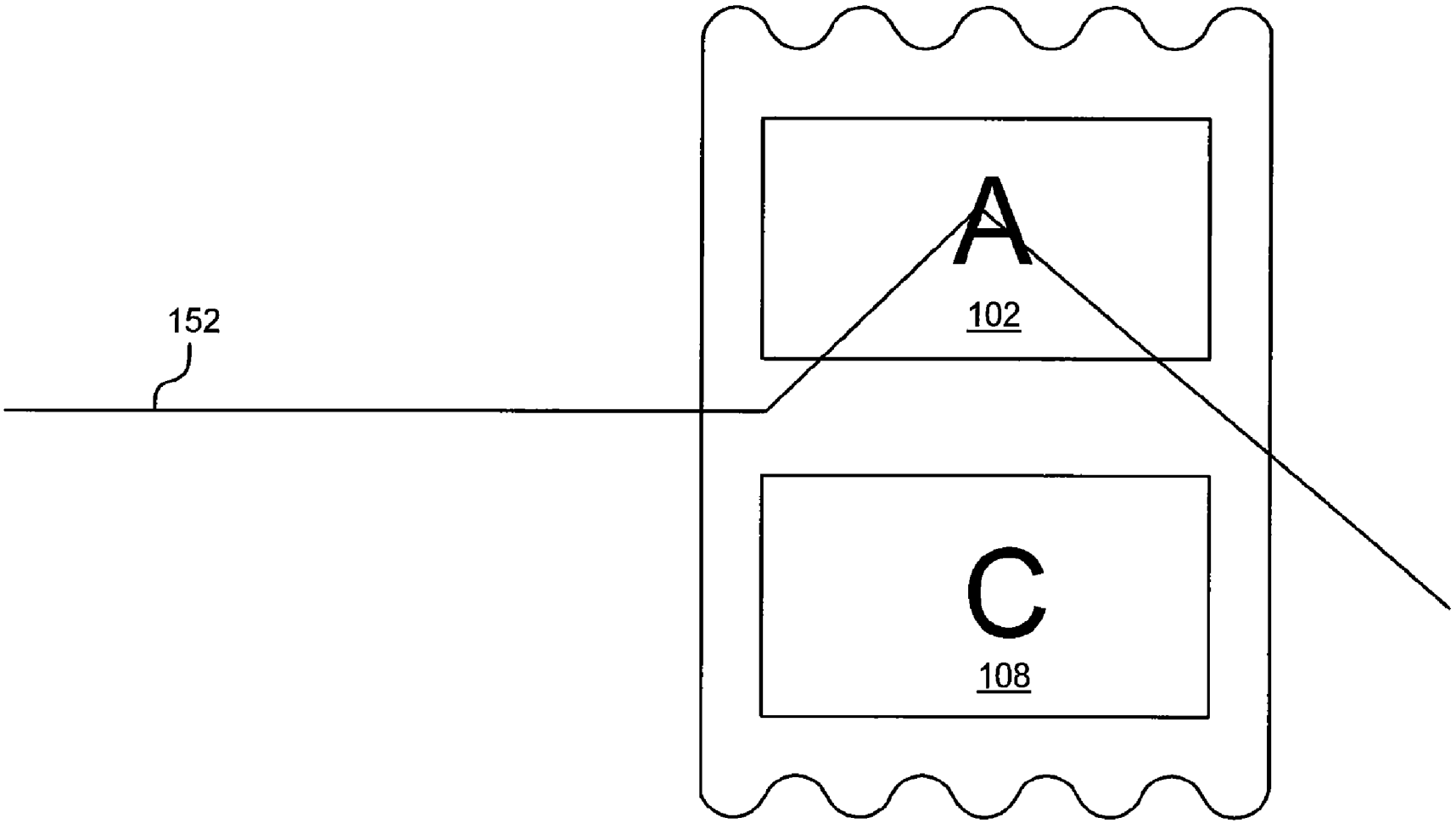
Figure 15C:
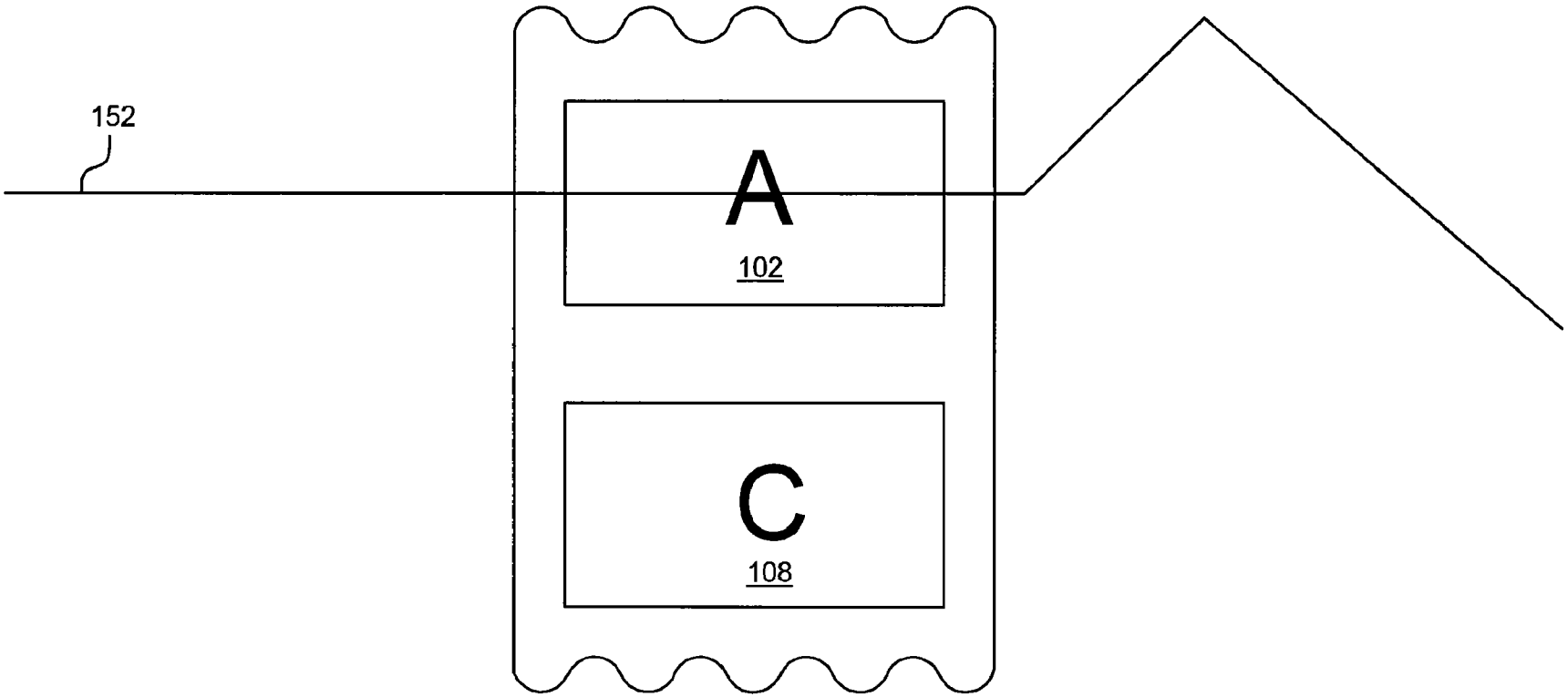

In an embodiment, a payline may be associated with symbol display areas as well as non-symbol display areas such as, for example, blanks between symbols on a reel. A transition from a first position to a second position may include a transition from a position where one or more paylines is associated with at least one non-symbol display area to a position where one or more paylines is associated with at least one symbol display area. FIGS. 15A and 15B illustrate two symbol display areas 102 and 108 such as symbol display areas 102 and 108 of the symbol display areas 120. A non-symbol display area 107 is situated between symbol display areas 102 and 108. As illustrated in FIG. 15A, payline 152 is associated with non-symbol display area 107 in a first position. Upon a substantially horizontal transition of the payline illustrated in FIG. 15B, the payline transitions from a first position indicating non-symbol display area 107 to a second position indicating the A symbol 120 displayed in symbol display area 102. Alternatively, payline 152 may transition in a substantially vertical manner from the first position, illustrated in FIG. 15A, to the second position, illustrated in FIG. 15C. It should be appreciated that the transition of the paylines from a non-symbol display area to a symbol display area may occur in any direction.

Figure 16:
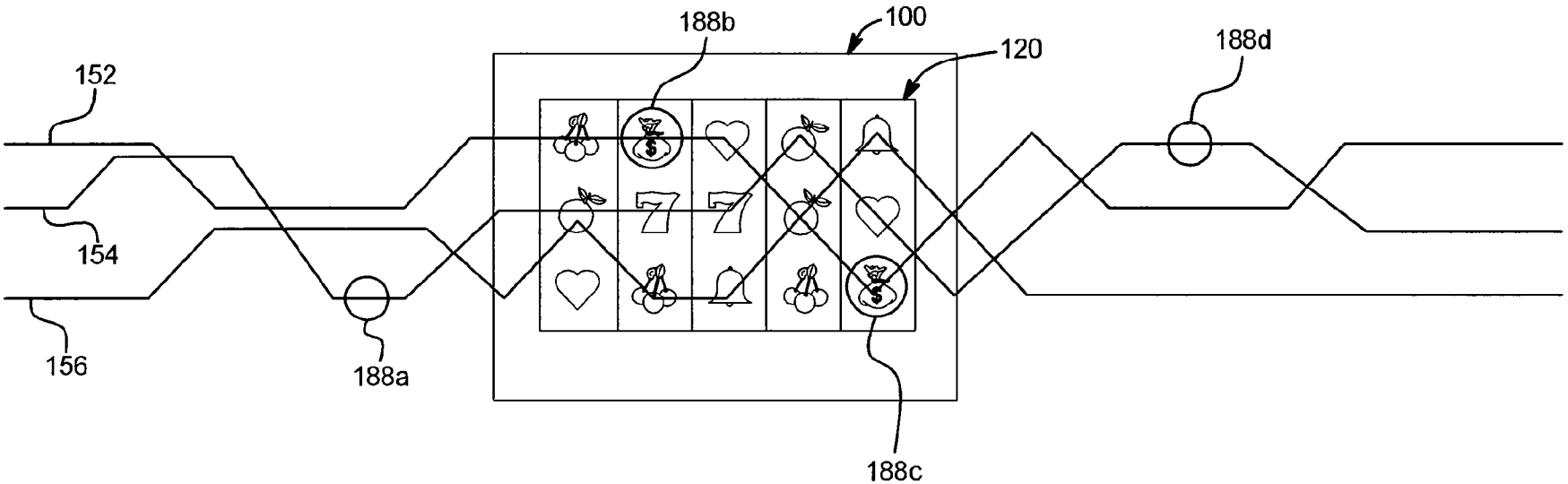
FIG. 16 is a view of paylines having payline symbols in association with a set of reels in an embodiment of the present disclosure.

In embodiments of the present disclosure, one or more indicators may be associated with a payline. A payline indicator may include any symbol, icon, letter, number, indicia or any other suitable indicator. A payline indicator may remain in a fixed position on the payline or, the payline indicator may transition to a different position along the payline in a random or predetermined manner with any number of transitions of the payline. As illustrated in FIG. 16, payline symbols 188 are distributed along paylines 152 and 154. In particular, payline symbols 188*a* and 188*d* are indicated along payline 154 but are not associated with the symbol display areas 120. The payline symbols may or may not be displayed in a position wherein the payline symbols are associated with the symbol display areas 120. Payline symbols 188*b* and 188*c* are indicated along payline 152 and are associated with the symbol display areas 120.

A payline indicator may be operable to perform at least one function, including indicating a stop position on a payline to determine the extent of a transition in relation to the symbol display areas as described above. In an example of an embodiment of the present disclosure, one or more payline symbols may be associated with a particular location along one or more of the paylines. The payline symbols may be displayed when, for example, the location of the payline is associated with at least one of the symbol display areas. In an embodiment, the payline symbol is not activated until the location of the payline symbol is associated with the symbol display areas. In the illustrated embodiment, the payline symbols are displayed when the payline symbol is associated with the symbol display areas. For example, as illustrated in FIG. 16, payline symbols 188*b* and 188*c* are each displayed as a "bag of money" when associated with the symbol display areas 120.

A payline indicator may be operable to affect or influence an outcome or operation of a game. Upon a transition of a payline that results in the association of a payline indicator with a symbol display area, a payline indicator may act as an independent outcome when associated with the symbol display areas. Additionally or alternatively, a payline indicator may act in combination with the symbol display areas, or the symbols displayed therein, to affect an outcome of the game. A payline indicator may include, for example, a special symbol that, when associated with a symbol display area, replaces the symbol displayed in the symbol display area. The payline symbol may be included in the evaluation of the symbols indicated by the payline. A payline indicator may act as a wild symbol replacing the symbol displayed in the associated symbol display area with any symbol for purposes of determining a winning outcome of symbols indicated by the payline. A payline indicator may include a symbol that entitles a player to an award if the payline indicator symbol matches the symbol displayed in the associated symbol display area. A payline indicator may cause a re-generation of symbols displayed in one or more symbol display areas, such as a re-spin of one or more reels associated with the symbol display areas. The payline symbol may act as a modifier to any outcome associated with any winning symbol or combination of symbols indicated by the payline including the payline symbol. The bag of money" symbol illustrated in FIG. 14, for example, may be a wild symbol. A multiplier may be associated with the "bag of money" symbol and applied to any award associated with a winning symbol or combination of symbols indicated by payline 152. Accordingly, it should be appreciated that a payline indicator may perform any suitable function affecting the operation or outcome of a game.

Figure 17A:
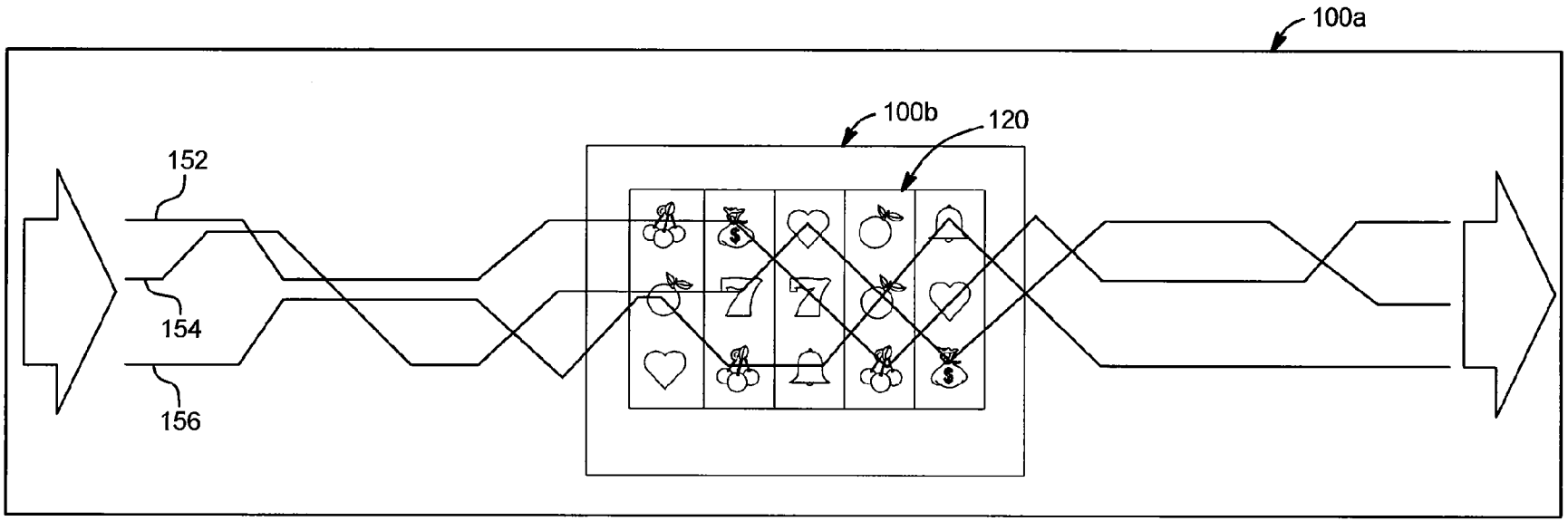
FIGS. 17A and 17B are front views of a display device of at least one embodiment disclosed herein illustrating a display of movement of one or more paylines in relation to symbol display areas.
Figure 17B:
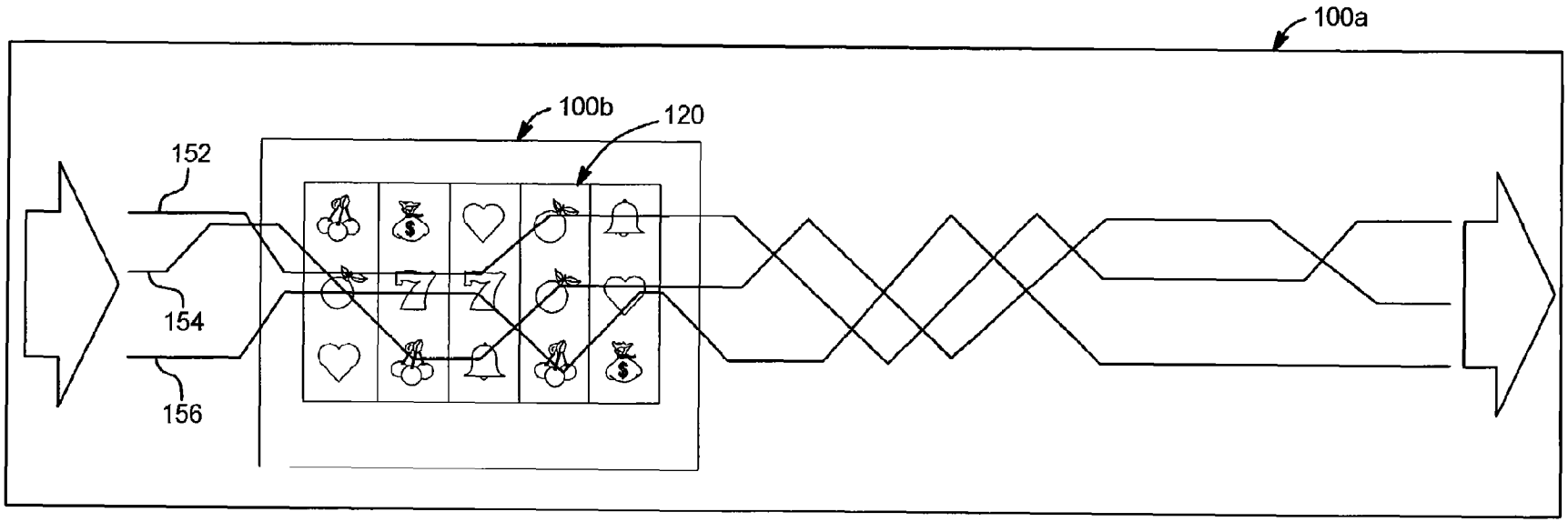
Figure 18A:
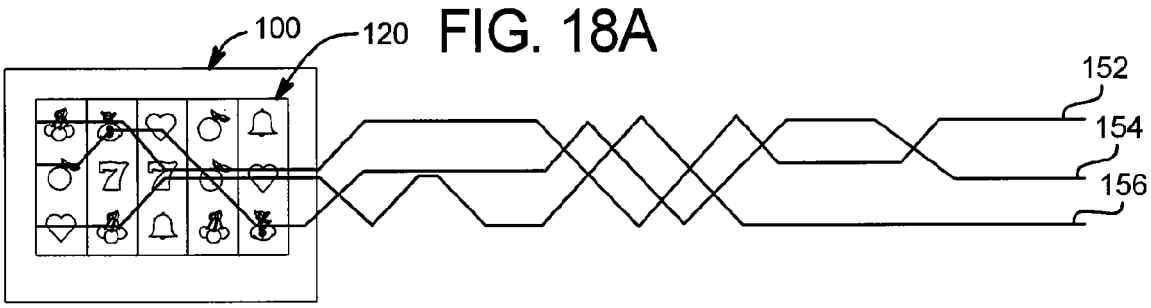
FIGS. 18A, 18B, 18C, 18C, 18D and 18E are front views of a display device of at least one embodiment disclosed herein illustrating a sequential display of movement of symbol display areas in relation to paylines.
Figure 18B:
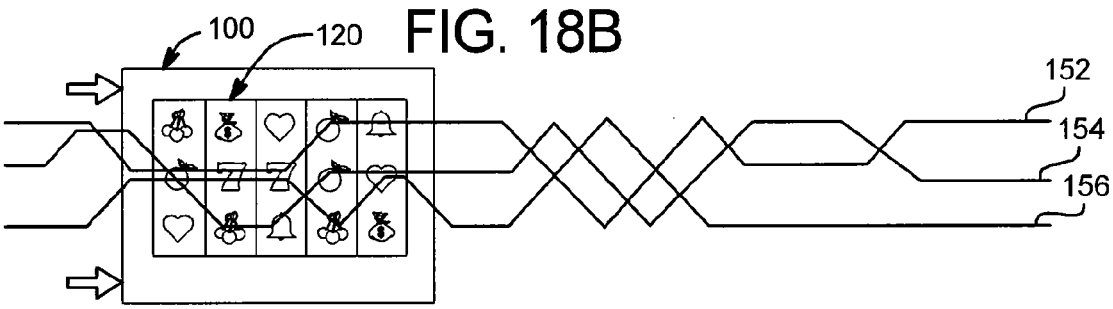
Figure 18C:
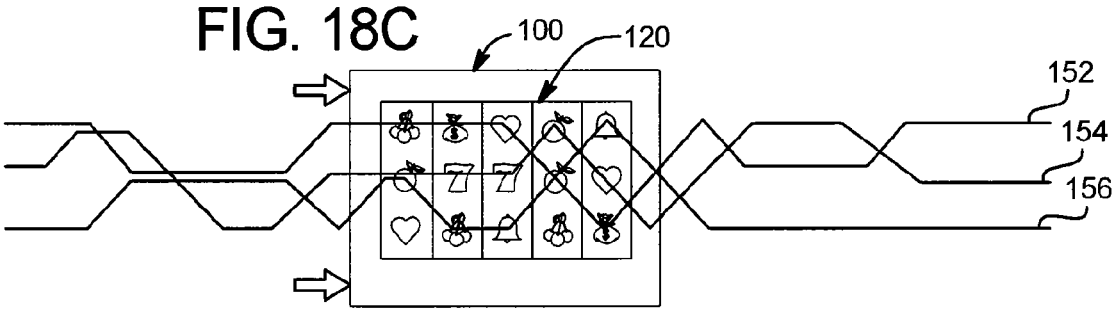
Figure 18D:
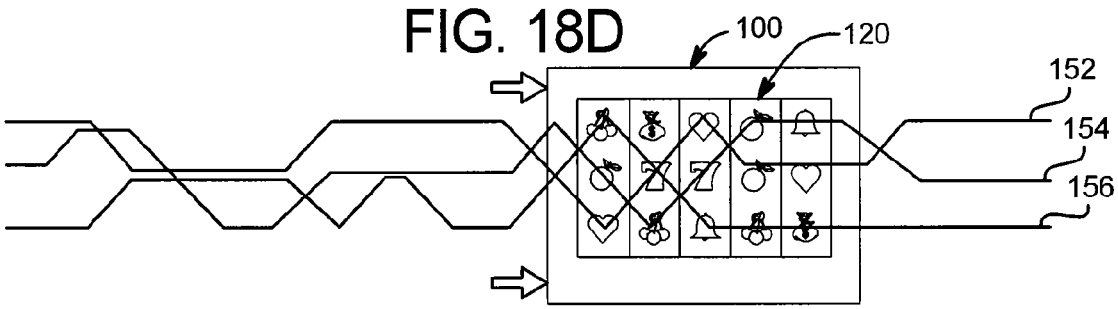
Figure 18E:
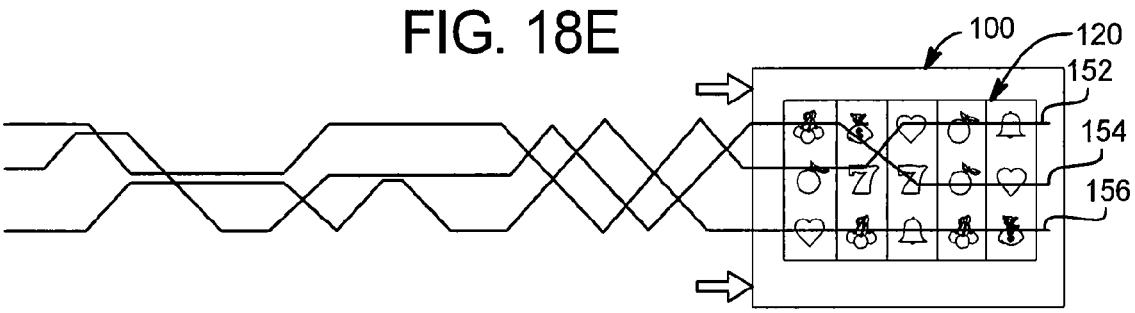

In any of the previously described embodiments, the transition of a payline may be displayed as a movement through any suitable distance or interval along the payline. The paylines may be displayed as moving individually or as a group from a first position to at least a second position. Paylines may appear to cross one another in a scrambling or random fashion. In addition, or alternatively, paylines may appear to move collectively in a group maintaining a predetermined distance from one another. The display of movement from a first position to a second position may occur in a linear or non-linear fashion and in any suitable direction, such as vertically, horizontally, diagonally, into or out of a plane in three-dimensional space and combinations thereof. For example, as illustrated in FIGS. 17A and 17B, the transition of paylines 152, 154, and 156 from a first position, illustrated in FIG. 17A, to a second position, illustrated in FIG. 17B, may be displayed to appear as if the payline moves in a left-to-right direction along a substantially horizontal axis across the symbol display areas of the display 100*a*. The movement of the one or more paylines may continue until each encounters a stop position as described above.

In certain embodiments, a transition may include a display of a movement of symbol display areas in relation to paylines that appear to remain in a fixed position. The transition of the symbol display areas from a first position to a second position may be through one or more paylines or portions thereof. For example, FIGS. 18A, 18B, 18C, 18D and 18E illustrate sequential movement of a set of symbol display areas 120 along paylines 152, 154 and 156. It should be understood that the movement may occur through any suitable distance or interval.

In addition or alternatively, the transition may include movement of both paylines and symbol display areas in relation to one another. The paylines or symbol display areas may or may not remain in a fixed position through the complete duration of the transition. The movement of the paylines may be simultaneous with, or may alternate with, the movement of the symbol display areas. The movement of the paylines and symbol display areas may be continuous or discontinuous.

The displayed movement may include the display of a continuous or discontinuous or incremental movement or scrolling or shift of the payline, or a combination of continuous and discontinuous movement of the payline, from the first position to the second position. The movement of the paylines may occur as one or more incremental movements from the first position to the second position. Alternatively, the movement may occur as a smooth or continuous movement from a first position to a second position and subsequent positions. In an embodiment, the paylines are displayed as moving in a scrolling or rotating fashion before, during or after the generation of symbols in the symbol display areas of the display, such as before, during or after spinning of reels.

In addition or alternatively, the paylines may move, shift, rotate, scroll, etc. as generated symbols are displayed in the symbol display areas of the display, such as during the spinning of reels. In such embodiments, paylines may move at different speeds and/or for different durations in relation to the spinning reels. For example, the reels may stop to display a plurality of symbols in the symbol display areas while the paylines continue to move. In certain embodiments, the one or more, or each of the paylines may stop moving based on one or more random determinations In other embodiments, the gaming device may include one or more inputs, such as apparent skill stop inputs, to enable the player to control when at least one of the paylines and/or reels stop in relation to one another. For example, as described above, an embodiment may include stopping the reels to display a plurality of symbols in the symbol display areas while the paylines continue to move. In such an embodiment, the gaming device may include apparent skill stop inputs to provide the player a perception of control of when the paylines stop in relation to the displayed symbols. It should be appreciated that the player may attempt to determine when to stop a moving payline such that the payline indicates a winning symbol or combination of symbols. Probabilities that a player-controlled stop of one or more moving paylines will indicate a winning symbol or combination of symbols may be based on the number of winning symbols displayed in the symbol display areas, the speed of the movement of the paylines, the predictability of a group of moving paylines to be displayed, such as how other paylines of a particular configuration are displayed, or any other suitable game parameter that affects the probability of achieving a winning stop of the paylines.

Figure 19A:
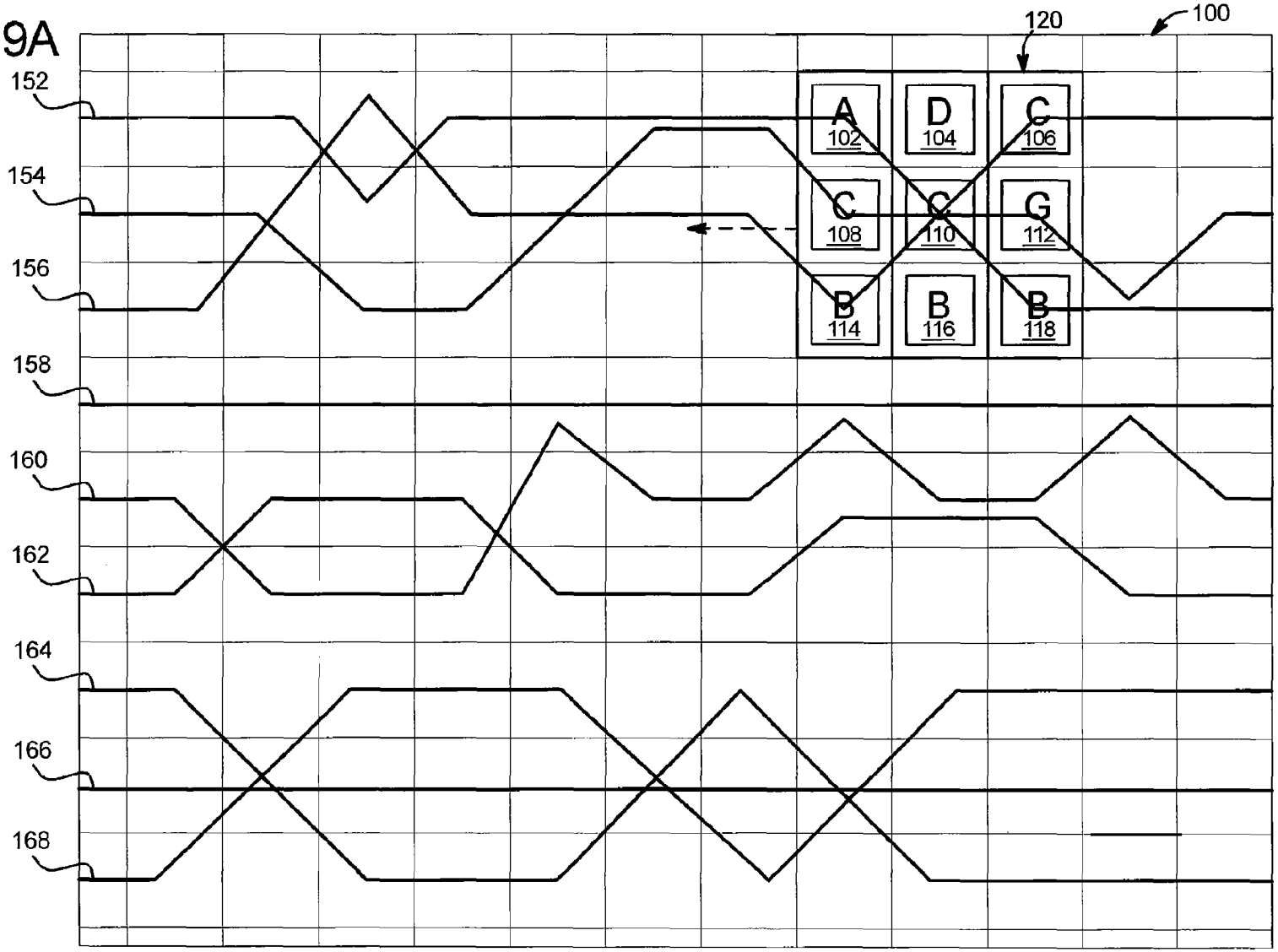
FIGS. 19A, 19B, 19C and 19D are front views of a display device of at least one embodiment disclosed herein illustrating an alternative transition of one or more paylines in relation to symbol display areas.

Referring to FIGS. 19A, 19B, 19C and 19D, any of the features of the embodiments described above may be combined in an embodiment including a display of an array of paylines. At least one payline may be configured to project in one or more different directions than other paylines such that at least one of the paylines is associated with a different symbol display area upon a transition of the payline. For example, as illustrated in FIG. 19A, an array of nine paylines 152, 154, 156, 158, 160, 162, 164, 166 and 168 are arranged on display 100. A grid corresponding to the symbol display areas is included in FIGS. 19A, 19B, 19C and 19D for ease of illustration of the transition of symbol display areas in relation to paylines, transition of paylines in relation to the symbol display areas, or both. It should be appreciated that the grid may or may not be displayed. It should be further appreciated that the display of paylines and symbol display areas, along with their transitions from one position to another, may or may not occur in relation to a grid, in whole or in part. As such, a grid may or may not exist.

A group of symbol display areas, such as a three-by-three matrix of reels, may be associated with one or more of the paylines. As illustrated in FIG. 19A, symbol display areas 120 are associated with paylines 152, 154 and 156. Payline 152 is associated with symbol display areas 102, 110 and 118. Payline 154 is associated with symbol display areas 108, 110 and 112. Payline 156 is associated with symbol display areas 114, 110, and 106. This arrangement of paylines in relation to the symbol display areas may be considered a first position of the paylines 152, 154 and 156. Symbols displayed in the combination of symbol display areas indicated by each of the paylines in the subsequent position may be evaluated for potential winning symbols and combinations of symbols as described above.

Figure 19B:
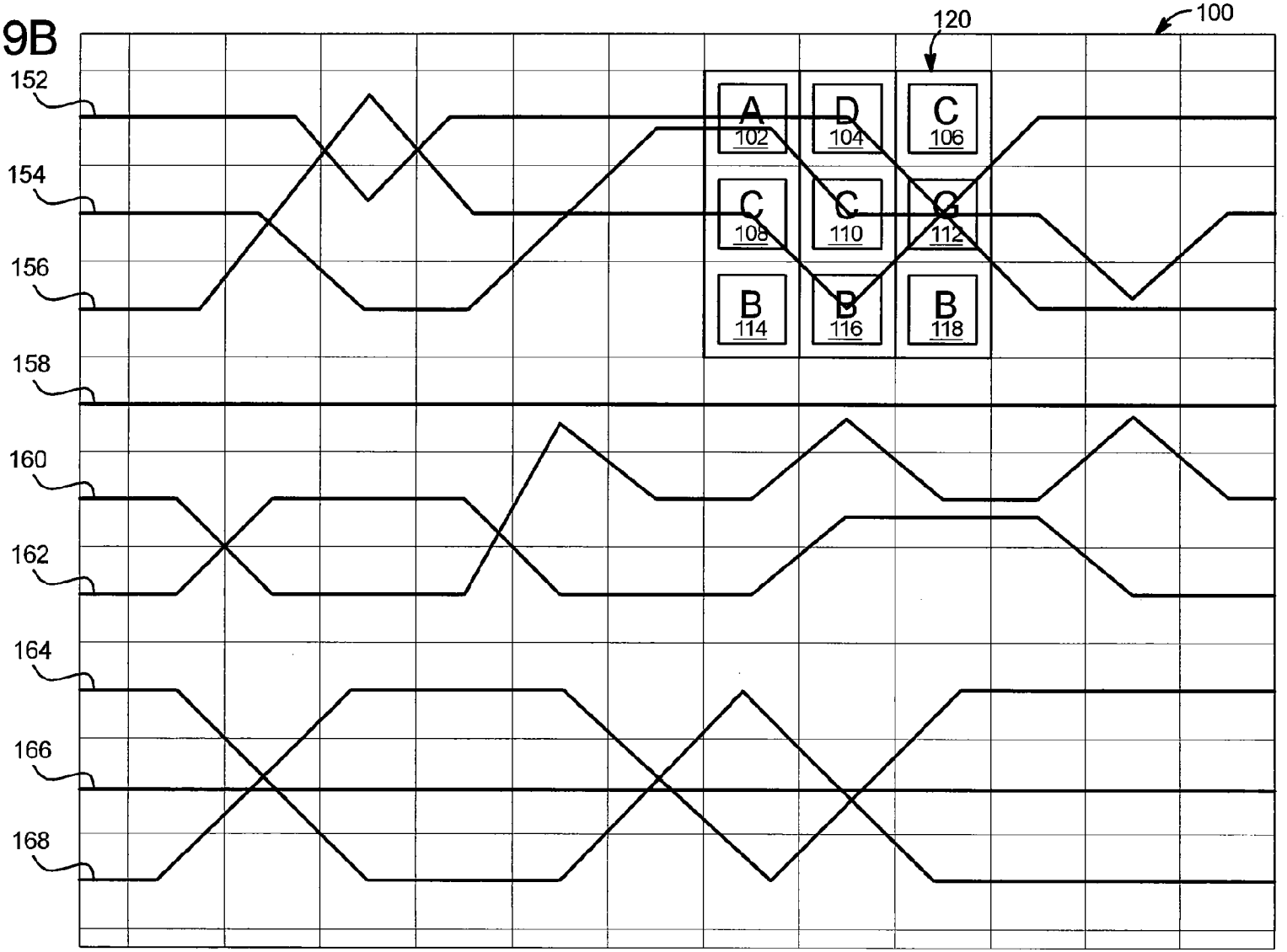

The display of paylines may be fixed on the display. The transition of paylines in relation to symbol display areas may appear to occur by a transition of the symbol display areas in relation to paylines which remain in a fixed position. A transition of symbol display areas to different positions may include transitions to one or more positions along the same or different paylines. FIGS. 19A and 19B display a transition of the symbol display areas along the same paylines 152, 154 and 156. In particular, symbol display areas transition in a substantially horizontal direction to a second position one column on the grid to the left along paylines 152, 154 and 156. In the second position of the symbol display areas, payline 152 is associated with symbol display areas 102, 104 and 112; payline 154 is associated with symbol display areas 102, 110 and 112; and payline 156 is associated with symbol display areas 108, 116, and 112. It should be appreciated that a transition of the symbol display areas from a first position to a second position may occur through any number of rows or columns of the grid. It should also be appreciated that the extent of the transition may be the same or may vary for each transition.

Figure 19C:
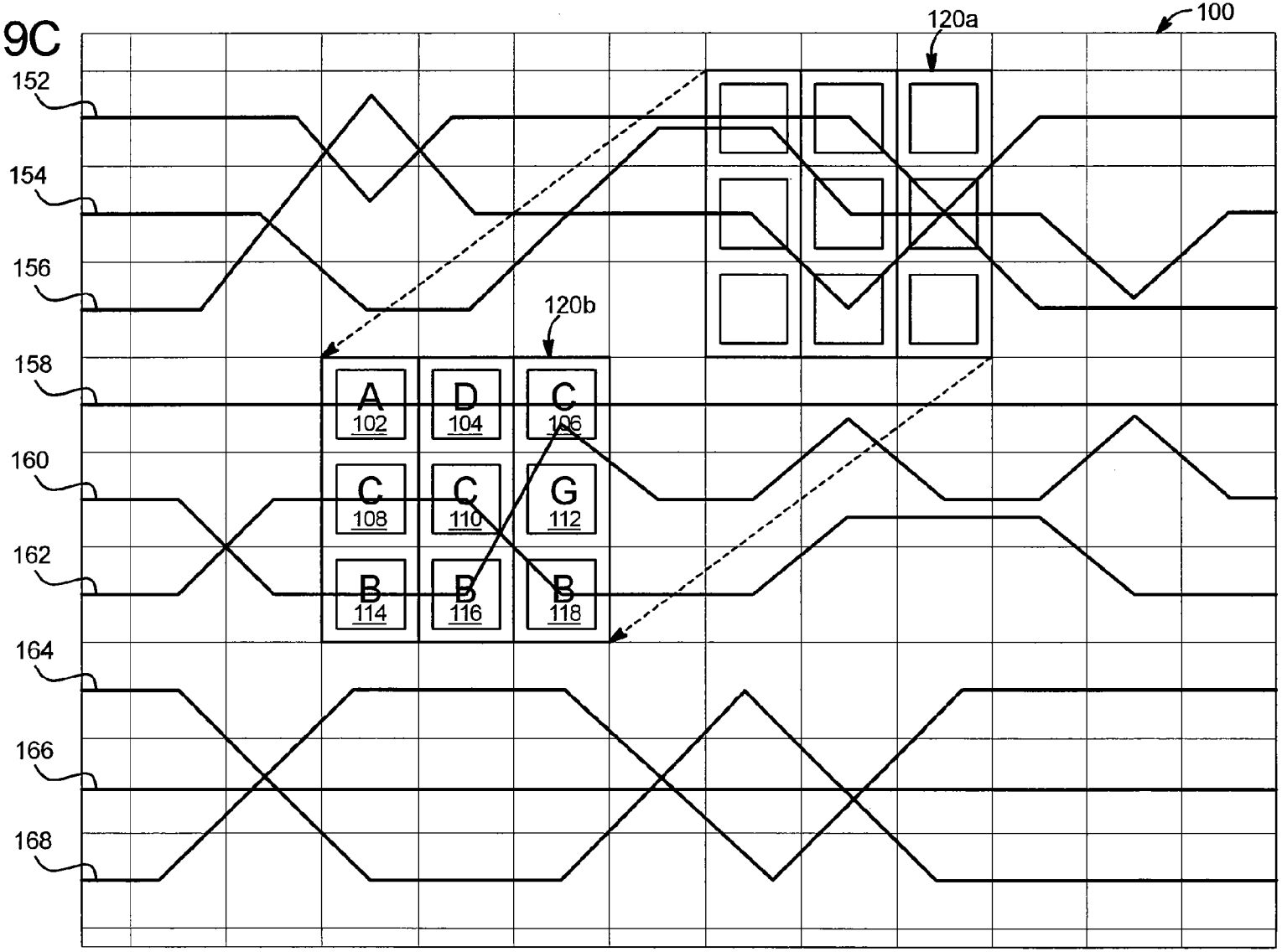

Transition from one position to another position may include a transition to a position where the symbol display areas are associated with different paylines. FIG. 19C illustrates a transition of symbol display areas 120 to a second position on the array of paylines. A set of broken lines is used to indicate movement between the symbol display areas in a first position and the same symbol display areas in a second position. FIG. 19C may also be displayed as a transition of paylines 152, 154, 156, 158, 160, 162, 164, 166 to another position in relation to symbol display areas 120. As a result of the transition to a second position, regardless of whether the transition appears to occur by a transition of paylines in relation to symbol display areas or a transition of symbol display areas in relation to paylines, or both, at least one payline is associated with a different symbol display area. Payline 158 is associated with symbol display areas 102, 104 and 106. Payline 160 is associated with symbol display areas 114, 116, and 106. Payline 162 is associated with symbol display areas 108, 110 and 118. Paylines 152, 154 and 156 are no longer associated with the symbol display areas. Symbols displayed in the combination of symbol display areas indicated by each of the paylines in the subsequent position may be evaluated for potential winning symbols and combinations of symbols as described above.

Figure 19D:
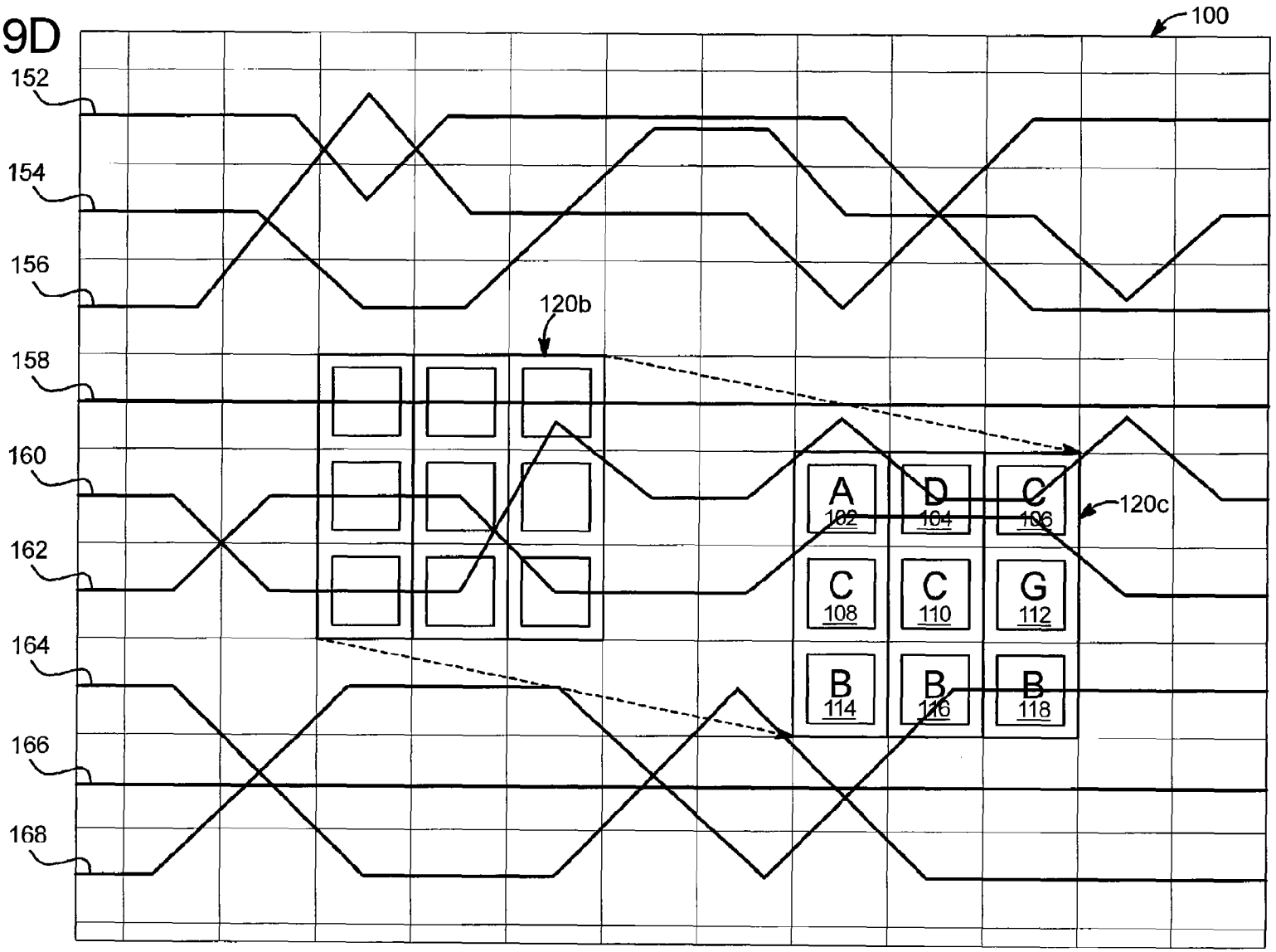

In an embodiment, the gaming device is enabled to perform a subsequent transition to yet another position based on an event in the game such as an additional or sufficient initial wager by a player. FIG. 19D illustrates a transition of symbol display areas 120 to a third position on the array of paylines including paylines associated with symbol display areas in the second position illustrated in FIG. 19C.

It should be appreciated that in various embodiments, the paylines may or may not transition to a position in relation to the symbol display areas such that each payline is associated with the same number of symbol display areas. In an embodiment, a payline transition includes a transition to a position wherein the paylines may be associated with a different number of symbol display areas. Symbol display areas may not be associated with a payline. Paylines may not be associated with symbol display areas. As illustrated in FIG. 19D, paylines 160, 162 and 164 are associated with symbol display areas 120. Payline 162 is associated with three symbol display areas, symbol display areas 102, 104 and 106, and paylines 160 and 164 are associated with two symbol display areas. Payline 160 is associated with symbol display areas 104 and 106. Payline 164 is associated with symbol display areas 116 and 118. Again, symbols displayed in the combination of symbol positions indicated by each of the paylines may be evaluated as potential winning symbols or combinations of symbols.

Figure 20A:
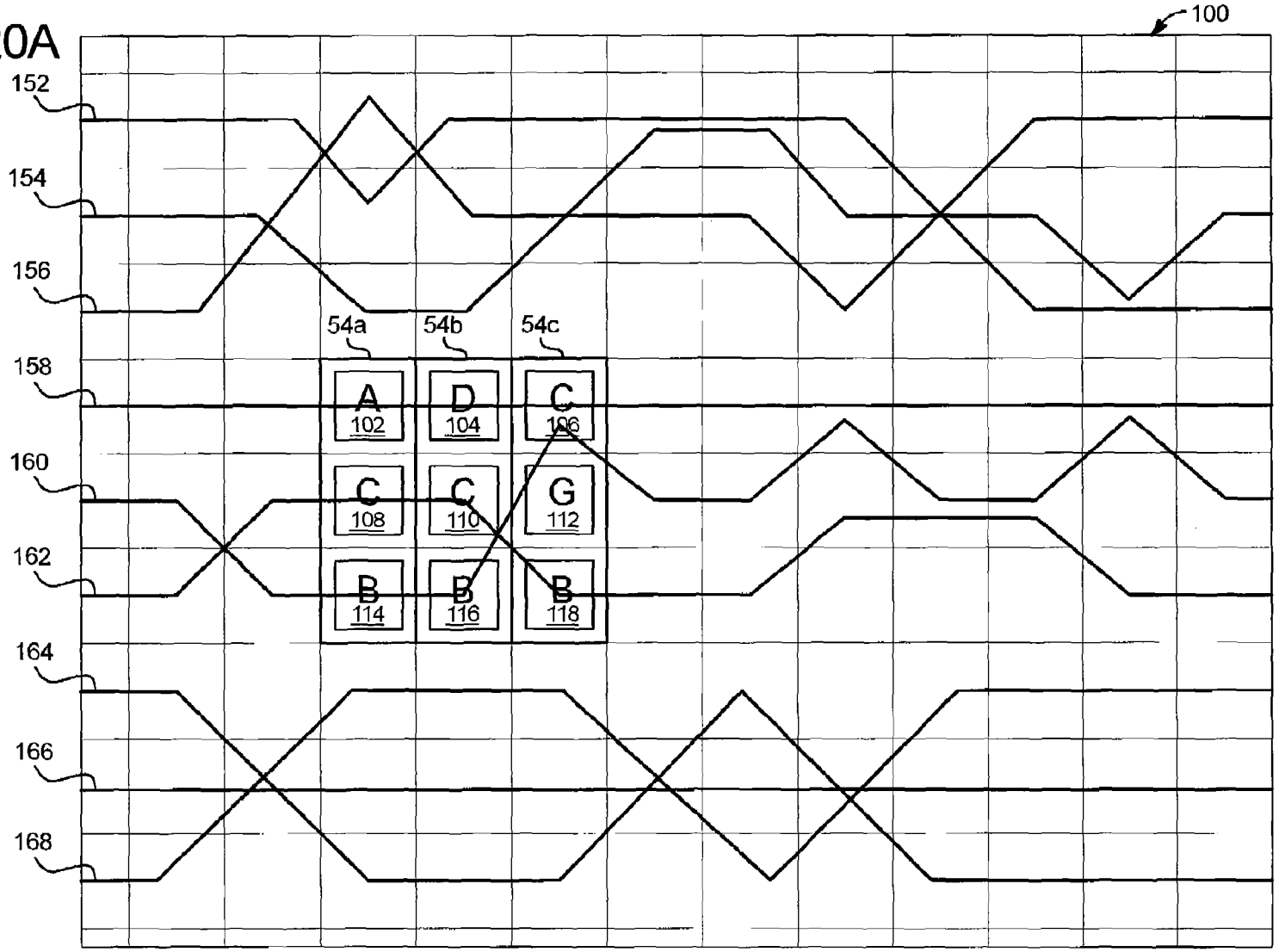
FIGS. 20A, 20B, 20C and 20D are front views of a display device of at least one embodiment disclosed herein illustrating an alternative transition of one or more paylines in relation to symbol display areas.

Referring to FIGS. 20A, 20B, 20C and 20D, the set of symbol display areas may transition from one position to another position as a group, a sub-group, or individually. In an embodiment, at least one reel can move independently of at least one other reel in relation to the paylines. As illustrated in FIG. 20A, three reels 54*a*, 54*b* and 54*c* are displayed adjacent to one another in a conventional manner. Payline 158 is associated with symbol display areas 102, 104 and 106 on reels 54*a*, 54*b* and 54*c*, respectively. Payline 160 is associated with symbol display areas 108, 110 and 118 on reels 54*a*, 54*b* and 54*c*, respectively. Payline 162 is associated with symbol display areas 114, 116 and 106 on reels 54*a*, 54*b* and 54*c*, respectively.

Figure 20B:
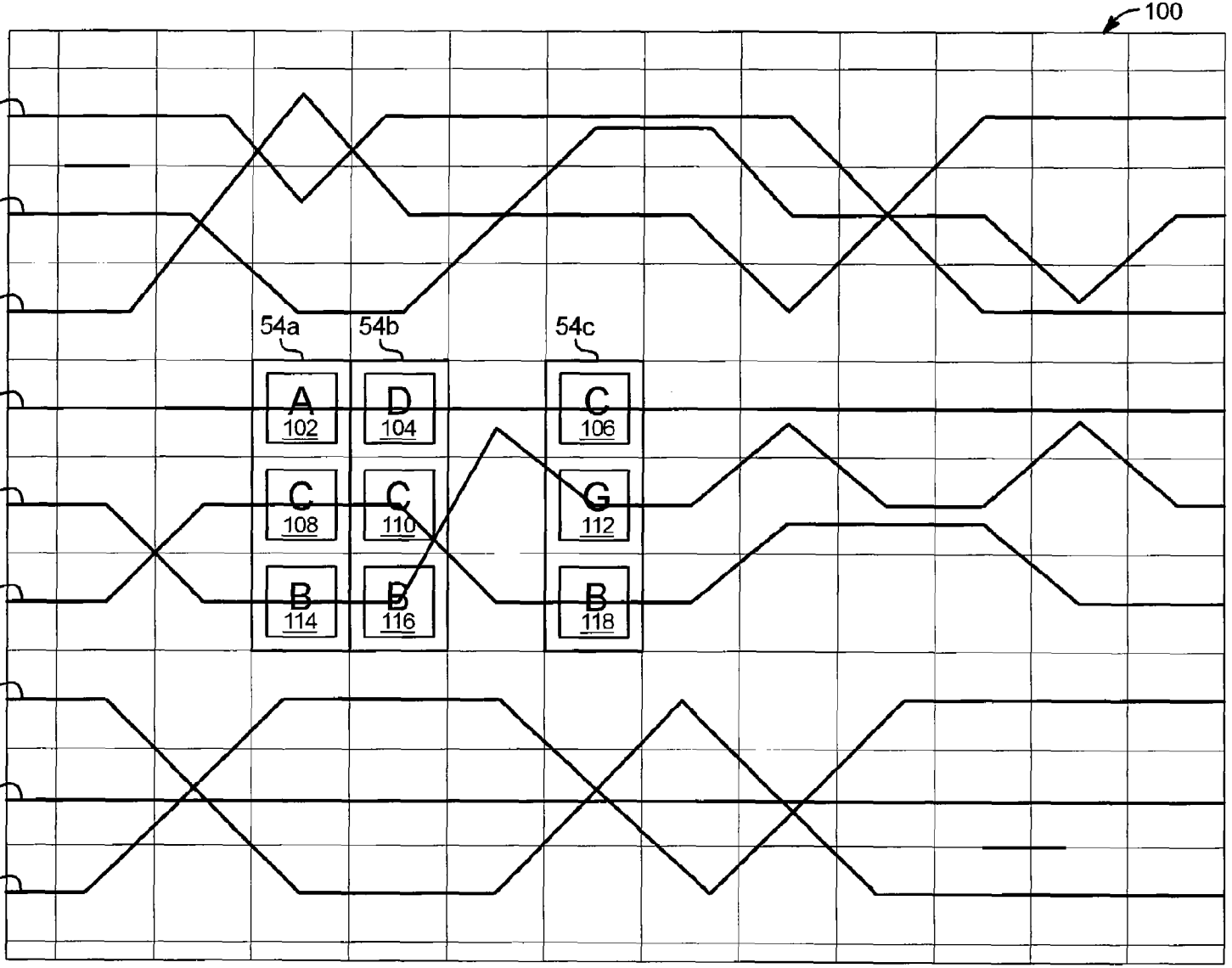
Figure 20C:
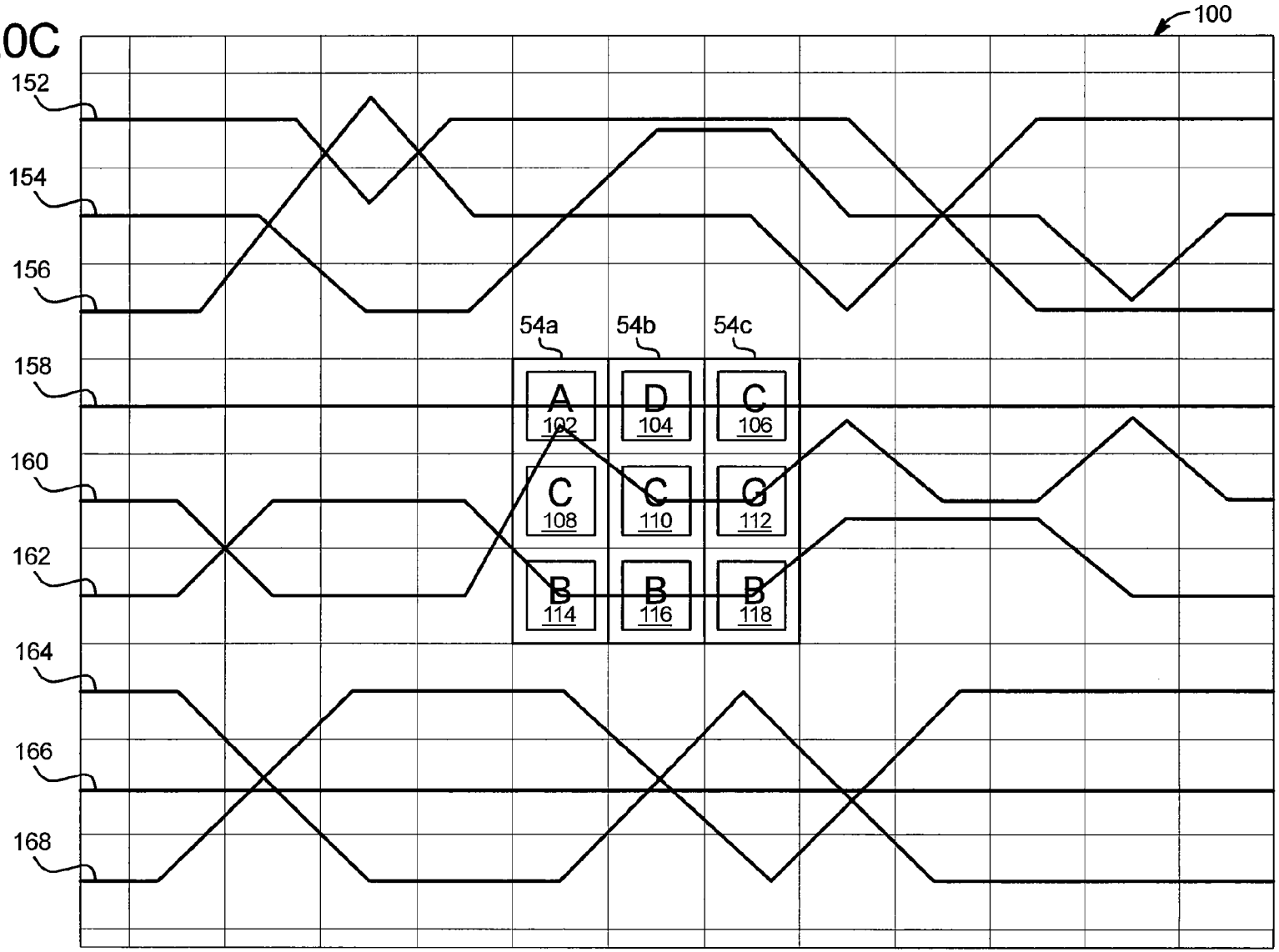
Figure 20D:
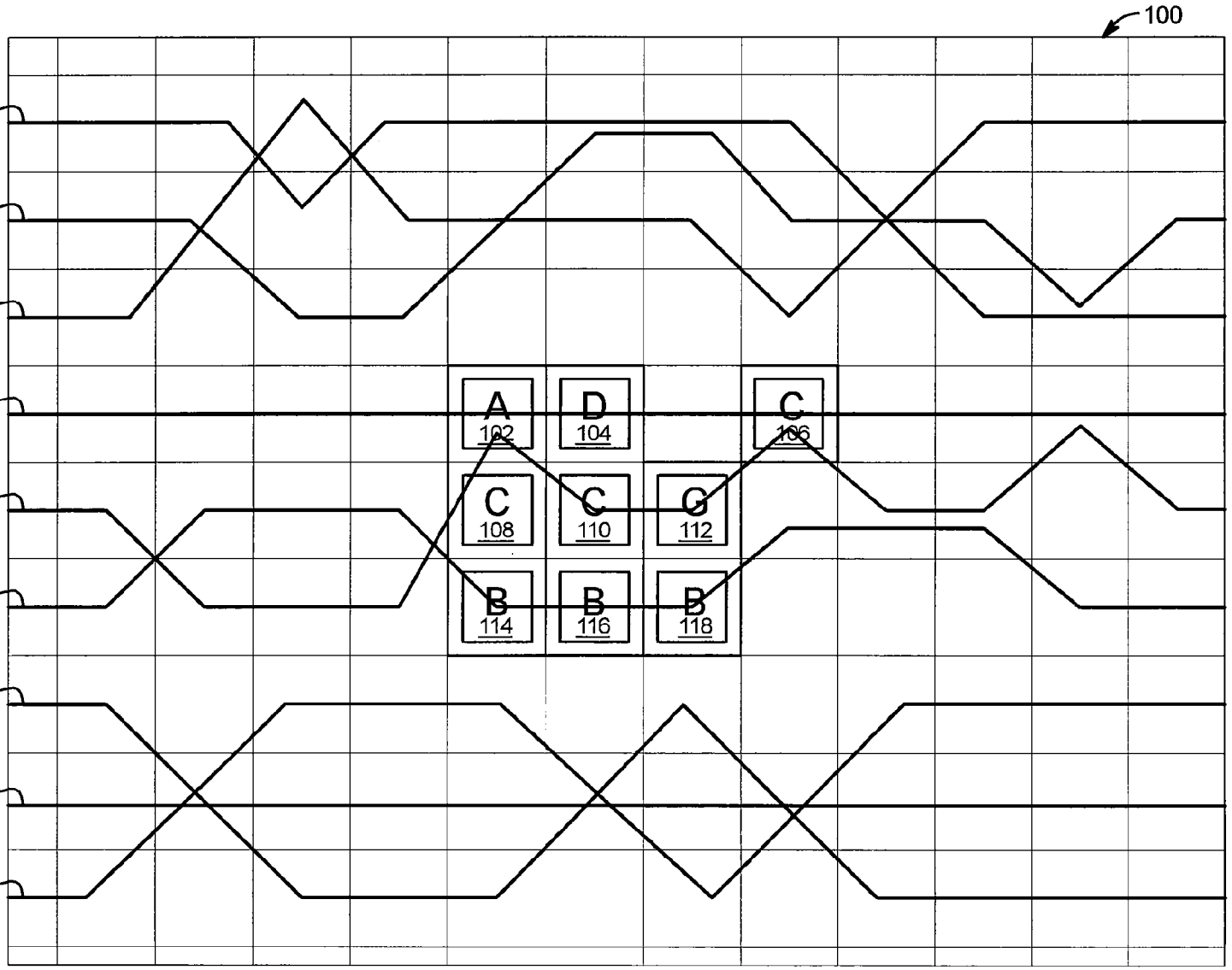

Upon a transition of reel 54*c* to an alternative position, as illustrated in FIG. 20B, a change in the combination of symbol display areas indicated by payline 162 occurs. In particular, payline 162 is associated with symbol display areas 114, 116 and 112 on reels 54*a*, 54*b* and 54*c*, respectively. The gaming device may perform an evaluation of the symbols displayed by the different combination of symbol display areas indicated by payline 162. As illustrated in FIG. 20C, two or more reels, such as reels 54*a* and 54*b*, may transition as a group to an alternative position In an embodiment, one or more symbol display areas may be associated with independent reels such that the symbol display areas are capable of being individually or independently displayed immediately adjacent to, or separate from, other symbol display areas. As illustrated in FIGS. 20C and 20D, symbol display areas 102, 104, 106, 108, 110, 112, 114, 116 and 118 are displayed adjacent to one another in a conventional manner. Payline 158 is associated with symbol display areas 102, 104 and 106; payline 160 is associated with symbol display areas 102, 110 and 112; and payline 162 is associated with symbol display areas 114, 116 and 118. Upon a transition to an alternative position of symbol display area 106 or an independent reel with symbol display area 106, as illustrated in FIG. 20C, at least one different symbol display area is indicated by payline 160. In particular, payline 160 is associated with symbol display areas 102, 110 and 112 and 106. The gaming device may perform an evaluation of the symbols displayed by the different combination of symbol display areas indicated by payline 160.

As illustrated in FIG. 20D, paylines may be associated with different numbers of symbol display areas. Accordingly, a payline may indicate more or less than the minimum number of symbols necessary for a winning combination. For example, paylines 158 and 162 are each associated with three symbol display areas. In contrast, payline 160 is associated with more than three symbol display areas. If a winning combination in the exemplary game includes less than four symbols, it should be appreciated that a transition that enables a payline to be associated with four symbol display areas, such as payline 160 illustrated in FIG. 20B, may increase the probability of indicating that winning combination in such an embodiment.

In an embodiment, more than one set of symbol display areas may be displayed on an array of paylines. The sets of symbol display areas may display symbols generated for each symbol display area of each of the sets of symbol display areas. Alternatively, the symbols displayed by at least one of the sets of symbol display areas may be duplicated into at least one other set of symbol display areas. In addition to wagering on paylines, payline shifts and other wagering opportunities described above, the gaming device may enable a player to wager on multiple sets of symbol display areas and shifts of those sets of symbol display areas.

Figure 21A:
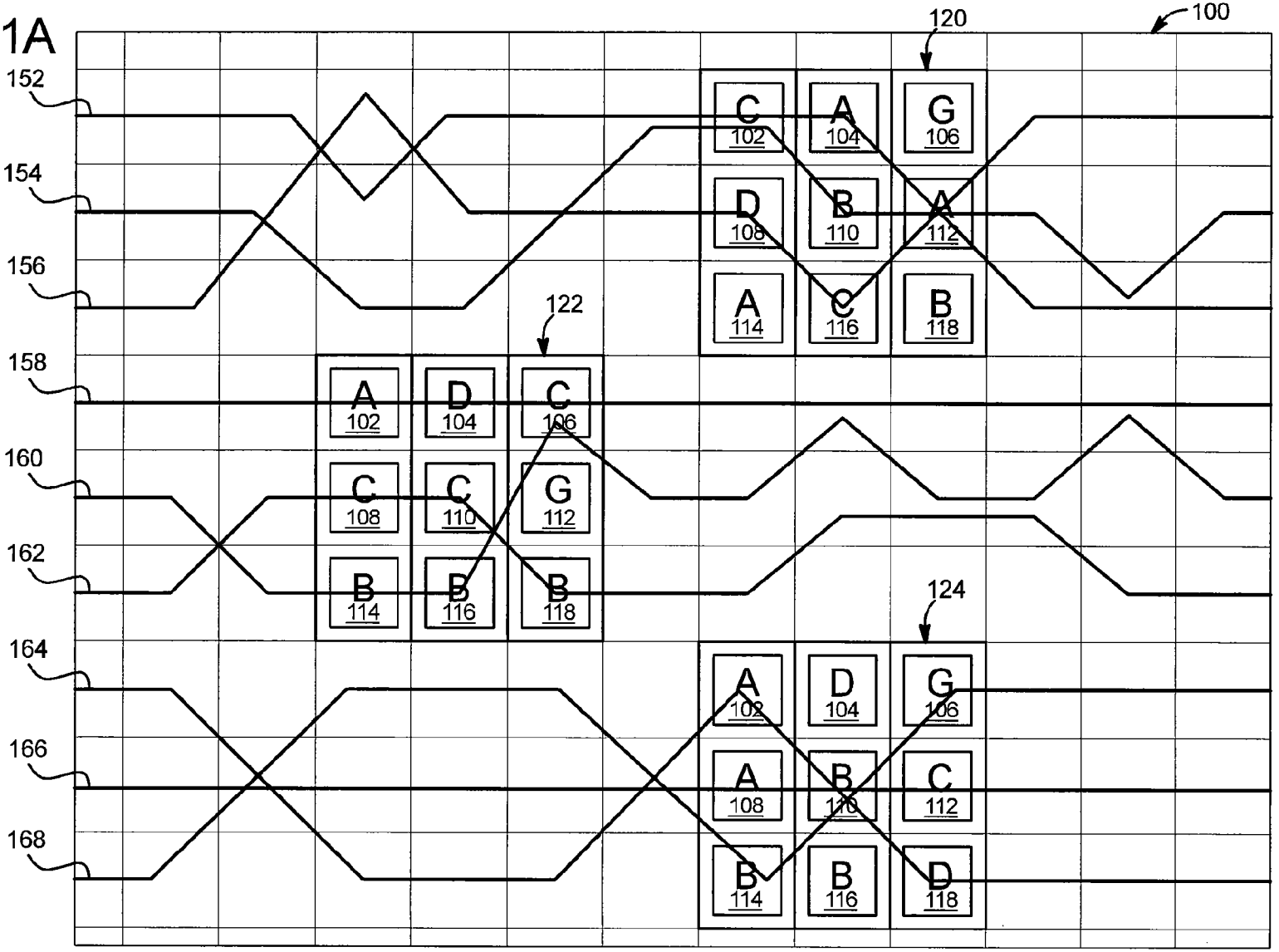
FIGS. 21A, 21B, 21C and 21D are front views of a display device of at least one embodiment disclosed herein illustrating an alternative transition of one or more paylines in relation to symbol display areas.
Figure 21B:
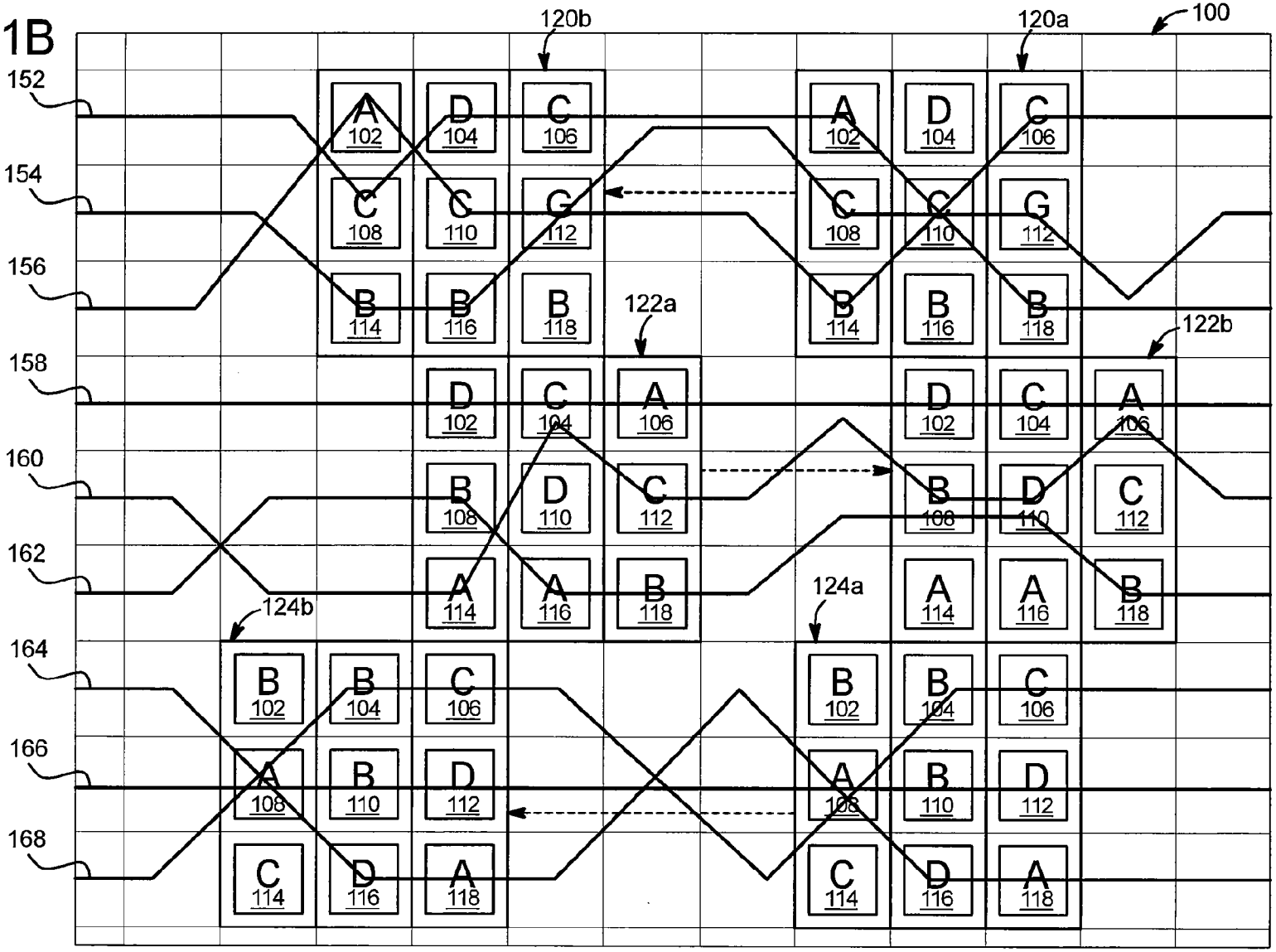

Referring to FIGS. 21A, 21B, 21C, 21D and 21E, in embodiments, of the present disclosure the gaming device may perform a transition of one or more of the symbol display areas based on an event in a game such as a wager by a player. At least one set of symbol display areas may transition from one position to another position in relation to the paylines, or at least one of the paylines may transition from one position to another position in relation to the symbol display areas. In an embodiment, multiple sets of symbol display areas may transition in relation to the paylines in at least one direction, along the same or different paylines, or combinations thereof. As illustrated in FIG. 21A, in at least a first position, a first set of symbol display areas 120 is associated with paylines 152, 154 and 156; a second set of symbol display areas 122 is associated with paylines 158, 160 and 162; and a third set of symbol display areas 124 is associated with paylines 164, 166 and 168.

Each set of symbol display areas may transition from one position to another position along the same paylines, respectively. For example, as indicated by the broken arrow in FIG. 21B, symbol display areas 120 may be displayed as moving in a direction along paylines 152, 154 and 156; symbol display areas 122 may be displayed as moving in a direction along paylines 158, 160 and 162; and symbol display areas 124 may be displayed as moving in a direction along paylines 164, 166 and 168. The symbol display areas may move in any suitable direction along the paylines and may move in the same or different directions as other symbol display areas. For example, symbol display areas 122 in FIG. 21B transition in a different direction along the paylines as the first and third sets of symbol display areas 120 and 124, respectively.

Figure 21C:
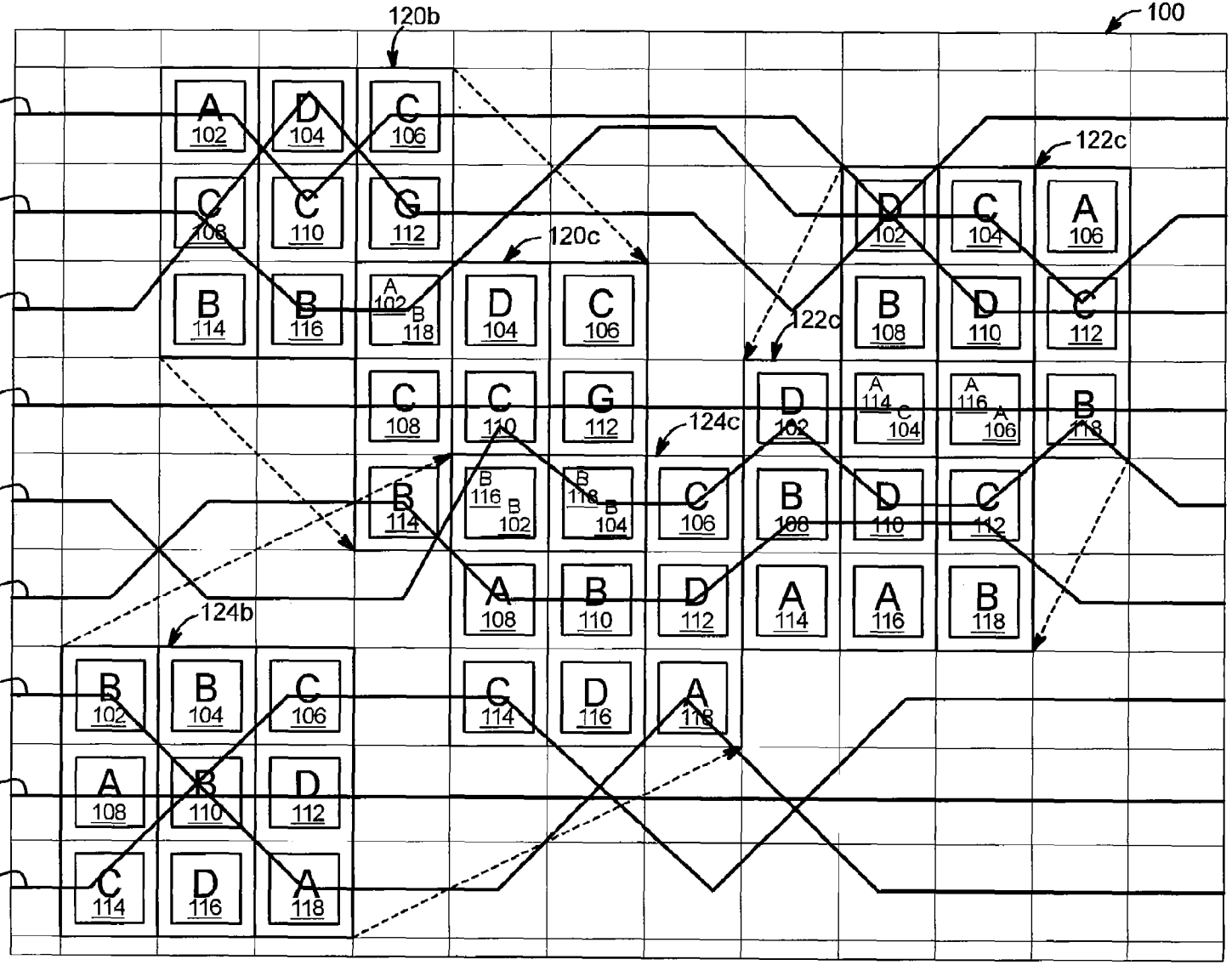
Figure 21D:
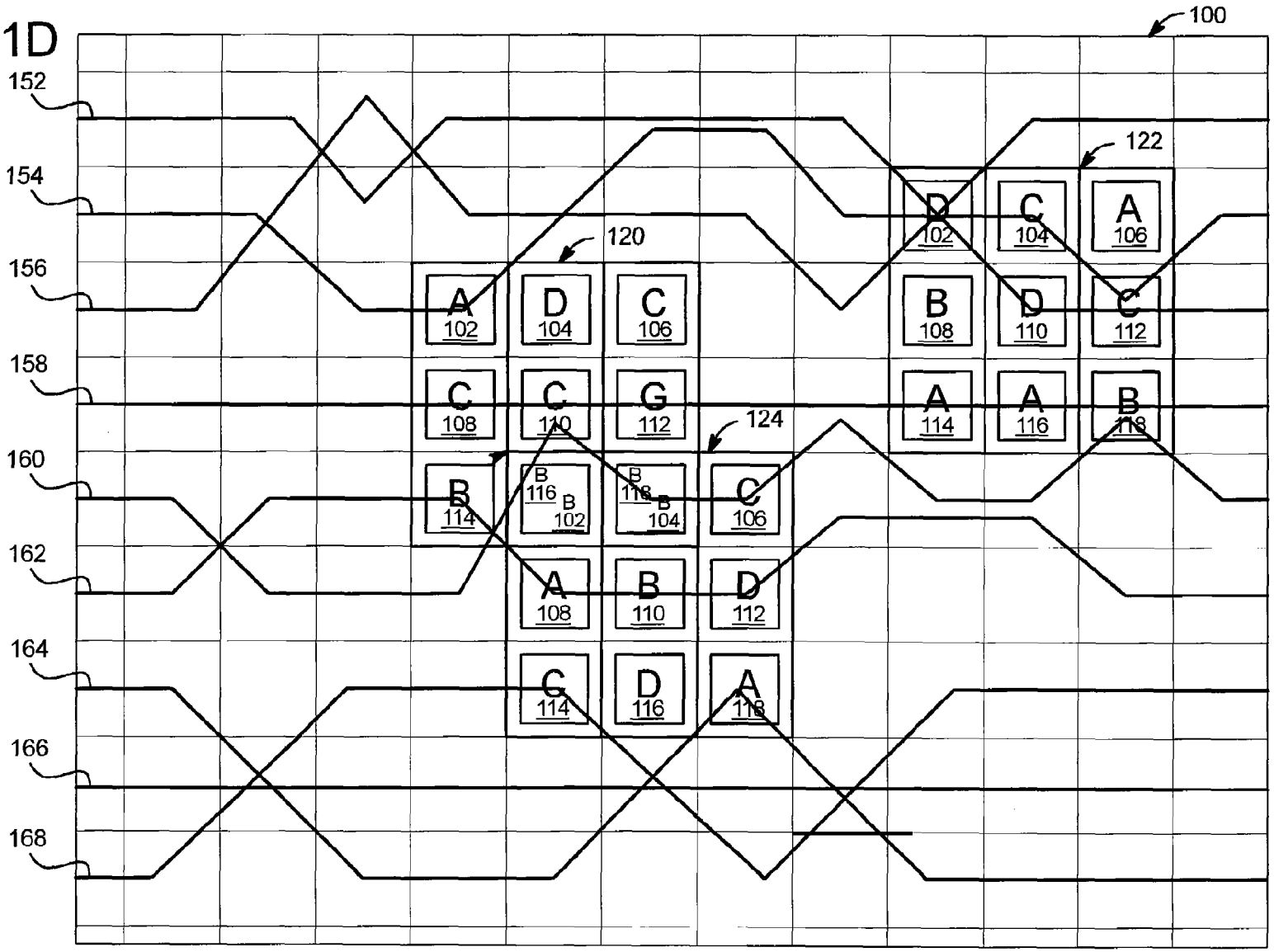

In addition, or alternatively, the symbol display areas may transition to one or more different paylines. More particularly, symbol display areas may transition from a first position to a second position in which at least one payline is associated with a different combination of symbol display areas. As illustrated in FIGS. 21C and 21D, in a first position, symbol display areas 120 are associated with paylines 152, 154 and 156; symbol display areas 122 are associated with paylines 158, 160 and 162; and symbol display areas 124 are associated with paylines 164, 166 and 168.

As indicated by the broken arrows in FIG. 21C, symbol display areas 120, 122 and 124 move to one or more different paylines. In the second position, symbol display areas 120 are associated with paylines 154, 158, 160 and 162; symbol display areas 122 are associated with paylines 152, 154 and 158; and symbol display areas 124 are associated with paylines 160, 162, 164 and 168.

In an embodiment, the gaming device may perform an evaluation of any winning symbol or combination of symbols displayed in a symbol display area indicated by an active payline, whether or not the symbol display areas are in the same or different sets of symbol display areas. For example, symbols displayed in symbol display areas 120, 122 and 124 associated with payline 162 illustrated in FIG. 21D may be evaluated for a winning symbol or combination of symbols.

As a result of a transition of more than one set of symbol display areas on one or more paylines, one or more symbol display areas may overlap on the same payline. In other words, a payline may be associated with two different symbols displayed in overlapping symbol display areas from more than one set of symbol display areas. For example, in FIG. 21D, symbol display areas 120 and 124 overlap on payline 160. In particular, symbol display area 118 of the set of symbol display areas 120 overlaps with symbol display area 104 of the set of symbol display areas 124. In an embodiment, if different symbols are displayed in overlapping symbol display areas, both symbols may be considered in an evaluation for a winning combination.

Figure 21E:
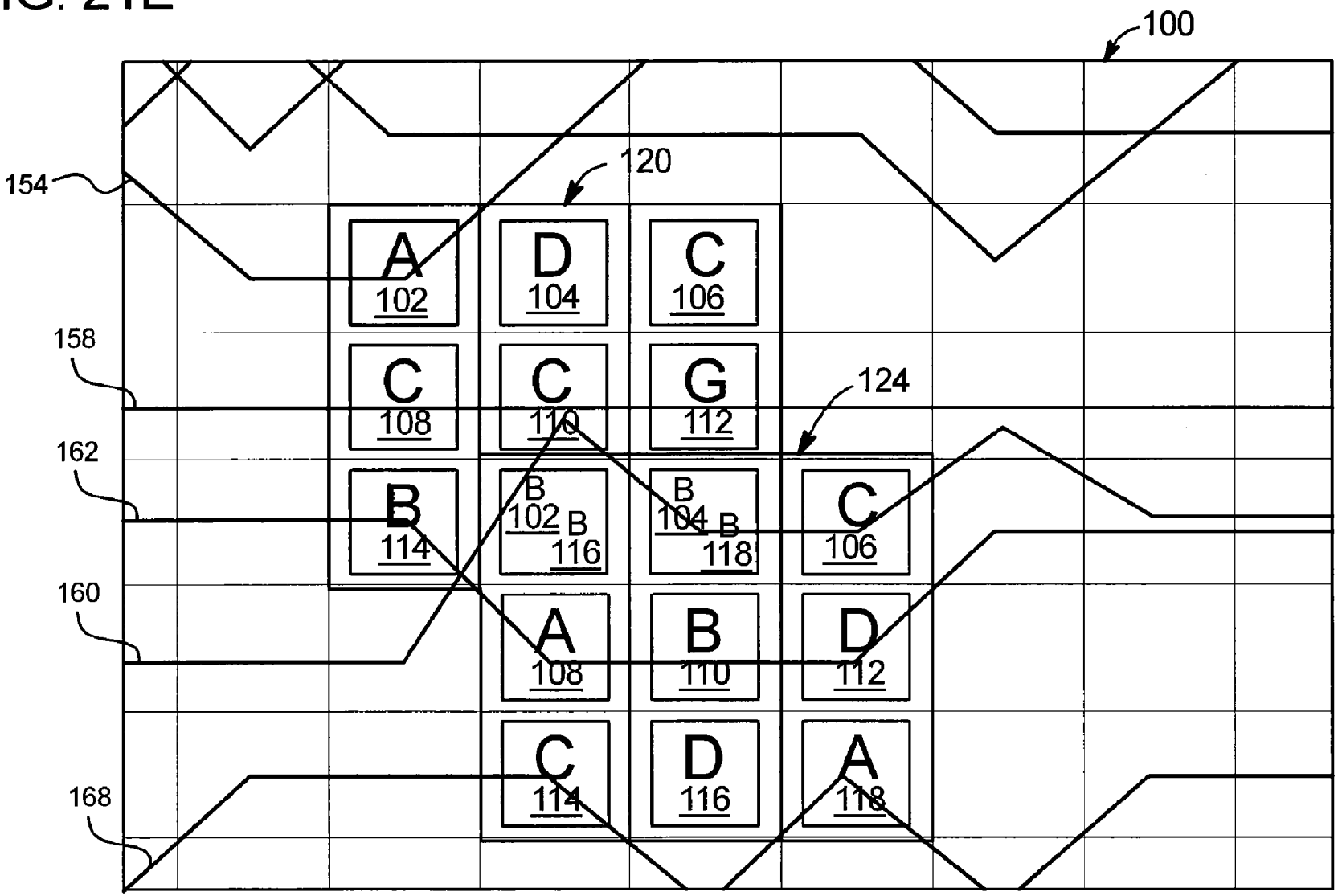
FIG. 21E is a front view of a portion of the display device of at least one embodiment disclosed herein illustrated in FIG. 21D illustrating an alternative transition of one or more paylines in relation to symbol display areas.

Alternatively, only symbols displayed along the same payline and displayed in the same set of symbol display areas may be evaluated for winning symbol or combination of symbols. FIG. 21E illustrates a portion of the display of FIG. 21D. As illustrated in FIG. 21E, payline 160 is associated with symbol display areas of the set of symbol display areas 120 displaying the symbols C and B. Payline 160 is also associated with symbol display areas of the set of symbol display areas 124 displaying the symbols C and C. Symbol display area 118 of the set of symbol display areas 120 displays the B symbol and overlaps with symbol display area 104 of the set of symbol display areas 124 which displays the C symbol. In an embodiment, the display may include an alternating display of both symbols or any other suitable indication of the symbols displayed in each of the overlapping symbol display areas. In an embodiment, either the B or the C, or both, may be considered in an evaluation for a winning combination of symbols. In the illustrated embodiment, the C in symbol display area set 120 combines with the two C symbols in symbol display area set 124 to form a combination of three C symbols which, in an embodiment, may be a winning outcome. Alternatively, only symbols along the same payline and displayed in the same set of symbol display areas may be evaluated for winning symbol or combination of symbols.

In an embodiment, outcomes associated with one or more transitions of one set of symbol display areas may be compared to outcomes associated with one or more transitions of another set of symbol display areas. Such an embodiment may be in the form of a competition game between selected sets of symbol display areas. The selection of the sets of symbol display areas may be performed by the gaming device in a predetermined or random fashion, by a player, or by one or more players. For example, one or more players may pick a set of symbol display areas on which to place a wager. The outcomes obtained upon one or more transitions of the set of symbol display areas selected by one player may be compared upon one or more transitions of the set of symbol display areas selected by other players to determine an outcome of the competition game.

In an embodiment, subsets of symbol display areas for evaluation of winning symbol combinations may be defined or indicated other than by paylines. As described above, symbol display areas may be activated based on a wager and/or based on symbols displayed in adjacent symbol display areas. For example, symbol display areas displaying at least two of a plurality of symbols associated together to form at least part of a winning combination of symbols may be grouped or linked into a subset of active symbol display areas sometimes referred to as "ways to win." Hence, in an embodiment, rather than determining an outcome to provide to the player by analyzing symbols generated and displayed in symbol display areas connected by an activated payline as described above, the gaming device determines any outcome to provide to the player based on the number of associated symbols which are generated in active symbol display areas on the requisite number of adjacent reels (i.e., not on paylines passing through any displayed winning symbol combinations).

In accordance with embodiments described herein, a transition of a subset of symbol display areas may include an evaluation of symbols displayed in each of a first plurality of symbol display areas and a subsequent evaluation of symbols displayed in each of a second plurality of symbol display areas. The second plurality of linked symbol display areas includes at least one symbol display area that is different than the symbol display areas in the first plurality of linked symbol display areas.

Figure 22A:
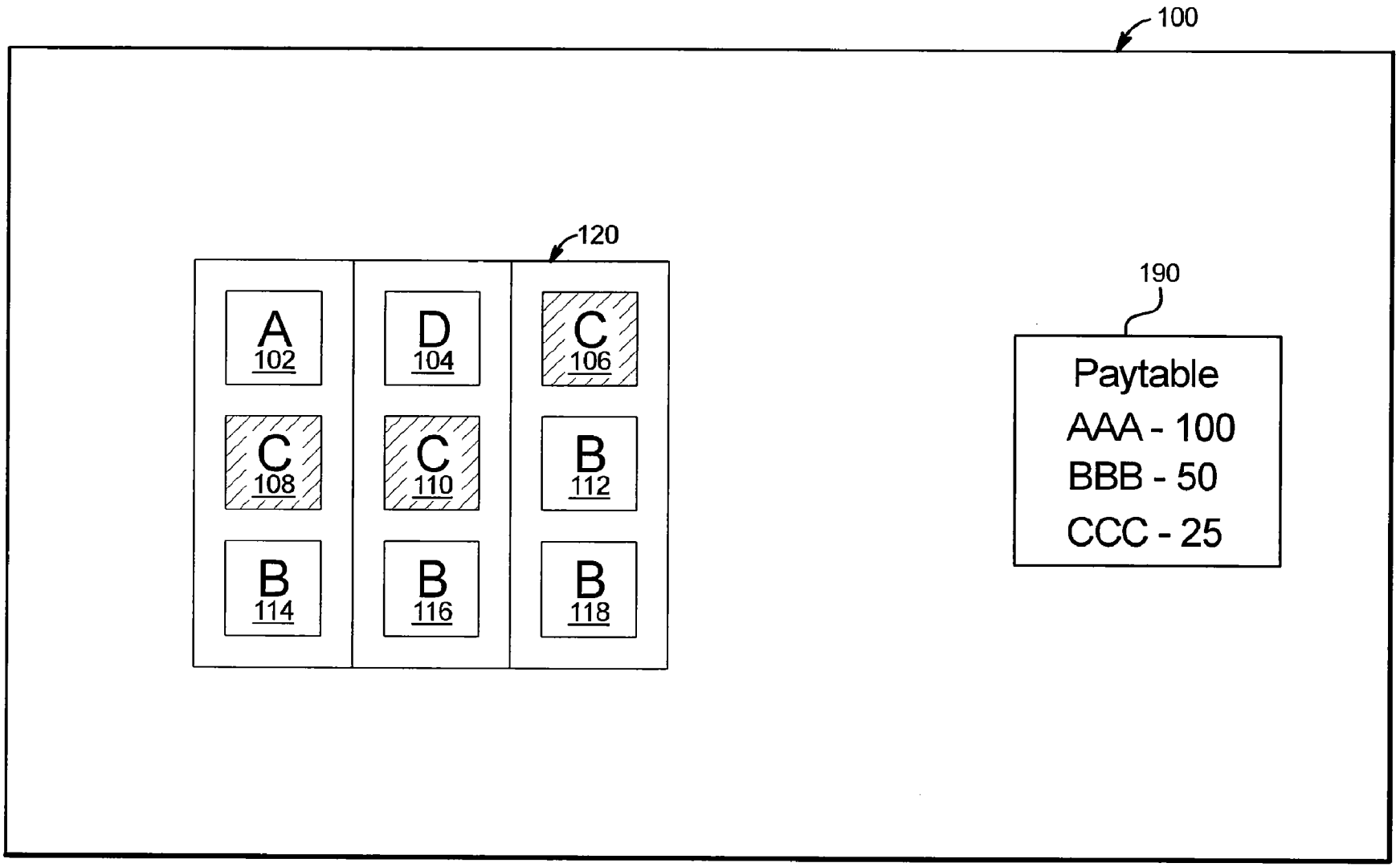
FIGS. 22A and 22B are front views of a display device of at least one embodiment disclosed herein illustrating an alternative transition of associated symbol display areas.
Figure 22B:
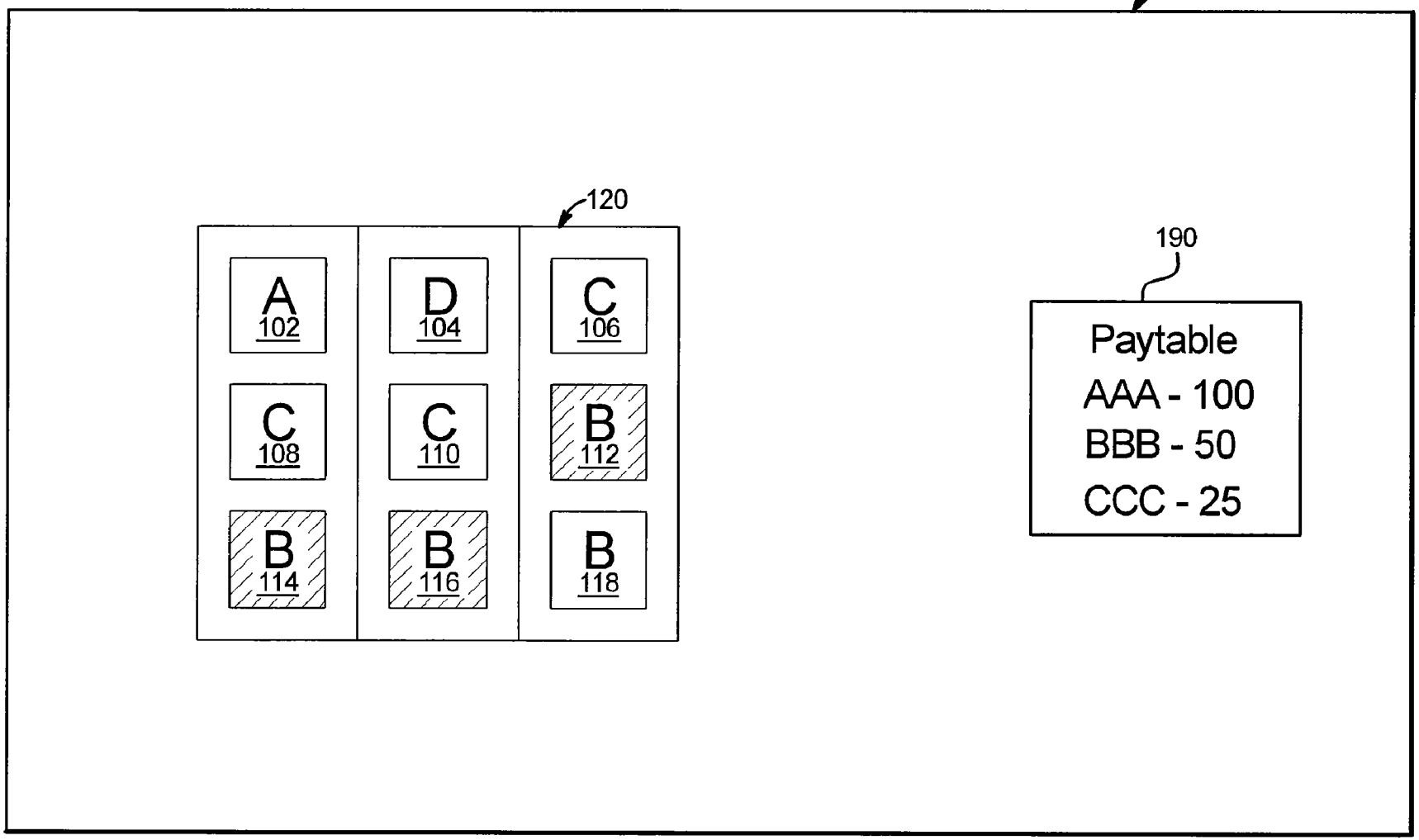

FIGS. 22A and 22B illustrate an embodiment including a number of activated symbol display areas. The player activates symbol display areas 102, 108 and 114. In the illustrated embodiment, default symbol display areas 110 and 106 not wagered on by the player are activated. Symbols are generated to be displayed in each of the symbol display areas including the activated symbol display areas, 102, 108, 114, 110 and 106 as illustrated in FIG. 22A.

In an embodiment, the gaming device individually determines if a symbol generated in active symbol display areas 102, 108 and 114 is part of a winning symbol combination with, or is otherwise suitably related to, a symbol generated in adjacent active symbol display area 110. Likewise, the gaming device individually determines if a symbol generated in active symbol display area 110 is part of a winning symbol combination with, or is otherwise suitably related to, a symbol generated in adjacent active symbol display area 106.

In FIG. 22A, each of the symbol display areas 108, 110 and 106 displays the letter C. In the exemplary embodiment, three C symbols are related as the same symbols and are associated with a winning outcome as illustrated in paytable 190. Accordingly, the symbols displayed in symbol display areas 108, 110 and 106 are related such that symbol display areas 108, 110 and 106 form a plurality of linked or associated symbol display areas.

A transition of the plurality of linked symbol display areas may include, for example a shift from symbol display areas 108, 110 and 106 to activate symbol display areas 114, 116 and 112, as illustrated in FIG. 22B. The gaming device may individually determine if symbols generated in active symbol display areas 114, 116 and 112 are part of a winning symbol combination or are otherwise suitably related as described above. In the exemplary embodiment, three B symbols displayed in symbol display areas 114, 116 and 112 are associated with a winning outcome. Although the configuration of linked symbol display areas (two symbol display areas in the same row of the first two columns and a symbol display area in the row above that row in the third column) is maintained in the exemplary transition, it should be appreciated that the transition of associated activated symbol display areas may or may not include the same configuration of associated activated symbol display areas.

It should be understood that various changes and modifications to the embodiments described herein will be apparent to those skilled in the art. Such changes and modifications can be made without departing from the spirit and scope of the present subject matter and without diminishing its intended advantages. It is therefore intended that such changes and modifications be covered by the appended claims.

The invention is claimed as follows:

1. A gaming device comprising:

at least one input device;

at least one display device;

at least one processor; and at least one memory device which stores a plurality of instructions, which when executed by the at least one processor, cause the at least one processor to operate with the at least one display device and the at least one input device, for a play of a game, to:

enable a player to wager on a payline associated with a first plurality of symbol display areas, randomly generate a plurality of symbols to be displayed in said symbol display areas, perform a first evaluation of the symbols displayed in the first plurality of symbol display areas associated with said payline for any winning symbol or winning combination of symbols, provide any awards resulting from said first evaluation to the player, display a transition of said payline from a first position to a second position wherein said payline is displayed in association with a second plurality of symbol display areas, wherein before said transition, a section of said payline is displayed not in association with any of said symbol display areas, wherein at least one symbol display area in said second plurality of symbol display areas is different from the symbol display areas of said first plurality of symbol display areas, and wherein after said transition, the section of said payline that was displayed not in association with any of the symbol display areas before said transition is displayed in association with at least one of said second plurality of symbol display areas, perform a second evaluation of the symbols displayed in said second plurality of symbol display areas associated with said payline including said section of the payline for any winning symbol or winning symbol combination, and provide any awards resulting from said second evaluation to the player.

2. The gaming device of claim 1, wherein the at least one display device includes at least one reel.

3. The gaming device of claim 1, wherein the at least one display device includes at least one independent reel, wherein when executed by the at least one processor, the plurality of instructions cause the at least one processor to operate with the at least one display device and the at least one input device to, for each independent reel, display one of the symbols in a different one of the symbol display areas.

4. The gaming device of claim 1, wherein a plurality of symbol display areas in said second plurality of symbol display areas are different from the symbol display areas of said first plurality of symbol display areas.

5. The gaming device of claim 1, wherein when executed by the at least one processor, the plurality of instructions cause the at least one processor to operate with the at least one display device and the at least one input device to display the payline in association with the second plurality of symbol display areas after an occurrence of a triggering event.

6. The gaming device of claim 1, wherein the transition of the payline is in at least one direction selected from the group consisting of a horizontal direction, a vertical direction, and a diagonal direction.

7. The gaming device of claim 1, wherein the display of the transition from said first position to said second position includes a transition of at least one of the symbol display areas.

8. The gaming device of claim 7, wherein the transition of said symbol display area is in a direction selected from the group consisting of a horizontal direction, a vertical direction, and a diagonal direction.

9. The gaming device of claim 1, wherein when executed by the at least one processor, the plurality of instructions cause the at least one processor to operate with the at least one display device and the at least one input device to display a number of subsequent payline transitions, said number being at least one.

10. The gaming device of claim 9, which includes an evaluation after each subsequent payline transition, wherein any awards resulting from said subsequent evaluations are provided to the player.

11. The gaming device of claim 10, wherein the number of payline transitions and evaluations is based on an amount of a wager.

12. The gaming device of claim 10, wherein the number of payline transitions and evaluations is based on an outcome in a game.

13. The gaming device of claim 1, wherein for each transition of the payline, any award associated with a winning symbol or winning combination of symbols associated with the payline is increased.

14. The gaming device of claim 1, wherein said payline includes at least one payline indicator, wherein the extent of the transition of said payline is based on a location of the payline indicator on the payline.

15. The gaming device of claim 1, wherein said payline includes at least one payline indicator, wherein, after said transition of the payline to said second position, said payline indicator modifies any award associated with a winning symbol or winning combination of symbols associated with said payline.

16. The gaming device of claim 1, wherein said payline includes at least one payline indicator, wherein, upon association of said payline indicator with one of the symbol display areas, said processor is programmed to replace a first one of the symbols displayed in said symbol display area with a second one of the symbols.

17. The gaming device of claim 1, wherein when executed by the at least one processor, the plurality of instructions cause the at least one processor to operate with the at least one display device and the at least one input device to display a plurality of paylines, each associated with a different first plurality of symbol display areas and to enable the player to wager on one, a plurality of, or all of said paylines.

18. The gaming device of claim 17, wherein, for each of said paylines, when executed by the at least one processor, the plurality of instructions cause the at least one processor to operate with the at least one display device and the at least one input device to display a transition of said payline from a first position to a second position wherein said payline is displayed in association with a second plurality of symbol display areas, and wherein at least one symbol display area in said second plurality of symbol display areas is different from the symbol display areas of said first plurality of symbol display areas.

19. The gaming device of claim 18, wherein the plurality of paylines transition as a group.

20. The gaming device of claim 18, wherein transition of the plurality of paylines is in a direction selected from the group consisting of a horizontal direction, a vertical direction, and a diagonal direction.

21. A gaming device comprising:

at least one input device;

at least one display device;

at least one processor; and at least one memory device which stores a plurality of instructions, which when executed by the at least one processor, cause the at least one processor to operate with the at least one display device and the at least one input device, for a play of a game, to:

enable a player to wager on a play of the game, display a first payline in association with a plurality of symbol display areas, display a second payline, said second payline displayed not in association with any of the symbol display areas, randomly generate a plurality of symbols to be displayed in said symbol display areas, perform a first evaluation of the symbols displayed in any symbol display areas associated with said first payline for any winning symbol or winning combination of symbols, provide any awards resulting from said first evaluation to the player, display a transition of said second payline from a first position to a second position wherein at least a portion of said second payline is displayed in association with a plurality of the symbol display areas in said second position, perform a second evaluation of the symbols displayed in the symbol display areas associated with said portion of said payline for any winning symbol or winning combination of symbols, an provide any awards resulting from said second evaluation to the player.

22. The gaming device of claim 21, wherein the at least one display device includes at least one reel.

23. The gaming device of claim 21, wherein when executed by the at least one processor, the plurality of instructions cause the at least one processor to operate with the at least one display device and the at least one input device to display a transition of said first payline from a first position to a second position, wherein at least a portion of said first payline is displayed not in association with the symbol display areas in said second position.

24. The gaming device of claim 21, when executed by the at least one processor, the plurality of instructions cause the at least one processor to operate with the at least one display device and the at least one input device to display a transition of said first payline from a first position to a second position, wherein at least one of the symbol display areas associated with said first payline in said second position is different from any symbol display areas associated with said first payline in said first position.

25. The gaming device of claim 21, when executed by the at least one processor, the plurality of instructions cause the at least one processor to operate with the at least one display device and the at least one input device to display a number of subsequent payline transitions, said number being at least one, and to perform an evaluation after each subsequent payline transition, wherein any awards resulting from said subsequent evaluations are provided to the player.

26. The gaming device of claim 21, wherein when executed by the at least one processor, the plurality of instructions cause the at least one processor to operate with the at least one display device and the at least one input device to display a plurality of paylines, each payline displayed in association with a plurality of symbol display areas and to enable the player to wager on one, a plurality of, or all of said paylines.

27. The gaming device of claim 26, wherein, for each of said plurality of paylines, when executed by the at least one processor, the plurality of instructions cause the at least one processor to operate with the at least one display device and the at least one input device to display a transition of said payline from a first position to a second position, wherein at least a portion of each of said plurality of paylines is displayed not in association with a plurality of the symbol display areas in said second position.

28. The gaming device of claim 27, wherein transition of the plurality of paylines is in a direction selected from the group consisting of a horizontal direction, a vertical direction, and a diagonal direction.

29. A gaming device comprising:

at least one input device;

at least one display device;

at least one processor; and at least one memory device which stores a plurality of instructions, which when executed by the at least one processor, cause the at least one processor to operate with the at least one display device and the at least one input device, for a play of a game, to:

enable a player to wager on a payline associated with a plurality of reels including a plurality of symbols configured to be displayed at a plurality of symbol display areas, prior to spinning at least one of the plurality of reels, display at least one portion of said payline not in association with any of the symbol display areas;

spin at least one of the plurality of reels, during the spinning of the at least one of the plurality of reels, display a transition of said payline from a first position, wherein said at least one portion of said payline is displayed not in association with any of the plurality of symbol display areas, to a second position, wherein said at least one portion of said payline is displayed in association with at least one of the symbol display areas, stop the reels to display a plurality of symbols in the symbol display areas, for said wagered-on payline, perform an evaluation of the symbols displayed in the symbol display areas associated with said at least one portion of said payline for any winning symbol or winning symbol combination, and provide to the player any awards resulting from said evaluation.

30. The gaming device of claim 29, wherein when executed by the at least one processor, the plurality of instructions cause the at least one processor to operate with the at least one display device and the at least one input device to enable the player to perceive an apparent control of at least one of stopping the reels and determining the second position of the transition.

31. A method of operating a gaming device, said method comprising:

causing at least one display device to display a plurality of symbol display areas;

enabling a player to wager on a payline displayed in association with a first plurality of said symbol display areas;

randomly generating a plurality of symbols to be displayed in said symbol display areas;

performing a first evaluation of the symbols displayed in the first plurality of symbol display areas associated with said payline for any winning symbol or winning symbol combination;

providing to the player any awards resulting from said first evaluation;

causing the at least one display device to display a transition of said payline from a first position to a second position, wherein before said transition, a section of said payline is displayed not in association with any of said symbol display areas, wherein said payline is displayed in association with a second plurality of said symbol display areas, and wherein at least one of said symbol display areas is different from the symbol display areas of said first plurality of symbol display area, and wherein after said transition, the section of said payline that was displayed not in association with any of the symbol display areas before said transition is displayed in association with said second plurality of symbol display areas;

performing a second evaluation of the symbols displayed in said second plurality of the symbol display areas associated with said payline including said section of the payline for any winning symbol or winning symbol combination; and providing any awards resulting from said second evaluation to the player.

32. The method of claim 31, which includes causing the at least one display device to display a number of a subsequent payline transitions, said number being at least one and performing an evaluation after each subsequent payline transition, wherein any awards resulting from said subsequent evaluations are provided to the player.

33. The method of claim 31, which includes causing the at least one display device to display a plurality of paylines, each associated with a different first plurality of symbol display areas and enabling the player to wager on one, a plurality of, or all of said paylines.

34. The method of claim 33, which includes, for each of said plurality of paylines, causing the at least one display device to display a transition of said payline from a first position to a second position wherein said payline is displayed in association with a second plurality of symbol display areas, and wherein at least one symbol display area in said second plurality of symbol display areas is different from the symbol display areas of said first plurality of symbol display areas.

35. A method of operating a gaming device, said method comprising:

providing a game having a plurality of symbol display areas;

enabling a player to wager on a play of the game;

causing at least one display device to display a first payline in association with a plurality of the symbol display areas;

causing the at least one display device to display a second payline, said payline displayed not in association with any of the symbol display areas;

randomly generating a plurality of said symbols to be displayed in said plurality of symbol display areas;

performing a first evaluation of the symbols displayed in any symbol display areas associated with said first payline for any winning symbol or winning symbol combination;

providing any awards resulting from said first evaluation to the player;

causing the at least one display device to display a transition of said second payline from a first position to a second position wherein at least a portion of said second payline is displayed in association with a plurality of the symbol display areas in said second position, and wherein at least one of the symbol display areas associated with said portion of said payline in said second position is different from any symbol display areas associated with said portion of said payline in said first position;

performing a second evaluation of the symbols displayed in the symbol display areas associated with said portion of said payline for any winning symbol or winning symbol combination; and providing any awards resulting from said second evaluation to the player.

36. The method of claim 35, which includes causing the at least one display device to display a transition of said first payline from a first position to a second position, wherein at least a portion of said first payline is displayed not in association with the symbol display areas in said second position.

37. A method of operating a gaming device, said method comprising:

causing at least one display device to display a plurality of reels including a plurality of symbols configured to be displayed at a plurality of symbol display areas;

enabling a player to wager on a payline associated with said plurality of reels;

prior to spinning at least one of the reels, displaying at least one portion of said payline not in association with any of the symbol display areas;

spinning at least one of the plurality of reels;

during the spinning of the at least one of the plurality of reels, displaying a transition of said payline from a first position, wherein said at least one portion of said payline is displayed not in association with any of the symbol display areas, to a second position, wherein said at least one portion of said payline is displayed in association with at least one of the symbol display areas in said second position;

stopping the reels to display a plurality of symbols in the plurality of symbol display areas;

for said wagered-on payline, performing an evaluation of the symbols displayed in the symbol display areas associated with said at least one portion of said payline for any winning symbol or winning symbol combination; and providing to the player any awards resulting from said evaluation.

38. The method of claim 37, which includes causing the at least one display device to display a transition of at least a second portion of said payline from a third position, wherein said second portion of said payline is displayed in association with at least one of the plurality of the symbol display areas to a fourth position, wherein said second portion of said payline is displayed not in association with any of the symbol display areas in said fourth position.

39. The method of claim 37, which includes enabling the player to perceive an apparent control of at least one of stopping the reels and determining the second position of the transition.

* * * * *

UNITED STATES PATENT AND TRADEMARK OFFICE

CERTIFICATE OF CORRECTION

PATENT NO. : 7,601,062 B2
APPLICATION NO. : 11/556969
DATED : October 13, 2009
INVENTOR(S) : Cole et al.

It is certified that error appears in the above-identified patent and that said Letters Patent is hereby corrected as shown below:

IN THE CLAIMS:

In Claim 21, Column 46, line 65, replace "a" second occurrence with --the--.

In Claim 32, Column 49, line 13, delete "a" second occurrence.

Signed and Sealed this

Sixth Day of July, 2010

David J. Kappos

David J. Kappos
*Director of the United States Patent and Trademark Office*